US010811796B2

(12) United States Patent
Ito

(10) Patent No.: US 10,811,796 B2
(45) Date of Patent: Oct. 20, 2020

(54) CONNECTOR AND CONNECTOR TERMINAL TO BE USED IN THE CONNECTOR

(71) Applicant: PANASONIC INTELLECTUAL PROPERTY MANAGEMENT CO., LTD., Osaka (JP)

(72) Inventor: Chikara Ito, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/394,808

(22) Filed: Apr. 25, 2019

(65) Prior Publication Data

US 2019/0334265 A1 Oct. 31, 2019

(30) Foreign Application Priority Data

Apr. 27, 2018 (JP) ..... 2018-087648
Apr. 27, 2018 (JP) ..... 2018-087650
Apr. 27, 2018 (JP) ..... 2018-087705

(51) Int. Cl.
*H01R 12/00* (2006.01)
*H01R 12/72* (2011.01)

(52) U.S. Cl.
CPC ..... *H01R 12/721* (2013.01)

(58) Field of Classification Search
CPC ..... H01R 12/721
USPC ..... 439/626
See application file for complete search history.

(56) References Cited

U.S. PATENT DOCUMENTS 5,306,169 A * 4/1994 Fukushima ..... H01R 12/712 439/248
5,993,268 A * 11/1999 Yamaguchi ..... H01R 13/432 439/746
7,186,126 B2 * 3/2007 Umehara ..... H01R 13/33 439/247
7,517,232 B2 * 4/2009 Yuan ..... H01R 13/2442 439/79
8,023,272 B2 * 9/2011 Shimizu ..... H01R 4/185 361/752

(Continued)

FOREIGN PATENT DOCUMENTS

JP 2005-322658 A 11/2005
JP 2016-110994 A 6/2016

OTHER PUBLICATIONS

U.S. Appl. No. 16/394,866 to Chikara Ito, filed Apr. 25, 2019.
U.S. Appl. No. 16/394,761 to Chikara Ito, filed Apr. 25, 2019.
U.S. Appl. No. 16/394,713 to Chikara Ito, filed Apr. 25, 2019.

*Primary Examiner* — Abdullah A Riyami
*Assistant Examiner* — Nelson R. Burgos-Guntin
(74) *Attorney, Agent, or Firm* — Greenblum & Bernstein, P.L.C.

(57) ABSTRACT

A connector includes a housing and a terminal held in the housing and to be mounted on a mounting member disposed outside the housing. The terminal includes a main body part inserted into a space formed in the housing, a leg part extending from the main body part toward a mounting surface of the mounting member in a state where the terminal is mounted on the mounting member, and a mounting part provided continuously from the leg part and to be mounted on the mounting member. The connector further includes a leg part holder connected to the housing and to hold the leg part.

18 Claims, 35 Drawing Sheets

(56) References Cited

U.S. PATENT DOCUMENTS

| | | | | |
|---|---|---|---|---|
| 8,202,126 | B2 * | 6/2012 | Lim | H01R 13/6581 439/607.31 |
| 8,241,073 | B2 * | 8/2012 | Hemmi | H01R 13/41 439/752 |
| 2002/0098733 | A1 * | 7/2002 | Okamura | H01R 13/6335 439/483 |
| 2004/0110402 | A1 * | 6/2004 | Jones | B60N 2/0224 439/137 |
| 2007/0093089 | A1 * | 4/2007 | Ford | H01H 9/10 439/76.2 |
| 2015/0004828 | A1 * | 1/2015 | Osada | H01R 13/639 439/357 |
| 2015/0229067 | A1 * | 8/2015 | Nakai | H01R 13/5202 439/587 |
| 2015/0380841 | A1 * | 12/2015 | Toratani | H01R 12/724 439/620.26 |
| 2017/0324179 | A1 | 11/2017 | Ito et al. | |
| 2019/0052009 | A1 | 2/2019 | Hayashi et al. | |
| 2019/0148884 | A1 * | 5/2019 | Sugiki | H01R 13/6315 439/247 |

* cited by examiner 14
142
149
149a
143
144
140
145a
147
147a
148(140a)
146
148a
146a
145
148b
141
145
146
140a

CONNECTOR AND CONNECTOR TERMINAL TO BE USED IN THE CONNECTOR

CROSS REFERENCE TO RELATED APPLICATIONS

This application is based upon and claims the benefit of priority from prior Japanese Patent Applications No. 2018-087648, No. 2018-087650, and No. 2018-087705, each filed on Apr. 27, 2018; the entire contents of which are incorporated by reference herein.

BACKGROUND OF THE INVENTION

The present disclosure relates to a connector and a connector terminal to be used in the connector.

There has heretofore been known a connector including a housing and terminals which are housed in the housing and are to come into conduction with terminals of an opposing connector, as disclosed in Japanese Patent Application Publication No. 2016-110994 (hereinafter referred to as Patent Literature 1).

In Patent Literature 1, the terminals each include a terminal main body housed in the housing and a leg part extending from the terminal main body. The leg part has a mounting part formed at its tip, which is to be mounted on a cable (mounting member). This mounting part is disposed to be exposed from the housing with the terminal main body housed in the housing, thus enabling the connector and the cable (mounting member) to be easily connected to each other.

There has also been known a connector including terminals to which electric wires are connected, a housing with a plurality of spaces formed therein to insert the terminals, and a retainer attached to the housing to restrict fall-off of the terminals from the housing, as disclosed in Japanese Patent Application Publication No. 2005-322658 (hereinafter referred to as Patent Literature 2).

In Patent Literature 2, the retainer attached to the housing is moved to a locking position, and a locking protrusion formed in the retainer is locked to the terminals inserted into the housing. In this way, the retainer restricts fall-off of the terminals.

Furthermore, in Patent Literature 2, two upper and lower space groups are formed in the housing, each group having a plurality of spaces arranged therein in the width direction, and a plurality of terminals having approximately the same shape are inserted into the upper and lower spaces, respectively. Here, the terminals inserted in the upper spaces are inverted to the terminals inserted in the lower spaces. Then, two retainers are attached to upper and lower parts of the housing, and the respective retainers are moved to locking positions. Accordingly, the terminals inserted into the upper spaces and the terminals inserted into the lower spaces are locked by the retainers, and thus prevented from falling off.

SUMMARY OF THE INVENTION

However, with the prior art of Patent Literature 1 described above, the leg part extending from the terminal main body may be deformed during insertion of the terminal into the housing, or the like. Such deformation of the leg part of the terminal may shift the position of the mounting part, which may cause a situation where the terminal can no longer be mounted on the mounting member.

Therefore, it is an object of the present disclosure to achieve a connector capable of more surely mounting terminals on a mounting member and a connector terminal to be used in the connector.

Meanwhile, such a structure as in the prior art described in Patent Literature 2 with the terminals inserted into the upper and lower spaces of the housing can achieve reduction in size of the connector in the width direction. Furthermore, an increase in height of the connector can be suppressed by inserting the terminals in the states inverted to each other into the upper and lower spaces, respectively.

However, the insertion of the terminals in the states inverted to each other into the upper and lower spaces of the housing require two retainers to be attached to the upper and lower parts of the housing, leading to a complicated structure of the connector.

As described above, the prior art described in Patent Literature 2 cannot achieve reduction in size of the connector without complicating its structure.

Therefore, it is an object of the present disclosure to achieve a connector that can be formed with a simpler configuration while achieving reduction in size thereof.

A connector according to the present disclosure includes a housing and a terminal held in the housing and to be mounted on a mounting member disposed outside the housing. The terminal includes a main body part inserted into a space formed in the housing, a leg part extending from the main body part toward a mounting surface of the mounting member in a state where the terminal is mounted on the mounting member, and a mounting part provided continuously from the leg part and to be mounted on the mounting member. The connector further includes a leg part holder connected to the housing and to hold the leg part.

A connector terminal according to the present disclosure is to be used in the connector.

A connector according to the present disclosure includes: a plurality of terminals to which an electric wire is connected respectively; a housing having a plurality of spaces formed therein, into which the terminal is inserted respectively, and a retainer attached to the housing, and to restrict fall-off of the terminals from the housing. The terminals each include a terminal main body part having a peripheral wall extending in an insertion direction of the terminal into the space, a contact part provided continuously from one side, in the insertion direction, of the terminal main body part, and an electric wire connector part provided continuously from the other side, in the insertion direction, of the terminal main body part, and to have the electric wire connected thereto. The contact part is formed at a position off the center of the electric wire extending in the insertion direction, when viewed along the insertion direction, and the spaces include a first space and a second space, which are formed on the upper and lower sides, respectively, of the housing disposed with the insertion direction aligned with a horizontal direction. The terminal to be inserted into the first space is inserted into the first space in a state where the contact part is positioned on the lower side when the housing is disposed such that the first space is positioned above the second space. The terminal to be inserted into the second space is inserted into the second space in a state where the contact part is positioned on the upper side when the housing is disposed such that the first space is positioned above the second space. Each of the terminals includes a first insertion hole and a second insertion hole in the peripheral wall, the first insertion hole opened upward and the second insertion hole opened downward when the terminal is disposed with the insertion direction aligned with the horizontal direction and the contact part positioned on the lower side. The retainer includes a retainer main body attached to the housing so as to be slidable in a top-bottom direction, when the housing is disposed such that the first space is positioned above the second space. The retainer main body includes a first restrictive protrusion to restrict fall-off of the terminal inserted into the first space and a second restrictive protrusion to restrict fall-off of the terminal inserted into the second space when the retainer main body is slid toward one side of the top-bottom direction. When the retainer main body is slid toward the one side, the first restrictive protrusion is inserted into either one of the first and second insertion holes, and the second restrictive protrusion is inserted into the other.

According to the present disclosure, a connector capable of more surely mounting terminals on a mounting member and a connector terminal to be used in the connector can be achieved.

Moreover, according to the present disclosure, a connector that can be formed with a simpler configuration while achieving reduction in size thereof can be achieved.

DESCRIPTION OF THE EMBODIMENTS

With reference to the drawings, an embodiment of the present disclosure is described in detail below. The following description is given of a plug connector 1 mounted on a cable 1A, a receptacle connector 2 mounted on a circuit board 2A, and a receptacle connector 3 to which electric wires 3A are connected.

Note that, as for the plug connector 1 and the receptacle connector 2, description is given assuming that a direction perpendicular to (normal to) a mounting surface of a mounting member in a state where each of the connectors is mounted on the mounting member is a top-bottom direction (Z direction). Also, description is given assuming that a direction in which terminals housed in a housing of each connector are arranged is a width direction (Y direction) and a direction in which the terminals are inserted into the housing of each connector is a front-rear direction (X direction).

Furthermore, the top side in a state where the connector mounted on the mounting member is located on the upper side of the mounting surface is defined as the top of the top-bottom direction, while the side on which the connectors face each other when fitted together is defined as the front of the front-rear direction.

As for the receptacle connector 3, description is given assuming that a direction in which the terminals housed in the housing are arranged is the width direction (Y direction) and a direction in which the terminals are inserted into the housing is the front-rear direction (X direction). Also, description is given assuming that the direction intersecting with the width direction (Y direction) and the front-rear direction (X direction) is the top-bottom direction (Z direction).

Moreover, the side of the housing on which the retainer is inserted is defined as the top of the top-bottom direction, while the side on which the connectors face each other when fitted together is defined as the front of the front-rear direction.

Configuration Example of Connector Set

Figure 1:
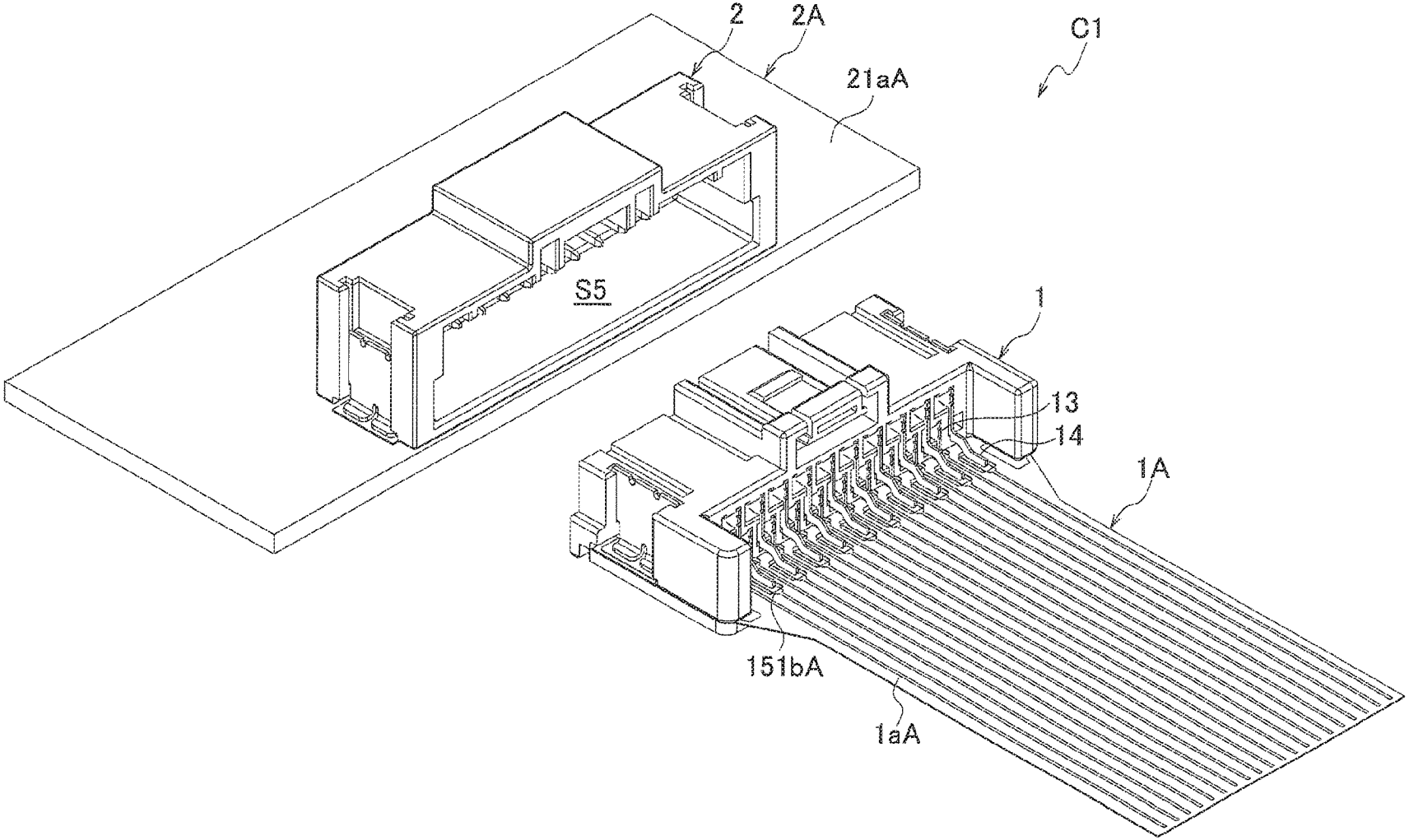
FIG. 1 is an exploded perspective view showing an example of a connector set including a plug connector mounted on a cable and a receptacle connector mounted on a circuit board.
Figure 2:
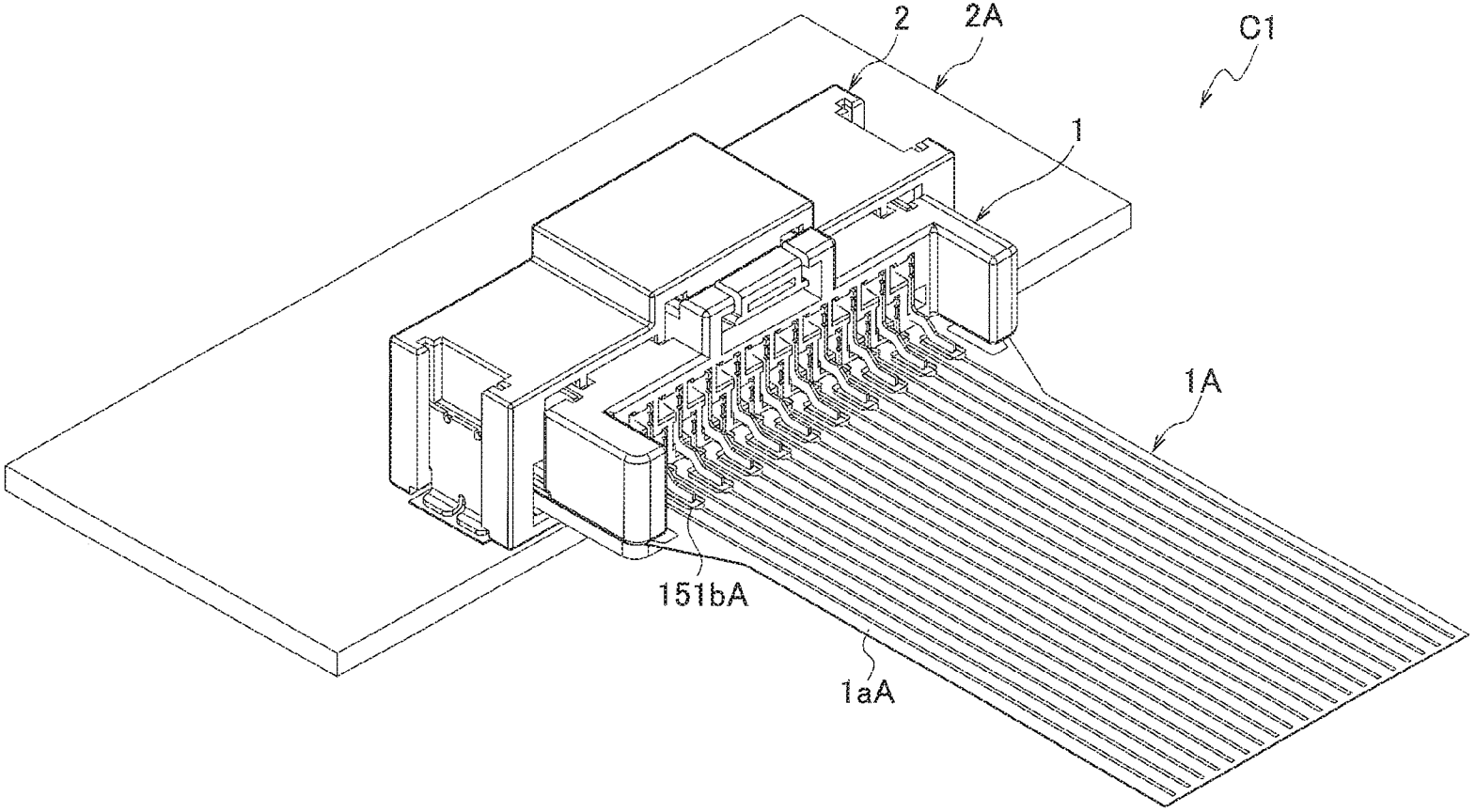
FIG. 2 is a perspective view showing an example of the connector set in a state where the plug connector mounted on the cable and the receptacle connector mounted on the circuit board are fitted together.
Figure 3A:
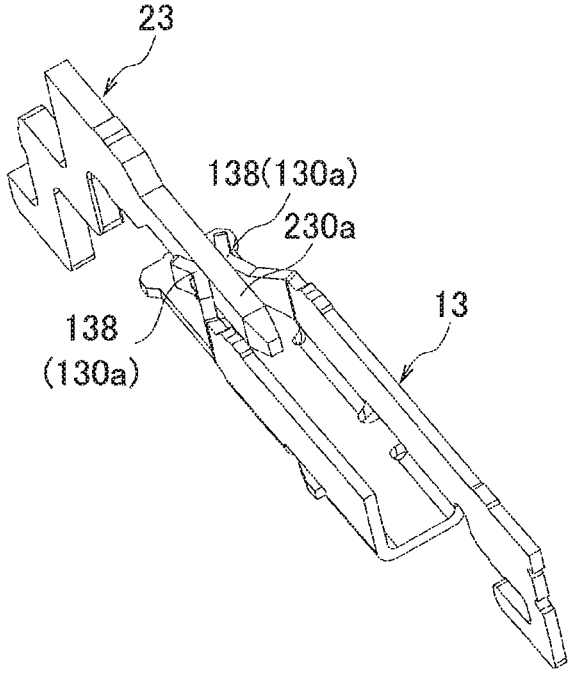
FIG. 3A and FIG. 3B are perspective views showing contact states of terminals on the plug connector side and terminals on the receptacle connector side of the connector set shown as an example, FIG. 3A showing a contact state of a first terminal on the plug connector side and a first terminal on the receptacle connector side and FIG. 3B showing a contact state of a second terminal on the plug connector side and a second terminal on the receptacle connector side.
Figure 3B:
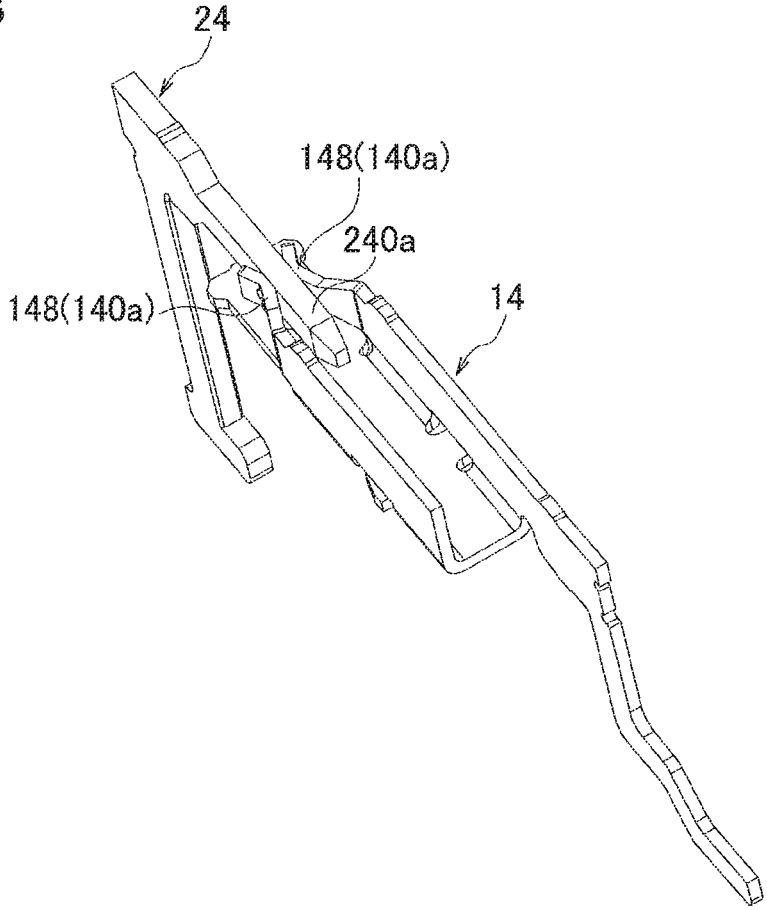
Figure 4:
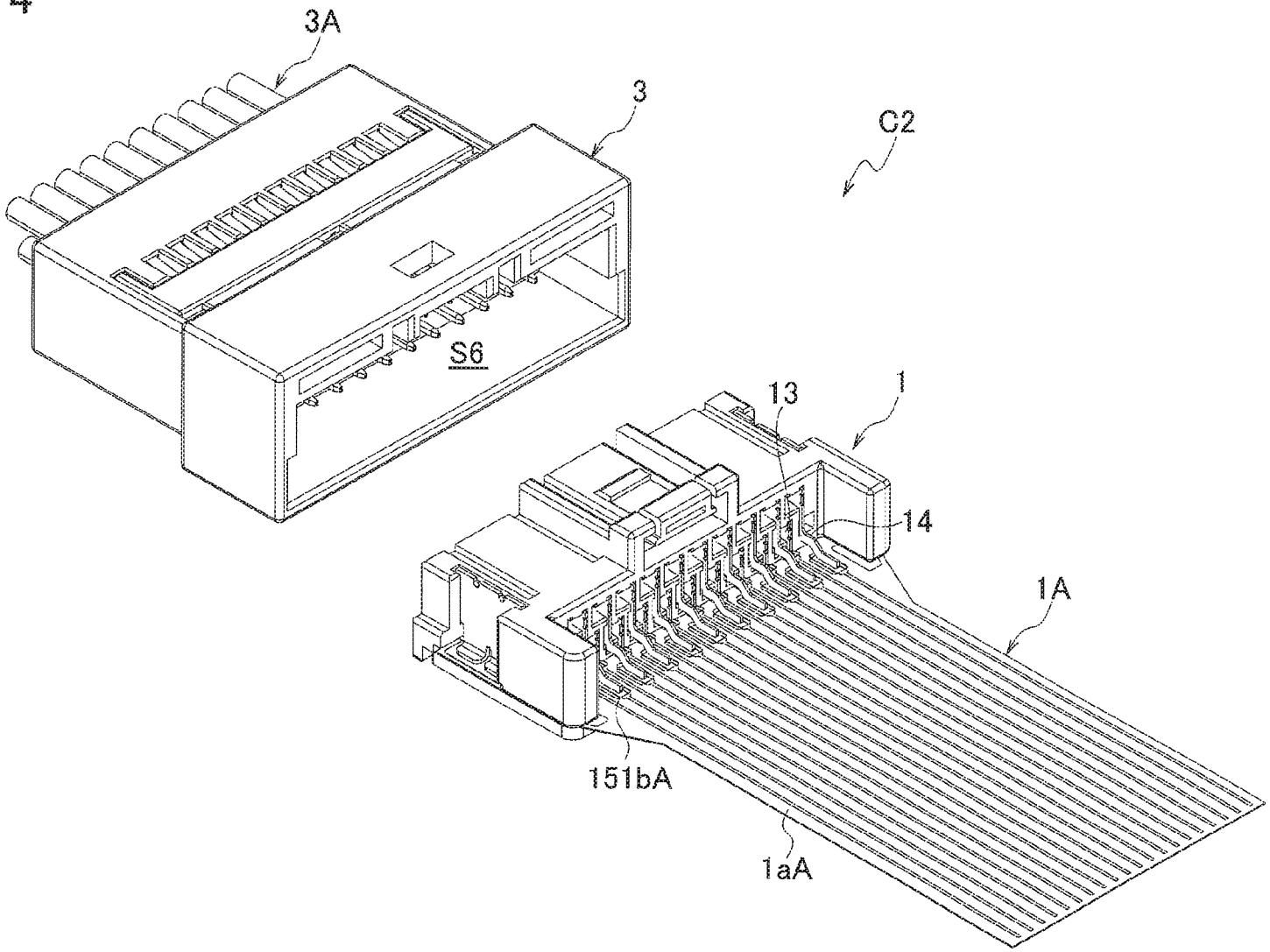
FIG. 4 is an exploded perspective view showing another example of a connector set including a plug connector mounted on a cable and a receptacle connector connected to electric wires.
Figure 5:
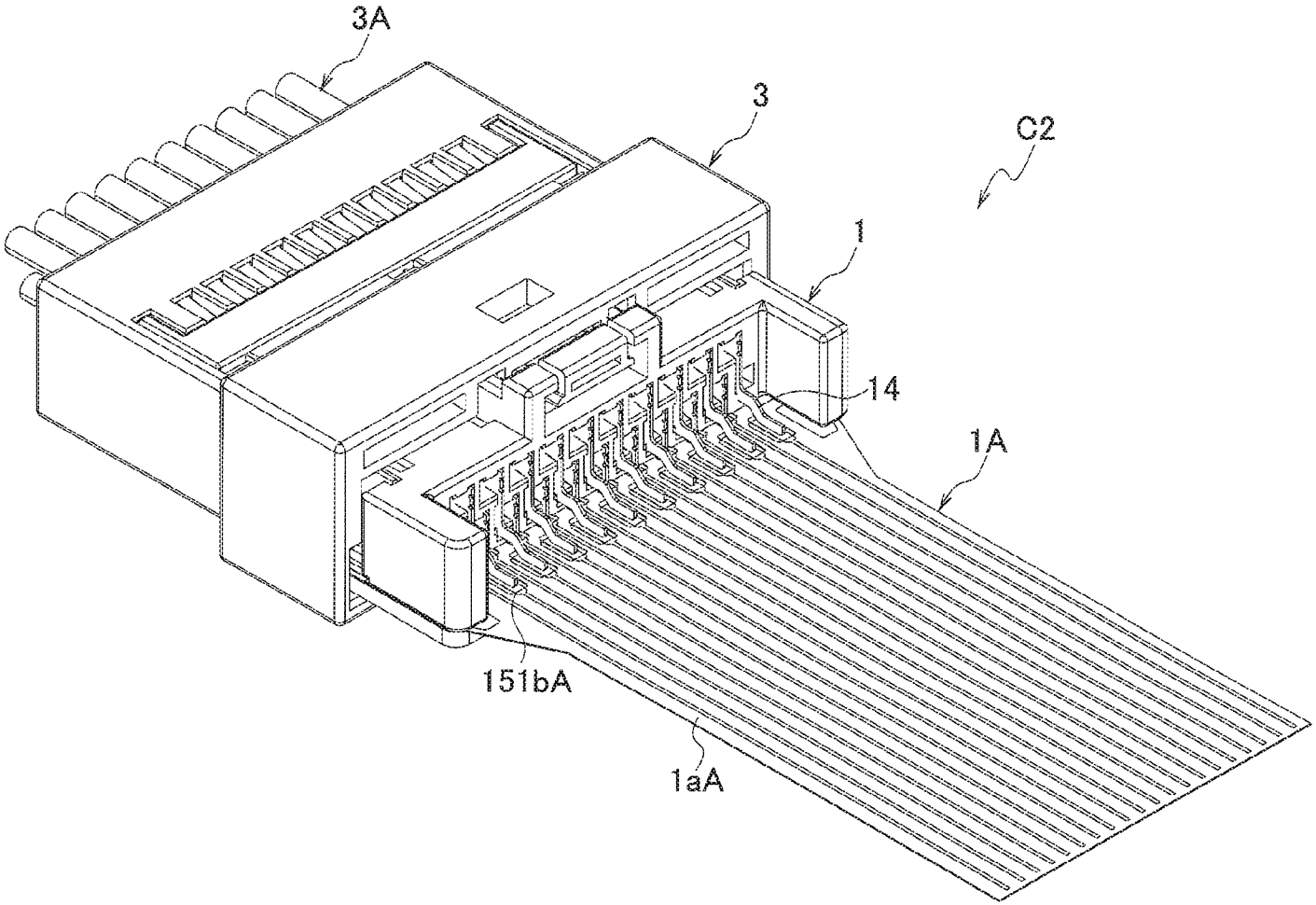
FIG. 5 is a perspective view showing another example of the connector set in a state where the plug connector mounted on the cable and the receptacle connector connected to the electric wires are fitted together.

The plug connector (connector) 1 according to this embodiment is used for a connector set C1 shown in FIGS. 1 to 3, a connector set C2 shown in FIGS. 4 to 6, or the like.

The connector set C1 includes the receptacle connector 2 to which the plug connector 1 described above is fitted, as shown in FIG. 1 and FIG. 2, while the connector set C2 includes the receptacle connector 3 to which the plug connector 1 described above is fitted, as shown in FIG. 4 and FIG. 5.

In this embodiment, the plug connector 1 is formed to be mountable on the cable (mounting member: connecting member) 1A such as an FPC and an FFC. More specifically, the plug connector 1 is configured to be mounted on the cable 1A by electrically connecting (mounting) terminals 13 and 14 included in the plug connector 1 to a conductor part 151*b*A of the cable 1A.

Meanwhile, the receptacle connector 2 is formed to be mountable on the circuit board (mounting member) 2A. More specifically, the receptacle connector 2 is configured to be mounted on the circuit board 2A by electrically connecting (mounting) terminals 23 and 24 included in the receptacle connector 2 to a conductor part 2*b*A of the circuit board 2A.

The receptacle connector 3 includes a plurality of relay terminals 33, and a conductor part 3*b*A of the electric wire 3A is electrically connected to each of the relay terminals 33. In this embodiment, the receptacle connector 3 is configured to be electrically connected to the plurality of electric wires 3A by electrically connecting the relay terminals 33 to the conductor parts 3*b*A exposed from cover parts 3*a*A of the electric wires 3A.

Thus, the connector set C1 electrically connects the cable 1A to the circuit board 2A by fitting the plug connector 1 into the receptacle connector 2 to achieve conduction between the terminals 13 and 14 and the terminals 23 and 24 (see FIG. 2 and FIG. 3).

Meanwhile, the connector set C2 electrically connects the cable 1A to the electric wires 3A by fitting the plug connector 1 into the receptacle connector 3 to achieve conduction between the terminals 13 and 14 and the terminals 33 (see FIG. 5 and FIG. 6).

Configuration Example of Cable 1A

Figure 7:
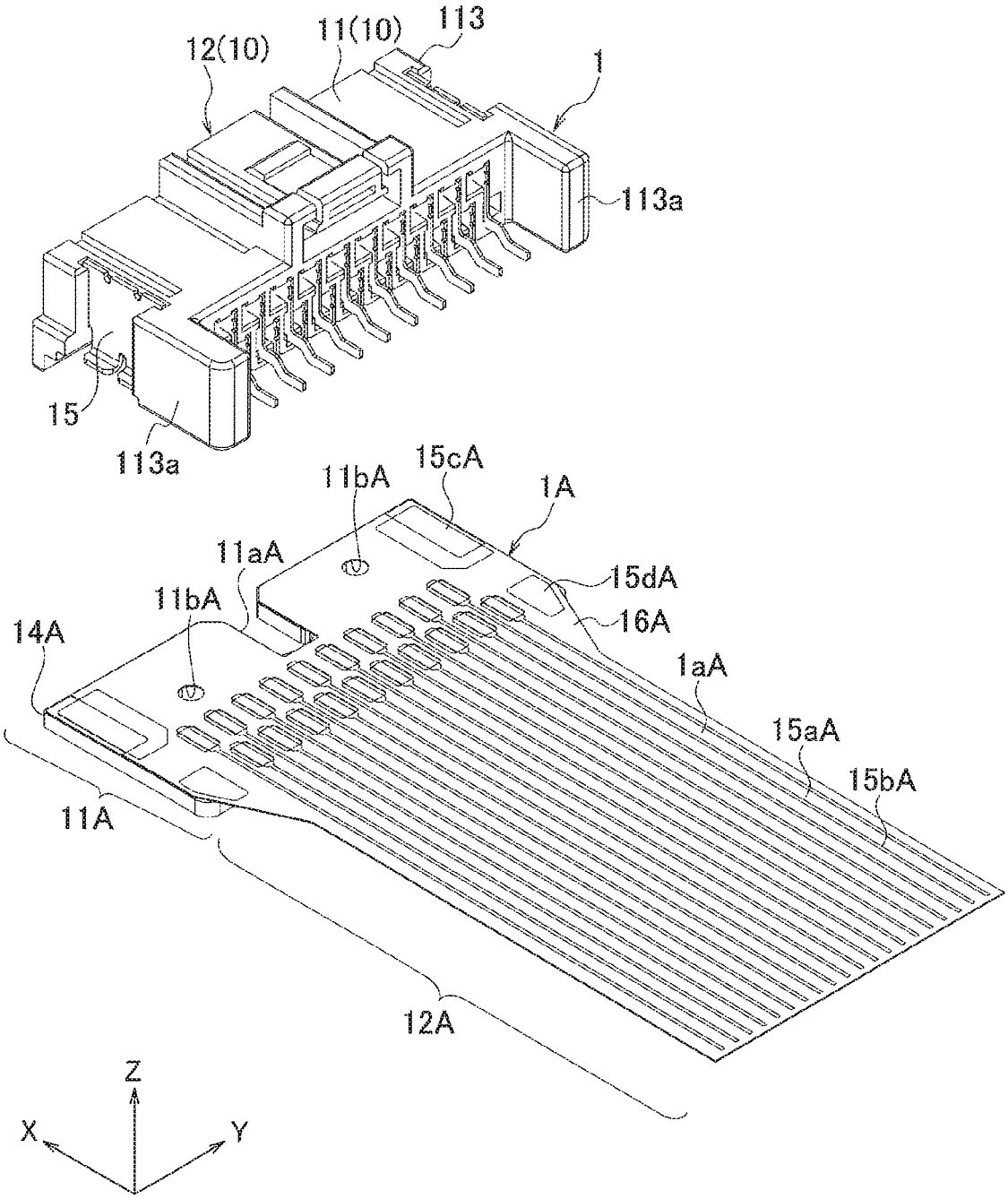
FIG. 7 is a perspective view showing a state before the plug connector included in the connector set shown as an example and another example is mounted on the cable.
Figure 8A:
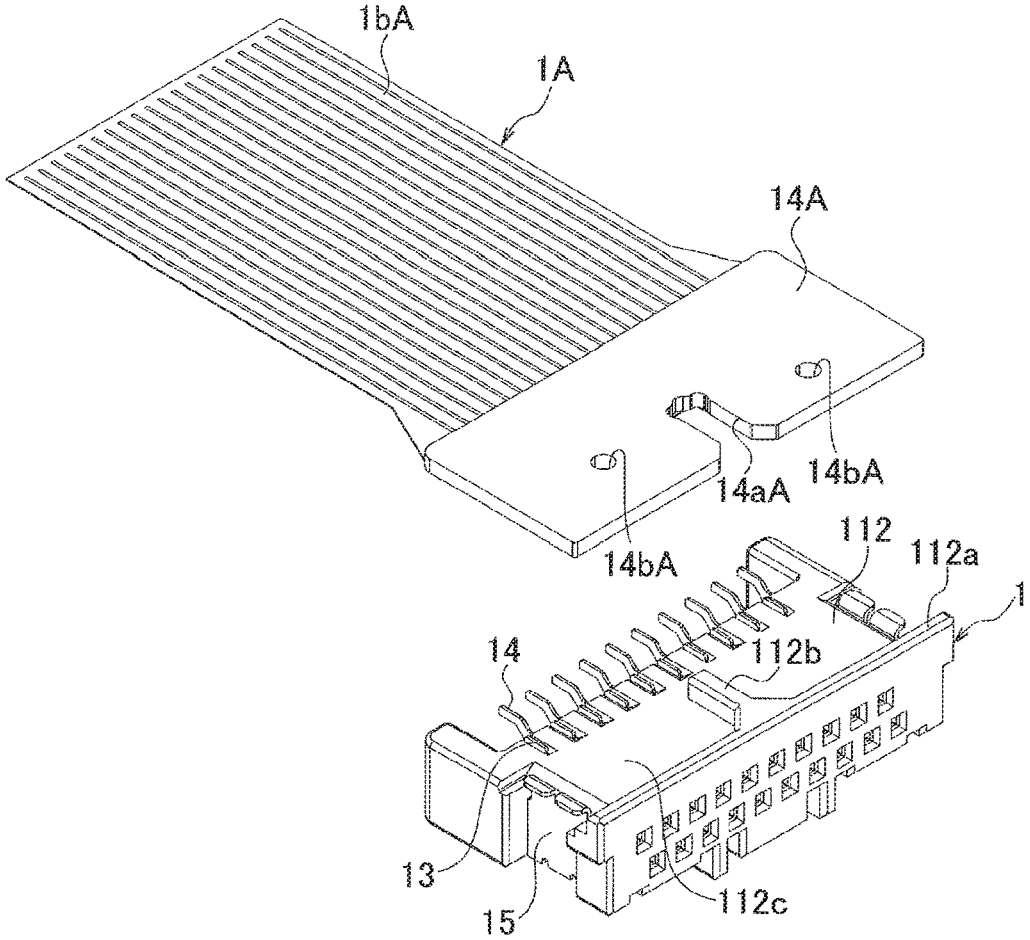
FIG. 8A and FIG. 8B are perspective views explaining how the plug connector included in the connector set shown as an example and another example is mounted on the cable, FIG. 8A showing a state viewed from the reverse side before the plug connector is mounted and FIG. 8B showing a state viewed from the reverse side after the plug connector is mounted.
Figure 8B:
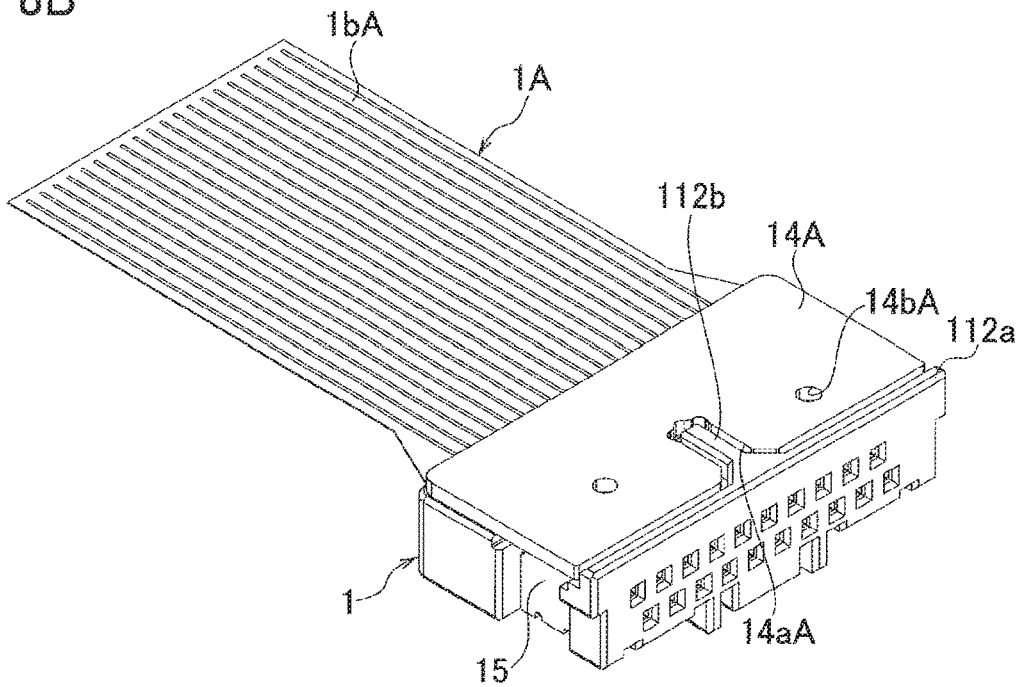

Next, with reference to FIG. 7 and FIG. 8, description is given of a configuration example of the cable 1A on which the plug connector 1 is mounted.

The cable 1A has a sheet shape (flat plate shape) with a top surface (front surface: one side) 1*a*A and a rear surface (back surface: the other side) 1*b*A. The top surface 1*a*A serves as a mounting surface to mount the plug connector 1. The cable 1A is also flexible and thus can be bent (curved) in a cable thickness direction.

This cable 1A includes a connection region 11A used for connection with the plug connector 1 and an extension region 12A in which a conductor layer 15*b*A extends for wiring with another circuit.

In this embodiment, the cable 1A is formed such that the connection region 11A is positioned at one end side of the extension region 12A. In a state where the plug connector 1 having the connection region 11A connected thereto is fitted into the receptacle connector (receptacle connector 2 or receptacle connector 3), the extension region 12A is positioned on the opposite side of the receptacle connector.

Moreover, the cable 1A has a multilayer structure, including a support layer 15*a*A and the conductor layer 15*b*A supported by the support layer 15*a*A. The support layer 15*a*A is formed of a plurality of insulator films to cover the conductor layer 15*b*A. On the other hand, the conductor layer 15*b*A is formed of conductor films printed on the insulator films included in the support layer 15*a*A, which are a plurality of wiring patterns corresponding to the plurality of terminals 13 and 14 to be described later, respectively.

On the upper surface of the connection region 11A, a plurality of conductor parts 151*b*A are formed, which are the conductor layer 15*b*A exposed from the support layer 15*a*A. The plurality of conductor parts 151*b*A are formed in two rows along the front-rear direction, and the conductor parts 151*b*A in each row are formed so as to be arranged at a predetermined pitch in the width direction (Y direction). Furthermore, in this embodiment, the plurality of conductor parts 151*b*A are formed in a staggered pattern in a plan view (state viewed along the mounting surface 1Aa).

Such a structure can be formed, for example, by printing the plurality of conductor films on the support layer 15*a*A to form the conductor layer 15*b*A and then covering the conductor layer 15*b*A with another support layer 15*a*A. In this event, another support layer 15*a*A is provided so as not to cover the tip of the conductor layer 15*b*A. Thus, the cable 1A having the tip of the conductor layer 15*b*A exposed on one side (top side of the top-bottom direction) is formed.

Note that a method for forming the cable 1A is not limited to the above method, but various other methods can be used to form the cable 1A.

On the upper surface of the connection region 11A, fixing parts 15*c*A are also formed to fix holding brackets 15 to be described later in the plug connector 1. In this embodiment, the cable 1A includes wide parts 16A extending on either side in the width direction (Y direction) of the plurality of conductor layers 15*b*A arranged in the width direction (Y direction), and a pair of fixing parts 15*c*A are formed on the tip side of the respective wide parts 16A (on the front side of the front-rear direction). Moreover, on the rear side in the front-rear direction of the respective wide parts 16A, fixing parts 15*d*A are formed to fix a plug housing (housing) 10 of the plug connector 1. These fixing parts 15*c*A and 15*d*A can be formed, for example, in the same manner as the conductor layers 15*b*A in a printing process for the conductor layers 15*b*A.

Moreover, in this embodiment, a slit 11*a*A that is elongated in the front-rear direction (X direction) and opened forward is formed in the connection region 11A of the cable 1A. On either side, in the width direction (Y direction), of the slit 11*a*A in the connection region 11A, through-holes 11*b*A are formed penetrating in the cable thickness direction (top-bottom direction; Z direction).

Furthermore, in this embodiment, the cable 1A includes a reinforcing plate 14A. This reinforcing plate 14A is formed using glass epoxy resin, stainless steel, or the like, and is configured to reinforce the connection region 11A of the cable 1A by sandwiching the connection region 11A of the cable 1A between the reinforcing plate 14A and the plug connector 1.

In this embodiment, the reinforcing plate 14A has a shape corresponding to the shape of the connection region 11A of the cable 1A. More specifically, a contour shape of the reinforcing plate 14A in the plan view (state viewed along the mounting surface 1Aa) is approximately the same as that of the connection region 11A. Therefore, a slit 14*a*A that is elongated in the front-rear direction (X direction) and opened forward and through-holes 14*b*A penetrating in the cable thickness direction (top-bottom direction; Z direction) are formed in the reinforcing plate 14A. Then, the reinforcing plate 14A is attached to the rear surface side of the connection region 11A with an adhesive or the like in a state where the slit 11*a*A and the slit 14*a*A communicate with each other and the through-holes 11*b*A and the through-holes 14*b*A communicate with each other.

In this event, it is preferable that the entire conductor part 151*b*A overlap with the reinforcing plate 14A in the plan view (state viewed along the mounting surface 1Aa). In this way, the entire conductor part 151*b*A is supported by the reinforcing plate 14A, and thus can be prevented from bending in the top-bottom direction (Z direction) or warping in the width direction (Y direction).

Configuration Example of Plug Connector 1

Next, with reference to FIGS. 9 to 17, description is given of a configuration example of the plug connector 1.

Figure 9:
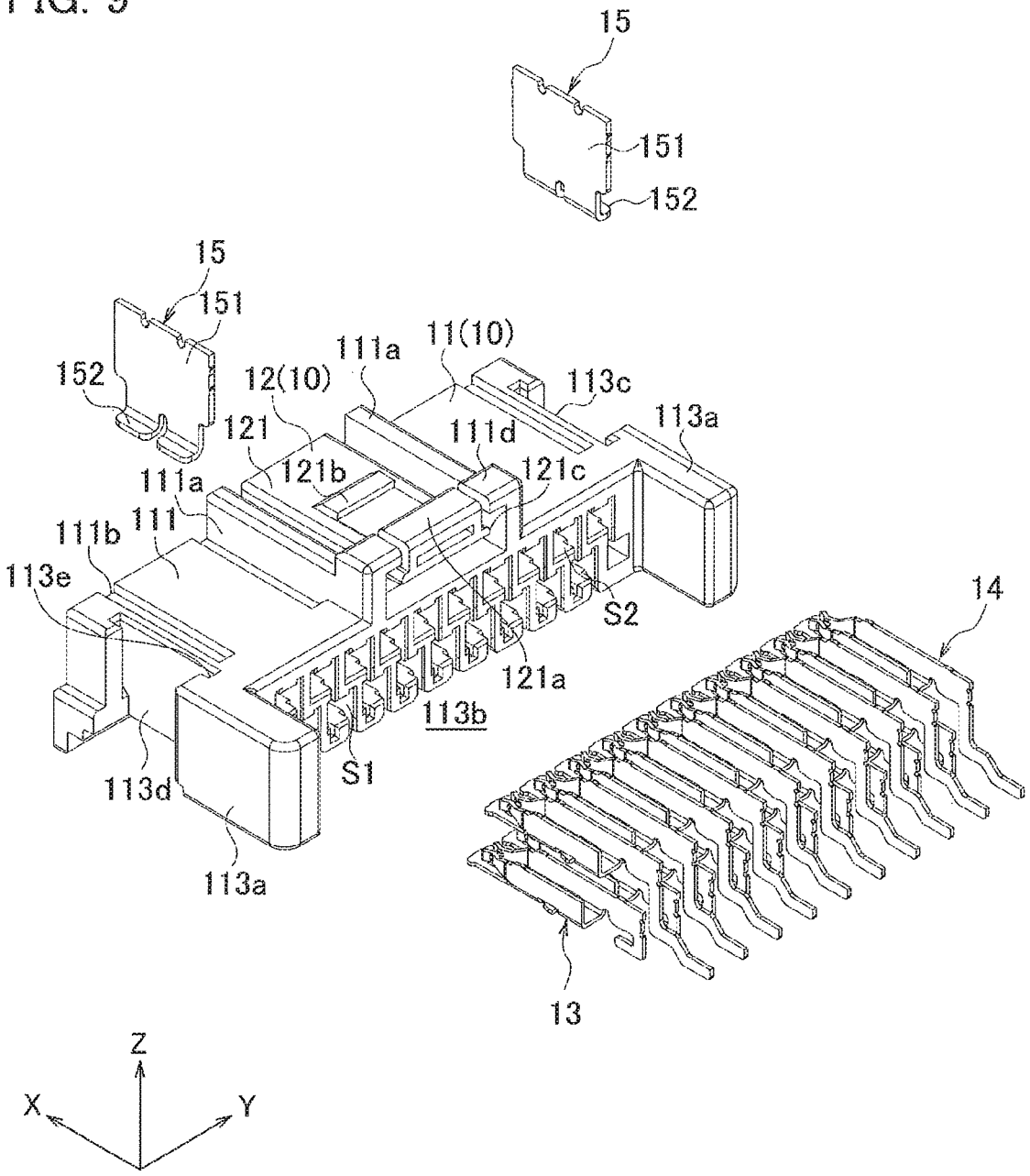
FIG. 9 is an exploded perspective view showing the plug connector included in the connector set shown as an example and another example.
Figure 10A:
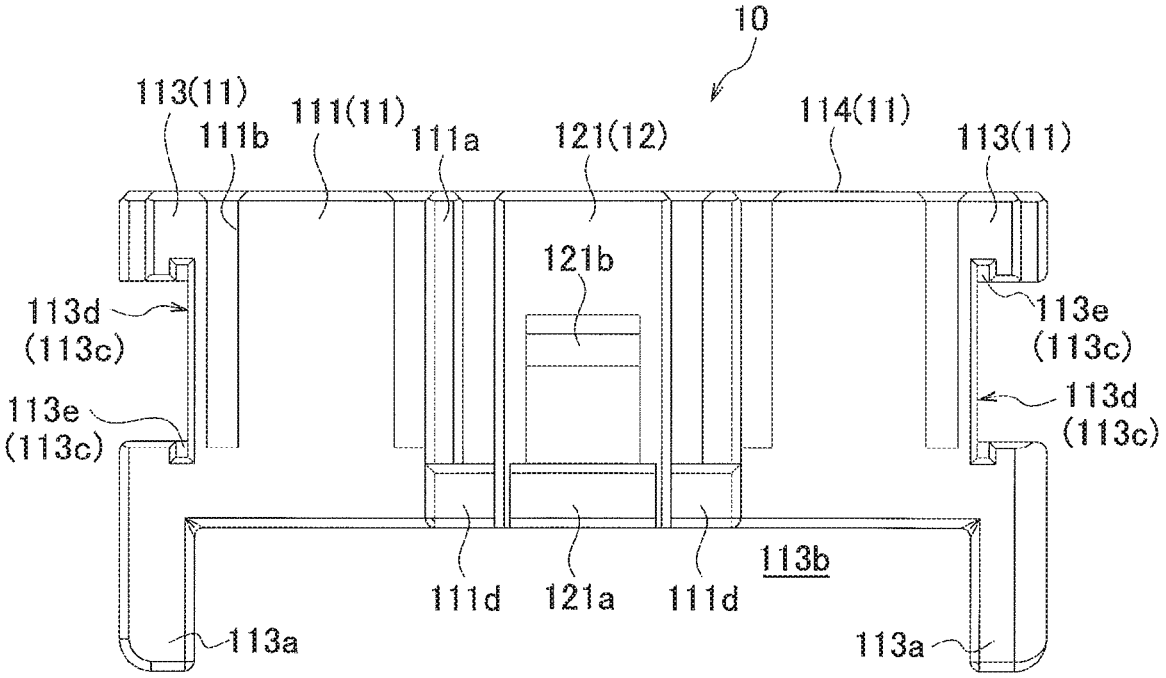
FIG. 10A is a plan view and FIG. 10B is a reverse side view showing a plug housing included in the plug connector.
Figure 10B:
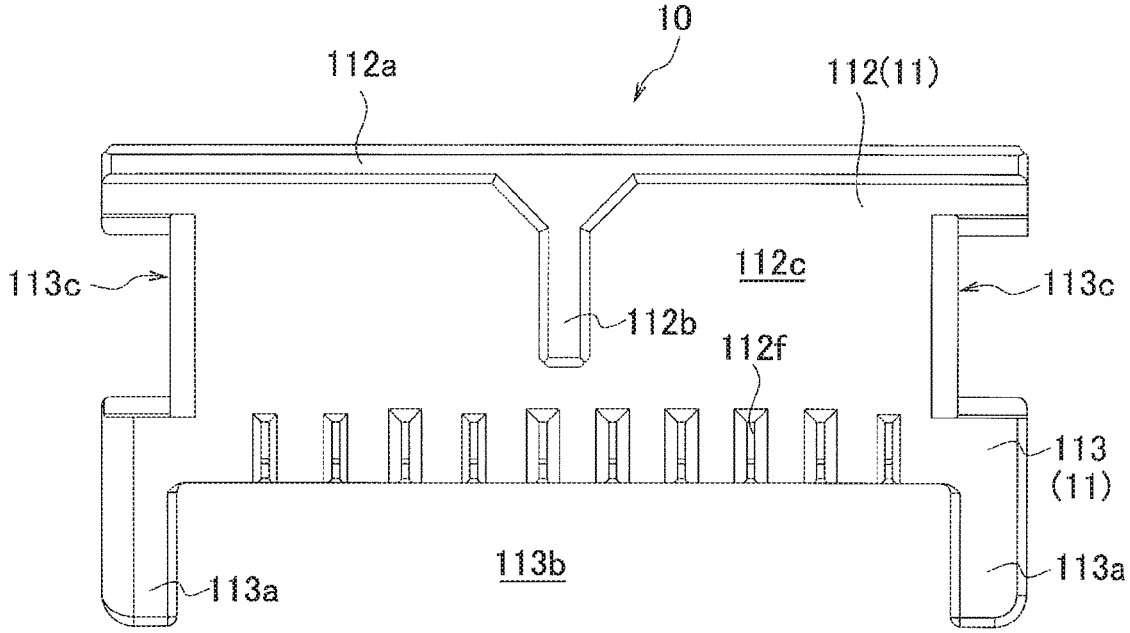
Figure 11A:
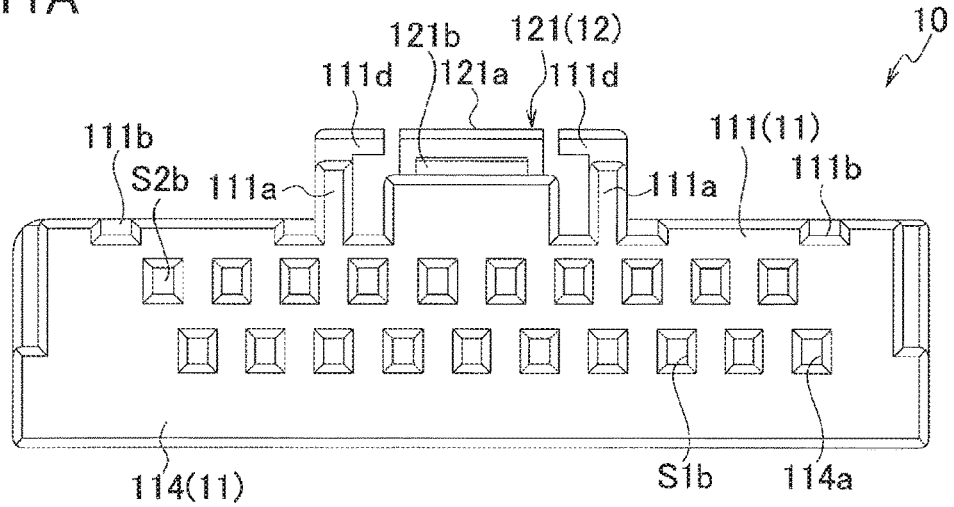
FIG. 11A is a front view.
Figure 11B:
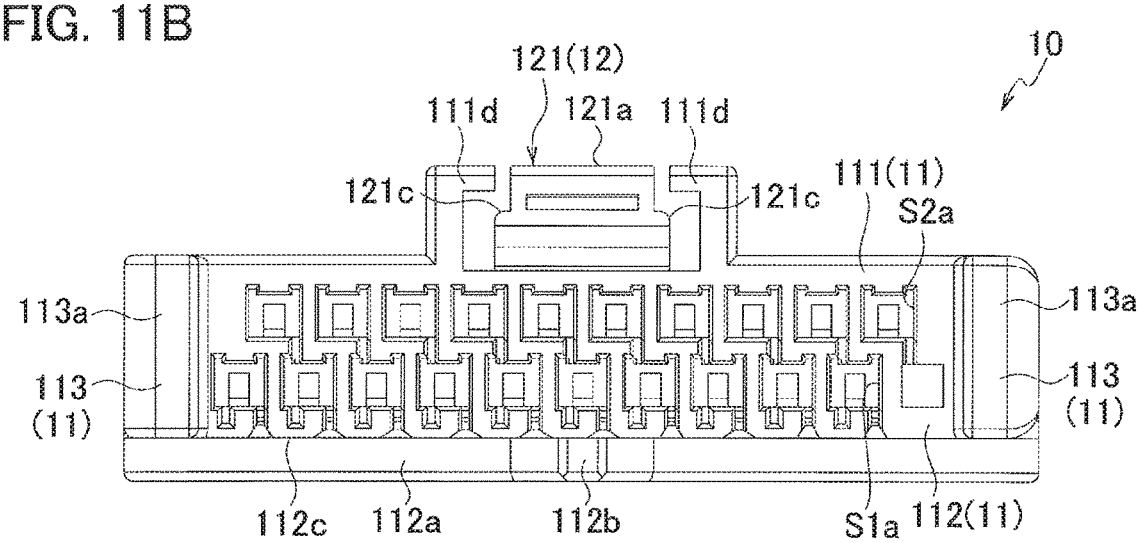
FIG. 11B is a back view.
Figure 11C:
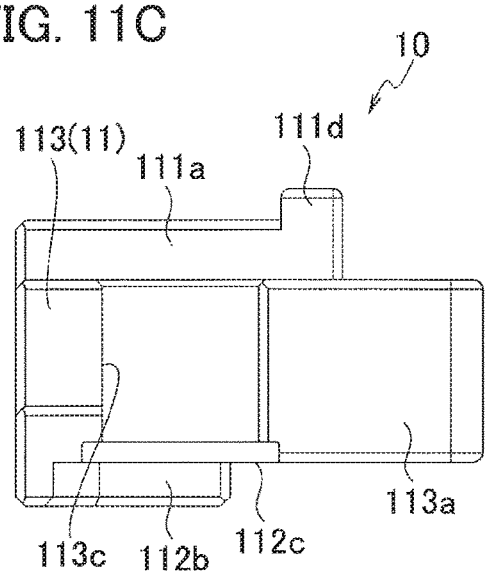
FIG. 11C is a side view.
Figure 11D:
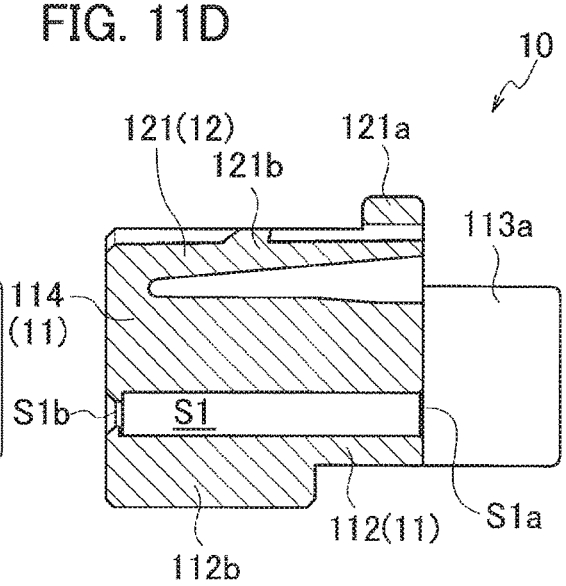
FIG. 11D is a sectional side view showing the plug housing included in the plug connector.
Figure 12B:
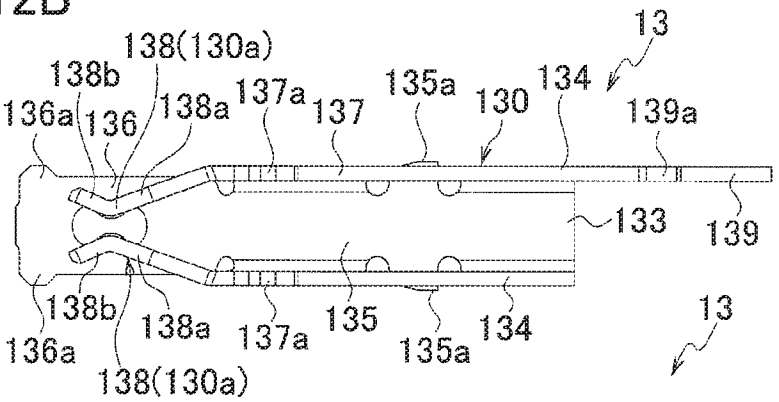
FIG. 12B is a plan view.
Figure 12C:
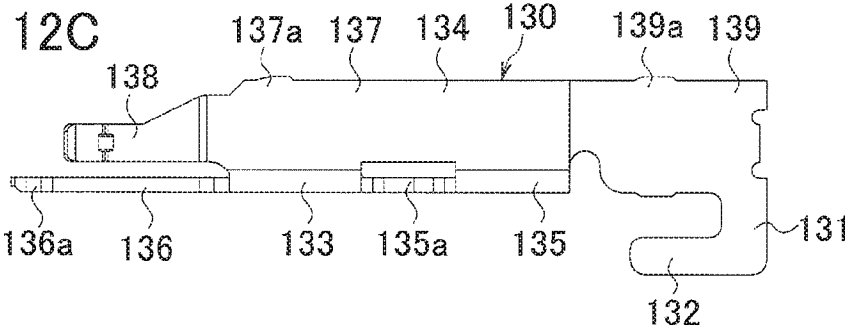
FIG. 12C is a side view.
Figure 12D:
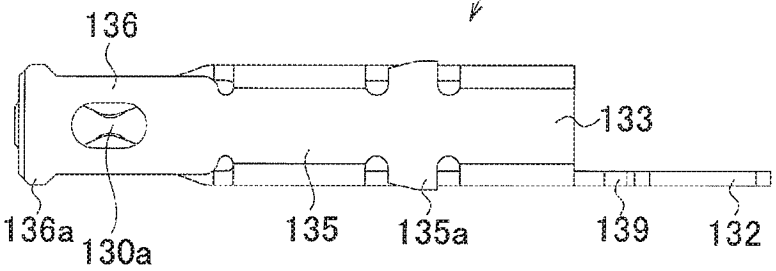
FIG. 12D is a reverse side view.
Figure 12A:
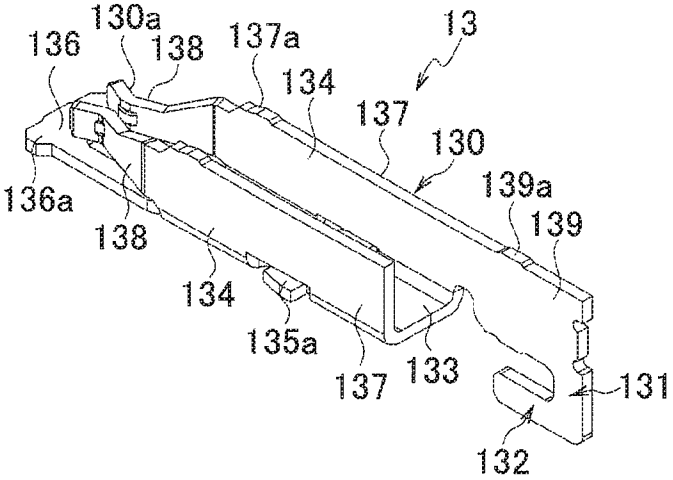
FIG. 12A is a perspective view.
Figure 12F:
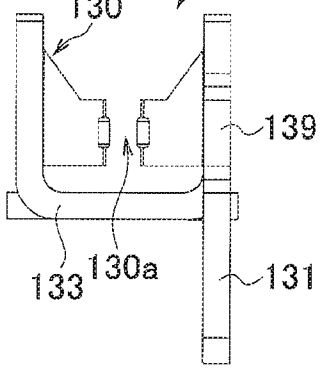
FIG. 12F is a back view showing the first terminal included in the plug connector.
Figure 12E:
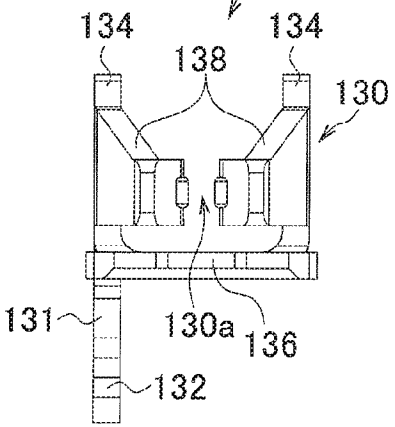
FIG. 12E is a front view.
Figures 13A, 13B, 13C, 13D, 13E, 13F:
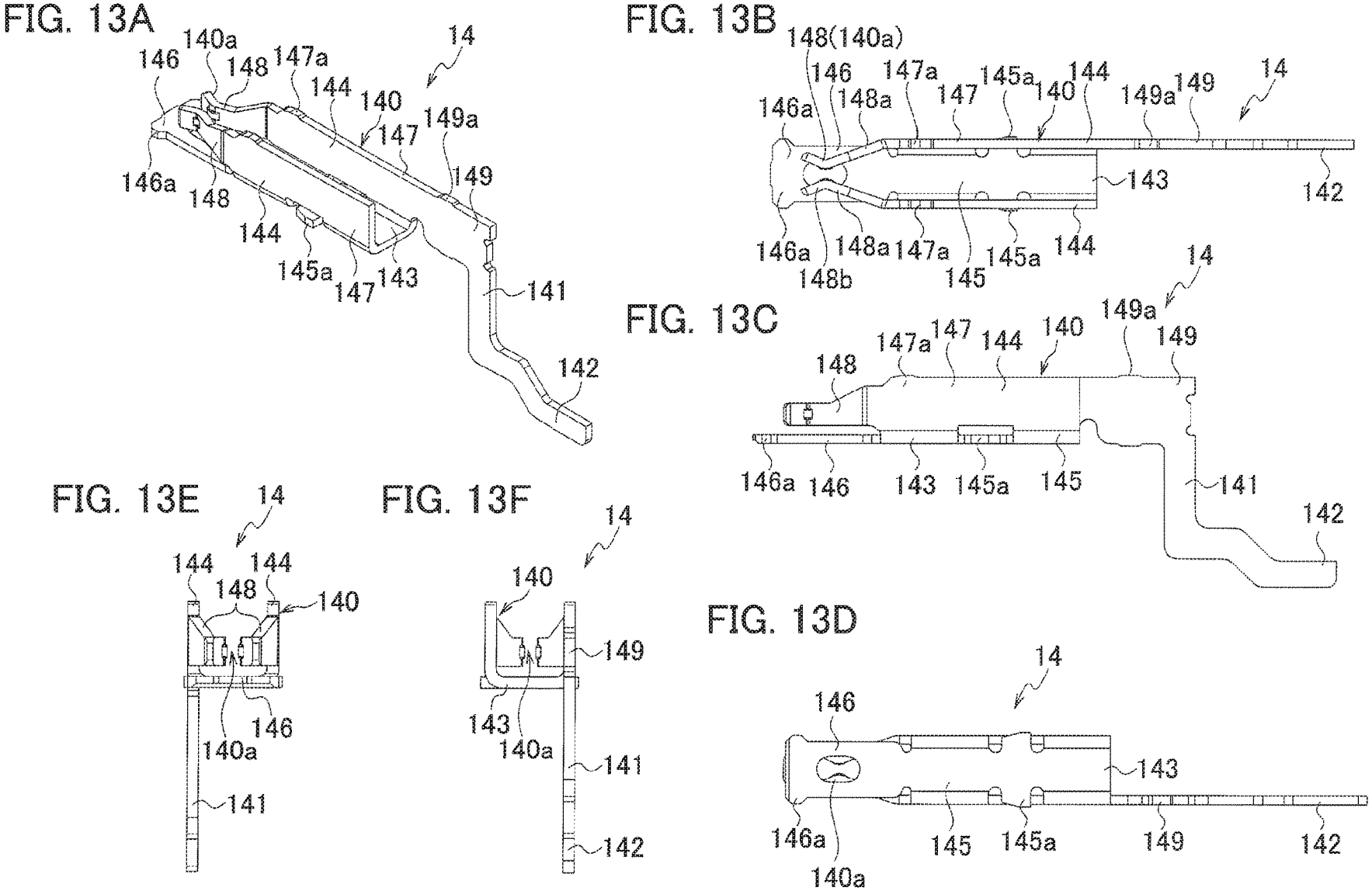
FIG. 13A is a perspective view.
FIG. 13B is a plan view.
FIG. 13C is a side view.
FIG. 13D is a reverse side view.
FIG. 13E is a front view.
FIG. 13F is a back view showing the second terminal included in the plug connector.

As shown in FIG. 9, the plug connector 1 includes a plug housing (housing) 10, plug terminals (terminals: connector terminals) 13 and 14 held by the plug housing 10, and the holding brackets 15 held by the plug housing 10.

The plug connector 1 is configured to be mounted on the cable 1A as the mounting member by mounting the plug terminals 13 and 14 held by the plug housing 10 on the conductor part 151*b*A of the cable 1A disposed outside the plug housing 10. Note that the plug terminals 13 and 14 are mounted on the conductor part 151*b*A by soldering or the like. The holding brackets 15 are fixed to the fixing parts 15*c*A of the cable 1A by soldering or the like, in a state where the holding brackets 15 are held by the plug housing 10, to fix the plug housing 10 to the cable 1A.

The plug housing 10 includes a rigid housing main body 11, and can be formed, for example, using an insulating resin material.

The housing main body 11 also has a lock part 12 formed on its upper side. This lock part 12 holds the plug housing 10 and the housing of the receptacle connector (receptacle connector 2 or receptacle connector 3) in their fitted state or releases the fitted state.

Thus, in this embodiment, the plug housing 10 includes the housing main body 11 and the lock part 12 formed in the housing main body 11.

The housing main body 11 includes a top wall 111, a bottom wall 112, a pair of side walls 113 connecting both ends, in the width direction (Y direction), of the top wall 111 and the bottom wall 112, and a front wall 114 provided continuously from front ends of the top wall 111, the bottom wall 112, and the side walls 113, 113.

The lock part 12 is formed in the middle, in the width direction, of the upper side of the top wall 111. To be more specific, the lock part 12 includes a lever part 121 that is provided continuously from the front end of the top wall 111 and extends rearward. This lever part 121 has its rear side capable of moving in the top-bottom direction relative to the top wall 111 (housing main body 11). The lever part 121 has an operation part 121*a* formed at its rear end to operate the lever part 121, and also has an engagement protrusion 121*b* formed in its central portion in the front-rear direction to engage with an engaged part formed in the receptacle connector.

In this embodiment, when the plug housing 10 and the housing of the receptacle connector are fitted together, the housings of the respective connectors can be locked together (maintained in the fitted state) by the engagement protrusion 121*b* engaging with the engaged part. Then, the fitted state of the housings of the respective connectors can be released by lowering the operation part 121*a* of the lever part 121 to move downward the lever part 121 as well as the engagement protrusion 121*b*, thus releasing the engagement with the engaged part.

Furthermore, locked parts 121*c* protruding outward in the width direction are formed on either side, in the width direction, of the lower side of the operation part 121*a*. These locked parts 121*c* are locked to restrictive protrusions 111*d* formed in the top wall 111 to prevent the rear end (operation part 121*a*) of the lever part 121 from going too far upward. In this embodiment, guide walls 111*a* that guide the fitting between the plug housing 10 and the housing of the receptacle connector is formed so as to extend upward on either side, in the width direction, of the lock part 12 in the top wall 111.

In rear parts of the guide walls 111*a*, restrictive protrusions 111*d* are formed protruding inward in the width direction so as to have their tips overlap with the locked parts 121*c* in the plan view. In this way, when the operation part 121*a* is lifted upward by a predetermined amount, the locked parts 121*c* are locked with the tips of the restrictive protrusions 111*d* to restrict upward movement of the lever part 121.

Note that the top wall 111 also has guide grooves 111*b* formed therein to guide the fitting between the plug housing 10 and the housing of the receptacle connector.

Moreover, at the front end of the lower side (rear surface side) of the bottom wall 112, a protrusion 112*a* extending in the width direction and a protrusion 112*b* extending rearward in the front-rear direction from the center, in the width direction, of the protrusion 112*a* are formed so as to protrude downward. These protrusions 112*a* and 112*b* are formed in the bottom wall 112 such that the protrusion amount is not less than the sum of the thickness of the cable 1A and the thickness of the reinforcing plate 14A.

By forming such protrusions 112*a* and 112*b* in the bottom wall 112, a recess part 112*c* is formed in the lower surface of the bottom wall 112. When the plug connector 1 is mounted on the cable 1A, the connection region 11A having the reinforcing plate 14A attached thereto is housed in the recess part 112*c* (see FIG. 8B).

As described above, in this embodiment, the plug housing 10 includes a pair of walls (top wall 111 and bottom wall 112) facing each other in the housing thickness direction (top-bottom direction: Z direction). The recess part 112*c* to house the connection region 11A of the cable 1A is formed in the bottom wall 112 that is one of the pair of walls (top wall 111 and bottom wall 112). More specifically, the plug housing 10 has a receiving part (recess part 112*c*) to receive the cable (mounting member) 1A in the wall (bottom wall 112) on one side in the housing thickness direction (top-bottom direction).

Note that the protrusion 112*b* is formed so as to correspond to the slit 11*a*A and the slit 14*a*A, and a positional shift in the width direction of the cable 1A is suppressed by inserting the protrusion 112*b* into the slit 11*a*A and the slit 14*a*A. Moreover, the protrusion 112*a* suppresses a forward shift in position of the cable 1A.

The housing main body 11 includes a partition wall 115 that is provided continuously from the pair of side walls 113 and the front wall 114 and partitions, into upper and lower parts, a space defined by the top wall 111, the bottom wall 112, the side walls 113, 113, and the front wall 114.

The housing main body 11 further includes a plurality of upper partition walls 116 provided continuously from the top wall 111, the partition wall 115, and the front wall 114. These upper partition walls 116 partition the upper space partitioned by the partition wall 115 into a plurality of spaces. The housing main body 11 also includes a plurality of lower partition walls 117 provided continuously from the bottom wall 112, the partition wall 115, and the front wall 114. These lower partition walls 117 partition the lower space partitioned by the partition wall 115 into a plurality of spaces.

Also, the front wall 114 has through-holes 114*a* formed therein, which communicate with the plurality of spaces partitioned by the partition wall 115 and the upper and lower partition walls 116 and 117. Thus, in this embodiment, the plurality of spaces penetrating in the front-rear direction are formed in the housing main body 11. Then, the plug terminals 13 and 14 are press-fitted (inserted) into the spaces penetrating in the front-rear direction.

In this embodiment, a plurality of spaces arranged in the width direction (Y direction) are formed in two stages in the top-bottom direction (Z direction) in the housing main body 11. These plurality of spaces are formed in a staggered pattern when viewed from the rear side in the front-rear direction of the housing main body 11. Accordingly, the plug connector 1 is reduced in size in the width direction.

To be more specific, on the lower side (mounting surface 1*a*A side) of the housing main body 11, a plurality of spaces defined by the bottom wall 112, the partition wall 115, and the lower partition walls 117 are arranged in the width direction (Y direction). These spaces formed on the lower side (mounting surface 1*a*A side) of the housing main body 11 serve as first spaces S1 into which first plug terminals (lower plug terminals) 13 to be described later, among the plug terminals 13 and 14, are press-fitted (inserted).

On the other hand, on the upper side (position further away from the mounting surface 1*a*A than the first spaces S1) of the housing main body 11, a plurality of spaces defined by the top wall 111, the partition wall 115, and the upper partition walls 116 are arranged in the width direction (Y direction). These spaces formed on the upper side of the housing main body 11 serve as second spaces S2 into which second plug terminals (upper plug terminals) 14 to be described later, among the plug terminals 13 and 14, are press-fitted (inserted).

Furthermore, in this embodiment, the upper partition walls 116 and the lower partition walls 117 are formed at positions shifted from each other in the width direction. More specifically, the first spaces S1 and the second spaces S2 are formed so as to partially overlap with each other in the plan view. In other words, the first spaces S1 and the second spaces S2 overlap with each other, when the plug housing 10 is viewed along a direction (top-bottom direction) normal to the mounting surface 1*a*A, in a state where the plug terminals 13 and 14 are held by the plug housing 10 and also mounted on the cable 1A.

The first plug terminals 13 are each configured to be press-fitted (inserted) forward from an opening at the rear end side of the first space S1. This opening at the rear end side of the first space S1 serves as an insertion opening (insertion slot) S1*a*. Also, an opening at the front end side of the first space S1 is formed to be smaller than the insertion opening S1*a* so as to prevent the first plug terminal 13 from falling off. More specifically, forward movement of the first plug terminal 13 press-fitted (inserted) from the insertion opening S1*a* is restricted by the front wall 114. Note that the opening at the front end side of the first space S1 serves as an introduction port S1*b* for introducing a contact portion of the receptacle terminal of the receptacle connector to be described later into the first space S1. This introduction port S1*b* has its peripheral portion formed into a tapered shape so as to facilitate introduction of the contact portion of the receptacle terminal.

An insertion main cavity S1*c* is formed between the insertion opening S1*a* and the introduction port S1*b*, and the main body part 130 of the first plug terminal 13 is housed in the insertion main cavity S1*c*. Thus, in this embodiment, the first space S1 includes: the insertion opening S1*a* opened toward the outside (rear side) of the plug housing 10; and the insertion main cavity S1*c* which communicates with the insertion opening S1*a* and in which to house the main body part 130 of the first plug terminal 13.

Likewise, the second plug terminals 14 are each configured to be press-fitted (inserted) forward from an opening at the rear end side of the second space S2. This opening at the rear end side of the second space S2 serves as an insertion opening (insertion slot) S2*a*. Also, an opening at the front end side of the second space S2 is formed to be smaller than the insertion opening S2*a* so as to prevent the second plug terminal 14 from falling off. More specifically, forward movement of the second plug terminal 14 press-fitted (inserted) from the insertion opening S2*a* is restricted by the front wall 114. Note that the opening at the front end side of the second space S2 serves as an introduction port S2*b* for introducing a contact portion of the receptacle terminal of the receptacle connector to be described later into the second space S2. This introduction port S2*b* has its peripheral portion formed into a tapered shape so as to facilitate introduction of the contact portion of the receptacle terminal.

An insertion main cavity S2*c* is formed between the insertion opening S2*a* and the introduction port S2*b*, and the main body part 140 of the second plug terminal 14 is housed in the insertion main cavity S2*c*. Thus, in this embodiment, the second space S2 includes: the insertion opening S2*a* opened toward the outside (rear side) of the plug housing 10; and the insertion main cavity S2*c* which communicates with the insertion opening S2*a* and in which to house the main body part 140 of the second plug terminal 14.

Moreover, in the lower part of the top wall 111, grooves 111*c* opened rearward and downward are formed to communicate with the second space S2. These grooves 111*c* guide press-fitting (insertion) of the second plug terminals 14 into the second space S2 by insertion of upper ends of side walls 144 of the second plug terminals 14 to be described later into the grooves.

The groove 111*c* described above is formed in the insertion main cavity S2*c* of the second space S2. Furthermore, the insertion opening S2*a* also has a second groove 111*e* formed therein to guide press-fitting (insertion) of the second plug terminal 14 into the second space S2.

Figure 17:
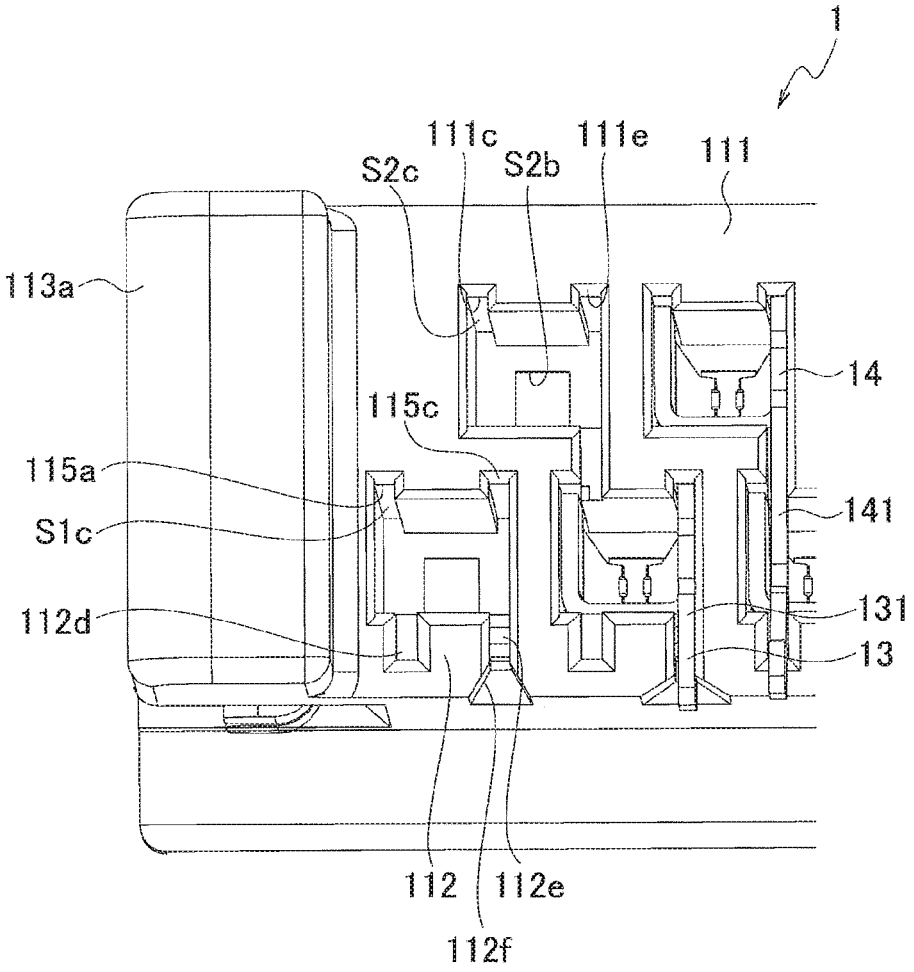
FIG. 17 is an enlarged perspective view showing a terminal guide groove of the plug connector.

In this embodiment, as shown in FIG. 17, the grooves 111*c* are formed on either side, in the width direction, of the second space S2 so as to extend from the insertion openings S2*a* to the front wall 114.

More specifically, the second grooves 111*e* communicate with the grooves 111*c*. The grooves 111*c* extend beyond the center of the second space S2 to the inner side (front side) of the second space S2 in the insertion direction (X direction). Moreover, the grooves 111*c* are formed such that the length in the insertion direction (X direction) is not less than a distance the second plug terminals 14 move during the period from the start of insertion of upper ends of side walls 134 into the grooves 111*c* through until the insertion is completed. Therefore, a portion of the upper end of the side wall 134 first inserted into the groove 111*c* stays inside the groove 111*c* during the period from the start of the insertion into the groove 111*c* through until the press-fitting (insertion) of the second plug terminal 14 into the second space S2 is completed.

Note that the grooves 111*c* are formed to have a groove width (length in the Y direction) slightly larger than the thickness of the side wall 134.

Likewise, in the lower part of the partition wall 115, grooves 115*a* opened rearward and downward are formed to communicate with the first space S1. These grooves 115*a* guide press-fitting (insertion) of the first plug terminals 13 into the first space S1 by insertion of the upper ends of the side walls 134 of the first plug terminals 13 to be described later into the grooves.

The groove 115*a* described above is formed in the insertion main cavity S1*c* of the first space S1. Furthermore, the insertion opening S1*a* also has a second groove 115*c* formed therein to guide press-fitting (insertion) of the first plug terminal 13 into the first space S1.

In this embodiment, as shown in FIG. 17, the grooves 115*a* are also formed on either side, in the width direction, of the first space S1 so as to extend from the insertion openings S1*a* to the front wall 114.

More specifically, the second grooves 115*c* communicate with the grooves 115*a*. The grooves 115*a* extend beyond the center of the first space S1 to the inner side (front side) of the first space S1 in the insertion direction (X direction). Moreover, the grooves 115*a* are formed such that the length in the insertion direction (X direction) is not less than a distance the plug terminals 13 move between the start of the insertion of the upper ends of the side walls 134 into the grooves 115*a* and the end of the insertion. Therefore, a portion of the upper end of the side wall 134 first inserted into the groove 115*a* stays inside the groove 115*a* until the press-fitting (insertion) of the first plug terminal 13 into the first space S is completed after the start of the insertion thereof into the groove 115*a*.

Note that the grooves 115*a* are formed to have a groove width (length in the Y direction) slightly larger than the thickness of the side wall 134.

Furthermore, in this embodiment, a groove 115*b* extending in the top-bottom direction and having both ends opened into the first and second spaces S1 and S2, respectively, is formed at the rear end of the partition wall 115. To be more specific, the groove 115*b* is formed so as to face, in the top-bottom direction, one of the two grooves 111*c* (the one on the right side in FIG. 16 and FIG. 17) formed so as to communicate with one of the second spaces S2.

Figure 16:
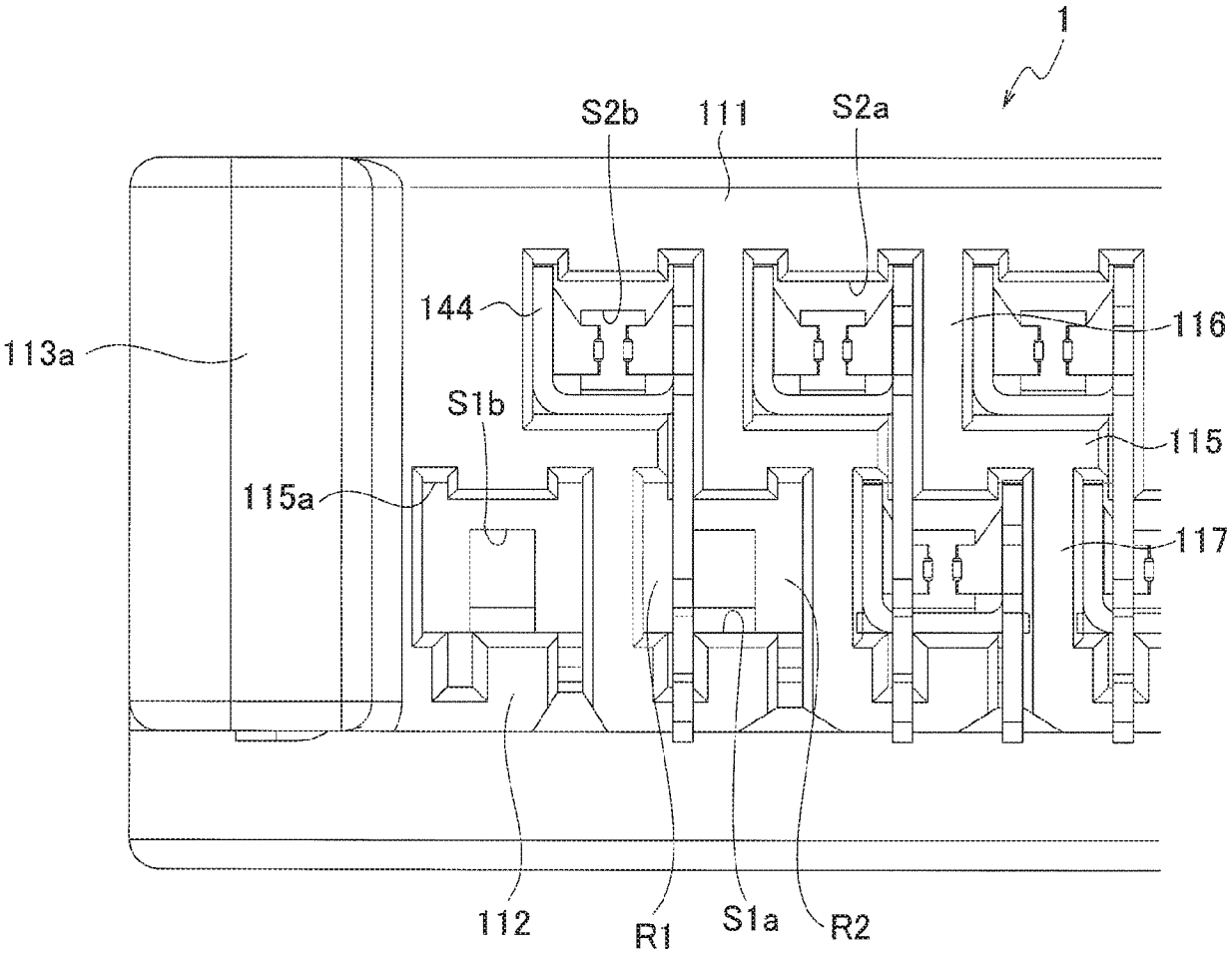
FIG. 16 is a view explaining a state where a first space of the plug connector is divided by a second leg part.

More specifically, as shown in FIG. 16, the groove 115*b* is aligned in the top-bottom direction with one of the grooves 111*c* (the one on the right side in FIG. 16) when the plug housing 10 is viewed from the rear side in the front-rear direction. A leg part 141 of the press-fitted (inserted) second plug terminal 14 has its upper part inserted into this groove 115*b*.

Moreover, a groove 112*d* extending in the top-bottom direction and having its upper end opened into the first space S1 is formed at the rear end of the bottom wall 112. To be more specific, the groove 112*d*, one of the grooves 111*c* (the one on the right side in FIG. 16), and the groove 115*b* are arranged so as to be aligned in the top-bottom direction with each other when the plug housing 10 is viewed from the rear side in the front-rear direction. The leg part 141 of the press-fitted (inserted) second plug terminal 14 has its lower part inserted into this groove 112*d*.

Furthermore, a groove 112*e* extending in the top-bottom direction and having both ends opened into the first space S1 and below the plug housing 10, respectively, is formed at the rear end of the bottom wall 112. To be more specific, the groove 112*e* is formed so as to face, in the top-bottom direction, one of the two grooves 115*a* (the one on the right side in FIG. 16 and FIG. 17) formed so as to communicate with one of the first spaces S1.

More specifically, as shown in FIG. 16, the groove 112*e* is aligned in the top-bottom direction with one of the grooves 115*a* (the one on the right side in FIG. 16) when the plug housing 10 is viewed from the rear side in the front-rear direction. A leg part 131 of the press-fitted (inserted) first plug terminal 13 is inserted into this groove 112*e*.

Moreover, a recess part 112*f* that is opened downward and rearward and extends in the front-rear direction is formed at the rear end part of the bottom wall 112. In this recess part 112*f*, a mounting piece (mounting part) 132 of the press-fitted (inserted) first plug terminal 13 is received.

Furthermore, extension parts 113*a*, 113*a* extending rearward are formed on the pair of side walls 113, 113, respectively. A region where the extension parts 113*a*, 113*a* face each other serves as a recess part 113*b* that houses mounting pieces (mounting parts) 132 and 142 of the terminals 13 and 14.

As described above, in this embodiment, the mounting pieces (mounting parts) 132 and 142 of the terminals 13 and 14 are mounted on the conductor part 151*b*A of the cable 1A at the position closer to the front than the rear ends of the extension parts 113*a*, 113*a*. Furthermore, in this embodiment, tips (rear ends) of the extension parts 113*a*, 113*a* are fixed to the fixing parts 15*d*A of the cable 1A. In this event, the connection region 11A of the cable 1A is sandwiched between the extension parts 113*a*, 113*a* and the reinforcing plate 14A.

In this way, when the cable 1A is fanned to move away from the reinforcing plate 14A, the cable 1A and the reinforcing plate 14A can be more surely suppressed from coming off each other. Furthermore, since the mounting pieces (mounting parts) 132 and 142 of the terminals 13 and 14 are positioned closer to the front than the tips (rear ends) of the extension parts 113*a*, 113*a*, the leg parts 131 and 141 of the terminals 13 and 14 as well as the mounting pieces 132 and 142 can be prevented from being deformed by fanning of the cable 1A. More specifically, the mounting parts between the cable 1A and the terminals 13 and 14 can be protected from fanning of the cable 1A.

Moreover, at the front ends of the pair of side walls 113, 113, holding bracket attachments 113*c*, 113*c* are formed, respectively, to hold the holding brackets 15.

In this embodiment, the holding bracket attachment 113*c* includes: a recess part 113*d* opened outward in the top-bottom direction and in the width direction; and slits 113*e*, 113*e* provided continuously inward, in the width direction, of the recess part 113*d*, into which both ends, in the front-rear direction, of a main body part 151 of the holding bracket 15 is inserted. In a state where the holding brackets 15 are held by the plug housing 10, fixing pieces 152 provided continuously from lower ends of the main body parts 151 are fixed to the fixing parts 15*c*A of the cable 1A, thereby fixing the plug housing 10 to the cable 1A.

Moreover, in this embodiment, the plug terminals each include: a main body part to be inserted into a space formed in the plug housing 10; a leg part extending from the main body part toward the mounting surface 1*a*A of the cable 1A in a state where the plug terminals are mounted on the cable (the mounting member) 1A; and a mounting part provided continuously from the leg part and to be mounted on the cable 1A.

To be more specific, the plug terminals include the first plug terminal 13 to be press-fitted (inserted) into the first space S1 formed on the lower side (mounting surface 1*a*A side) of the housing main body 11. The plug terminals further include the second plug terminal 14 to be press-fitted (inserted) into the second space S2 formed on the upper side (position further away from the mounting surface 1*a*A than the first space S1) of the housing main body 11.

In this embodiment, the first plug terminal 13 is conductive, and a plurality of the first plug terminals 13 are arranged in the width direction (Y direction) of the plug housing 10. As shown in FIGS. 12A to 12F, the first plug terminal 13 has a shape formed by bending a strip-shaped metal member in a strip thickness direction, and has an approximately U-shape when viewed along the insertion direction (front-rear direction; X direction) (see FIG. 12E and FIG. 12F). Such a first plug terminal 13 can be formed, for example, by bending a strip-shaped metal member.

The first plug terminal 13 also includes a first main body part 130 to be press-fitted (inserted) into the first space S1. The first plug terminal 13 further includes: a first leg part 131 extending from the first main body part 130 toward the mounting surface 1*a*A in a state where the first plug terminal 13 is mounted on the cable (the mounting member) 1A; and a first mounting piece (first mounting part) 132 connected to the first leg part 131 and to be mounted on the cable 1A.

The first main body part 130 includes a bottom wall 133 and a side wall 134 connected to both ends, in the width direction (Y direction) of the bottom wall 133.

The bottom wall 133 includes: a bottom wall main body 135 provided continuously from the lower end of the side wall 134; and a contact protection part 136 that is provided continuously from the front end of the bottom wall main body 135 and protrudes forward. This contact protection part 136 prevents a contact part 130*a* of the first plug terminal 13 from coming into contact with the housing main body 11 when the first main body part 130 is press-fitted (inserted) into the first space S1.

The bottom wall main body 135 and the contact protection part 136 have restricting pieces 135*a* and 136*a* formed therein, respectively, which protrude outward from both ends in the width direction (Y direction). These restricting pieces 135*a* and 136*a* prevent the first main body part 130 from being obliquely press-fitted (inserted) when the first main body part 130 is press-fitted (inserted) into the first space S1.

The side wall 134 includes: a side wall main body 137 having its lower end provided continuously from the bottom wall main body 135; and an elastically deformable contact piece 138 that is provided continuously from the front end of the side wall main body 137 and comes into contact with the contact part of the receptacle connector.

The side wall main body 137 has a restricting protrusion 137*a* formed at its upper end. This restricting protrusion 137*a* prevents the first main body part 130 from being lifted when press-fitted (inserted) into the first space S1.

The contact piece 138 includes: an inner bent piece 138*a* provided continuously from the front end of the side wall main body 137 so as to be bent inward in the width direction; and an outer bent piece 138*b* provided continuously from the front end of the inner bent piece 138*a* so as to be bent inward in the width direction.

In this embodiment, the contact pieces 138 are provided continuously from the pair of side wall main bodies 137, 137, respectively, and are formed to be approximately line-symmetric in the plan view. More specifically, the pair of contact pieces 138, 138 include: the inner bent pieces 138*a*, 138*a* bent in a direction of getting close to each other toward the front; and the outer bent pieces 138*b*, 138*b* bent in a direction of getting away from each other toward the front.

Figure 6A:
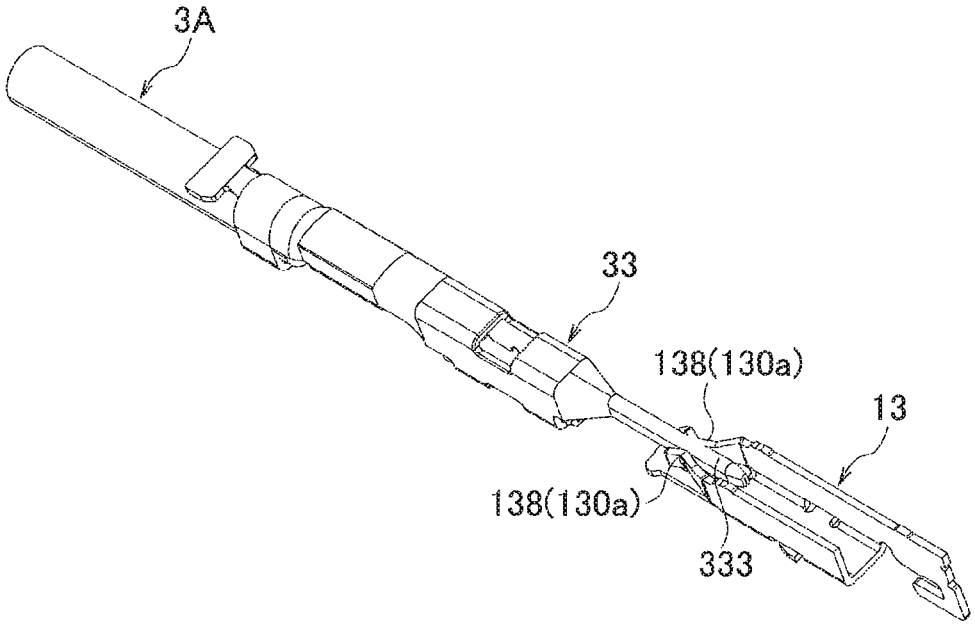
FIG. 6A and FIG. 6B are perspective views showing contact states of terminals on the plug connector side and terminals on the receptacle connector side of the connector set shown as another example, FIG. 6A showing a contact state of a first terminal on the plug connector side and a terminal on the receptacle connector side and FIG. 6B showing a contact state of a second terminal on the plug connector side and a terminal on the receptacle connector side.

The contact part of the receptacle connector is sandwiched in a spot (connection between the inner bent piece 138*a* and the outer bent piece 138*b*) where the pair of contact pieces 138, 138 come closest to each other (see FIG. 3A and FIG. 6A). Thus, in this embodiment, the pair of contact pieces 138, 138 function as the contact part 130*a* of the first plug terminal 13. Also, the pair of outer bent pieces 138*b* function as a guide part for more smoothly guiding the contact part of the receptacle connector.

Furthermore, in this embodiment, an extension wall 139 protruding rearward is provided continuously from the rear end of one of the pair of side wall main bodies 137, 137, and the first main body part 130 has a shape having its one side protruding rearward.

This extension wall 139 has a press-fit protrusion 139*a* formed at its upper end. The first main body part 130 is press-fitted into the first space S by sticking the press-fit protrusion 139*a* into the housing main body 11.

Note that, in this embodiment, the grooves 115*a* are formed to guide the press-fitting (insertion) of the first plug terminal 13 into the first space S1 while the upper ends of the side walls 134 of the first plug terminal 13 are inserted into the grooves. Therefore, a positional shift in the first plug terminal 13 is suppressed even when the first plug terminal 13 is press-fitted (inserted) into the first space S1 by pressing one side wall 134 protruding rearward of the first main body part 130. As a result, the first plug terminal 13 can be press-fitted (inserted) more smoothly and more accurately into the first space S1.

The first leg part 131 is provided extending downward (toward the cable 1A: mounting member) from the rear end of the extension wall 139. Thus, in this embodiment, the first leg part 131 is provided extending in the housing thickness direction from the first main body part 130 that is press-fitted (inserted) into the first space S1. Moreover, a first mounting piece 132 is provided continuously from the lower end of the first leg part 131 so as to protrude forward.

In this event, the first leg part 131 and the first mounting piece 132 are each formed into a thin plate shape (plate shape) such that its plate thickness direction is approximately the same as the thickness direction of the side wall main body 137.

Therefore, in a state where the first main body part 130 is inserted into the first space S1 and also the first mounting piece (first mounting part) 132 is mounted on the cable (mounting member) 1A, the thickness direction of the first leg part 131 is the width direction (Y direction). More specifically, in a state where the plug connector 1 is mounted on the cable 1A, the thickness direction of the first leg part 131 is the direction intersecting with the insertion direction of the first main body part 130 into the first space S1 and with the direction normal to the mounting surface 1*a*A.

Note that, in this embodiment, when the first plug terminal 13 is press-fitted (inserted) into the first space S1, the upper end of the side wall main body 137 constituting a part of the side wall 134 is inserted into the groove 115*a*. Therefore, in this embodiment, the front side edge of the upper end of the side wall main body 137 is the portion of the upper end of the side wall 134 to be first inserted into the groove 115*a*.

Meanwhile, the second plug terminal 14 is also conductive, and a plurality of the second plug terminals 14 are arranged in the width direction (Y direction) of the plug housing 10. As shown in FIGS. 13A to 13F, the second plug terminal 14 has a shape formed by bending a strip-shaped metal member in a strip thickness direction, and has an approximately U-shape when viewed along the insertion direction (front-rear direction; X direction) (see FIG. 13E and FIG. 13F). Such a second plug terminal 14 can also be formed, for example, by bending a strip-shaped metal member.

The second plug terminal 14 also includes a second main body part 140 to be press-fitted (inserted) into the second space S2. The second plug terminal 14 further includes: a second leg part 141 extending from the second main body part 140 toward the mounting surface 1*a*A in a state where the second plug terminal 14 is mounted on the cable (the mounting member) 1A; and a second mounting piece (second mounting part) 142 provided continuously from the second leg part 141 and to be mounted on the cable 1A.

The second main body part 140 includes a bottom wall 143 and a side wall 144 provided continuously from both ends, in the width direction (Y direction) of the bottom wall 143.

The bottom wall 143 includes: a bottom wall main body 145 provided continuously to the lower end of the side wall 144; and a contact protection part 146 that is provided continuously from the front end of the bottom wall main body 145 and protrudes forward. This contact protection part 146 prevents a contact part 140*a* of the second plug terminal 14 from coming into contact with the housing main body 11 when the second main body part 140 is press-fitted (inserted) into the second space S2.

The bottom wall main body 145 and the contact protection part 146 have restricting pieces 145*a* and 146*a* formed therein, respectively, which protrude outward from both ends in the width direction (Y direction). These restricting pieces 145*a* and 146*a* prevent the second main body part 140 from being obliquely press-fitted (inserted) when the second main body part 140 is press-fitted (inserted) into the second space S2.

The side wall 144 includes: a side wall main body 147 having its lower end connected to the bottom wall main body 145; and an elastically deformable contact piece 148 that is provided continuously from the front end of the side wall main body 147 and comes into contact with the contact part of the receptacle connector.

The side wall main body 147 has a restricting protrusion 147*a* formed at its upper end. This restricting protrusion 147*a* prevents the second main body part 140 from being lifted when press-fitted (inserted) into the second space S2.

The contact piece 148 includes: an inner bent piece 148*a* provided continuously from the front end of the side wall main body 147 so as to be bent inward in the width direction; and an outer bent piece 148*b* provided continuously from the front end of the inner bent piece 148*a* so as to be bent inward in the width direction.

In this embodiment, the contact pieces 148 are continuous from the pair of side wall main bodies 147, 147, respectively, and are formed to be approximately line-symmetric in the plan view. More specifically, the pair of contact pieces 148, 148 include: the inner bent pieces 148*a*, 148*a* bent in a direction of getting close to each other toward the front; and the outer bent pieces 148*b*, 148*b* bent in a direction of getting away from each other toward the front.

Figure 6B:
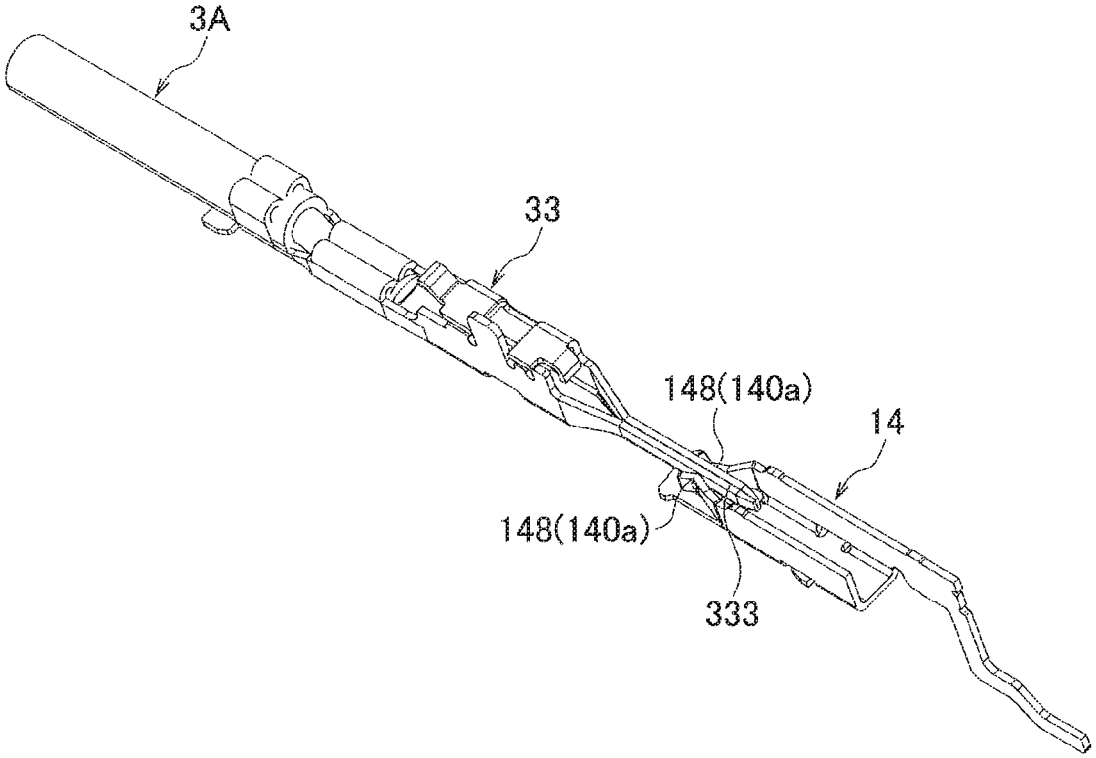

The contact part of the receptacle connector is sandwiched in a spot (connection between the inner bent piece 148*a* and the outer bent piece 148*b*) where the pair of contact pieces 148, 148 come closest to each other (see FIG. 3B and FIG. 6B). Thus, in this embodiment, the pair of contact pieces 148, 148 function as the contact part 140*a* of the second plug terminal 14. Also, the pair of outer bent pieces 148*b* function as a guide part for more smoothly guiding the contact part of the receptacle connector.

Furthermore, in this embodiment, an extension wall 149 protruding rearward is provided continuously from the rear end of one of the pair of side wall main bodies 147, 147, and the second main body part 140 has a shape having its one side protruding rearward.

This extension wall 149 has a press-fit protrusion 149*a* formed at its upper end. The second main body part 140 is press-fitted into the second space S2 by sticking the press-fit protrusion 149*a* into the housing main body 11.

Note that, in this embodiment, the grooves 111*c* are formed to guide the press-fitting (insertion) of the second plug terminal 14 into the second space S2 while the upper ends of the side walls 144 of the second plug terminal 14 are inserted into the grooves. Therefore, a positional shift in the second plug terminal 14 is suppressed even when the second plug terminal 14 is press-fitted (inserted) into the second space S2 by pressing one side wall 144 protruding rearward of the second main body part 140. As a result, the second plug terminal 14 can be press-fitted (inserted) more smoothly and more accurately into the second space S2.

The second leg part 141 is provided extending downward (toward the cable 1A: mounting member) from the rear end of the extension wall 149. The second leg part 141 has its length, in the top-bottom direction, longer than the first leg part 131. Thus, in this embodiment, the second leg part 141 is provided extending in the housing thickness direction from the second main body part 140 that is press-fitted (inserted) into the second space S2. Moreover, a second mounting piece 142 is provided continuously from the lower end of the second leg part 141 so as to protrude rearward.

As described above, in this embodiment, the first mounting piece (first mounting part) 132 is provided continuously from the first leg part 131 so as to protrude forward (toward one side) in the front-rear direction (X direction: insertion direction into the space of the main body part). Also, the second mounting piece (second mounting part) 142 is provided continuously from the second leg part 141 so as to protrude rearward (toward the other side) in the front-rear direction (X direction: insertion direction into the space of the main body part).

Figure 14A:
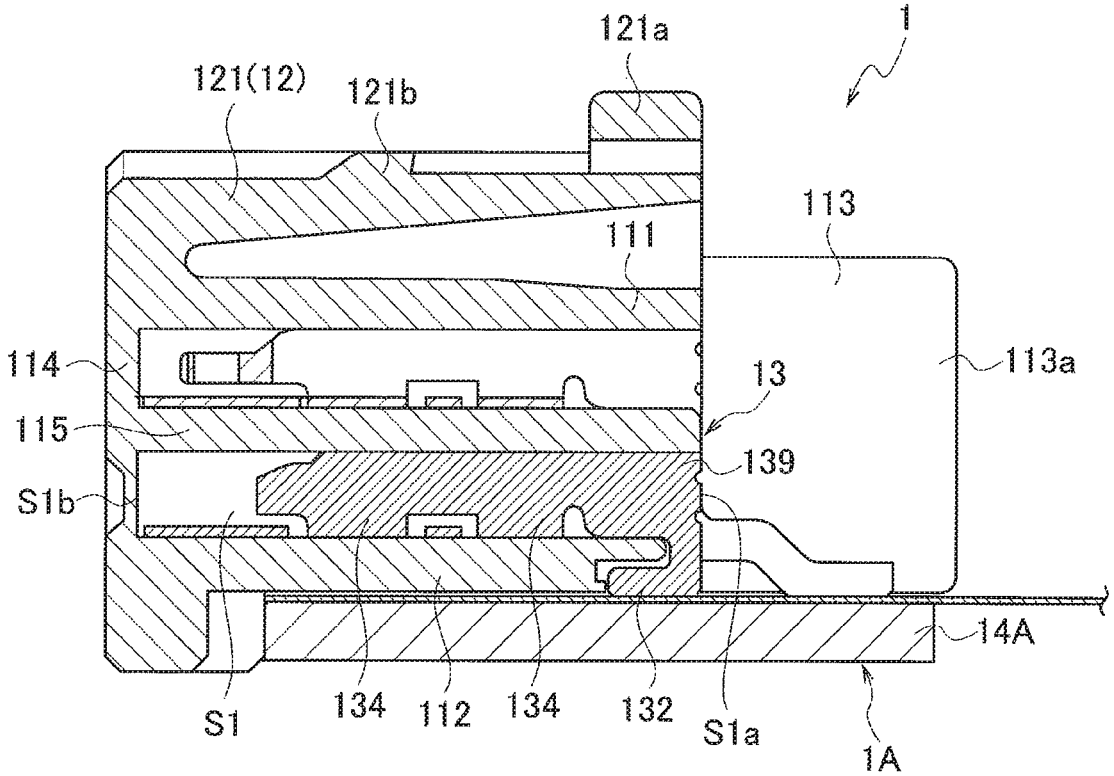
FIG. 14A and FIG. 14B are sectional side views showing a state where the plug connector is mounted on the cable, FIG. 14A showing a state where the first terminal is mounted on a conductor part of the cable and FIG. 14B showing a state where the second terminal is mounted on the conductor part of the cable.
Figure 14B:
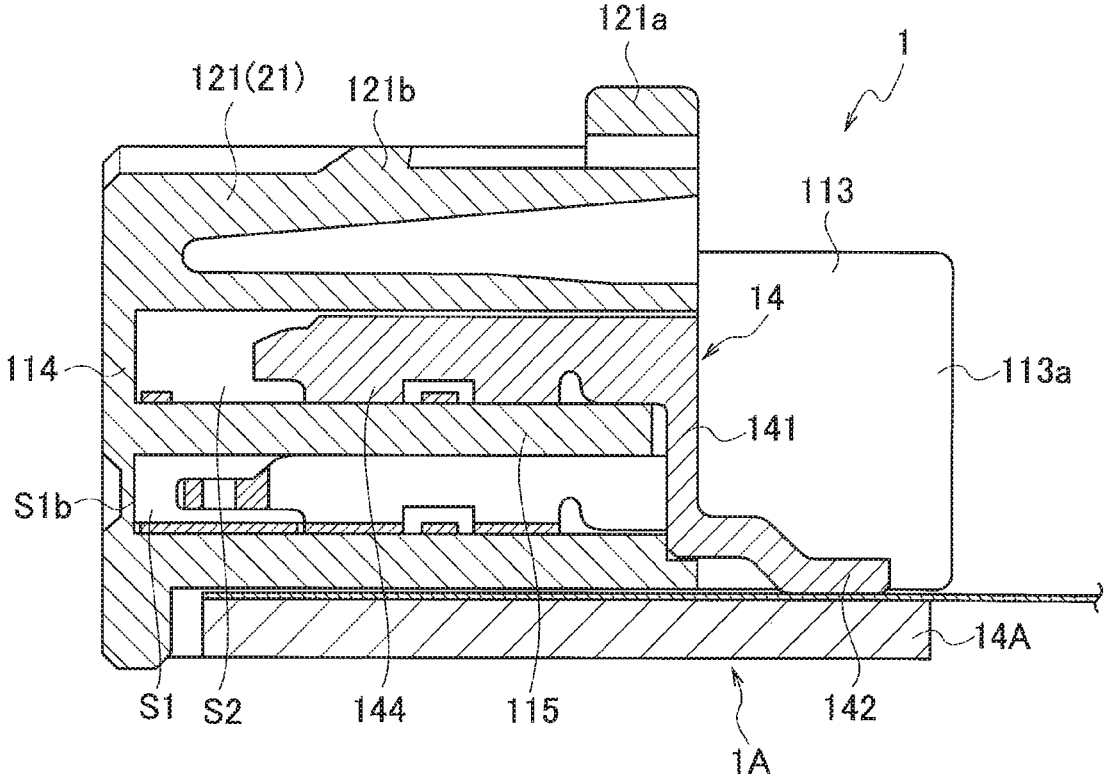
Figure 15:
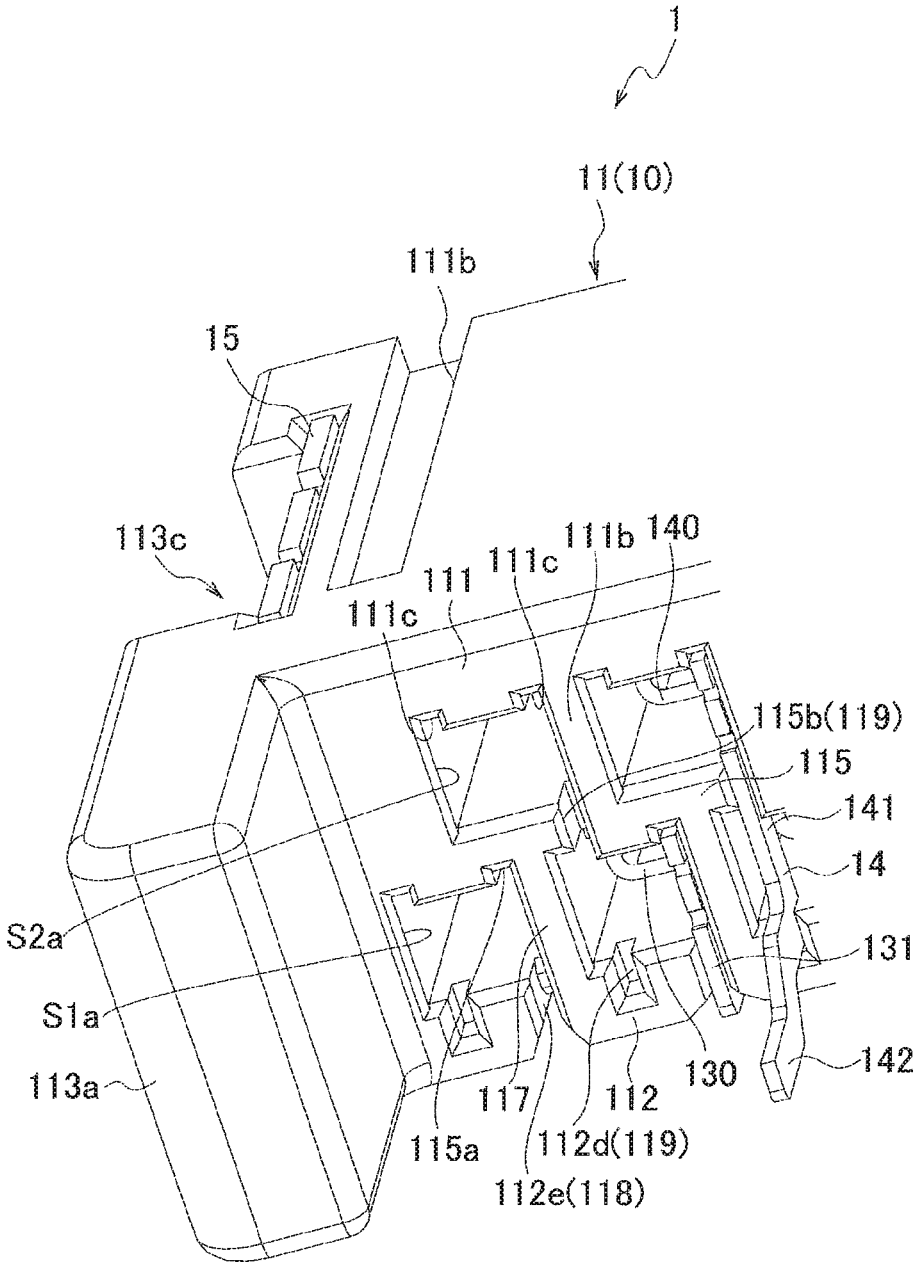
FIG. 15 is an enlarged perspective view showing a leg holding part of the plug connector.

The first leg part 131 and the second leg part 141 are located at approximately the same position in the front-rear direction in a state where the first main body part 130 and the second main body part 140 are inserted into the first space S1 and the second space S2 (see FIG. 14). At the same time, the first leg part 131 and the second leg part 141 are located at positions shifted by approximately a half pitch in the width direction in the state where the first main body part 130 and the second main body part 140 are inserted into the first space S1 and the second space S2.

Therefore, in this embodiment, the mounting parts (first and second mounting pieces 132 and 142) are arranged in a staggered pattern in a state where the plurality of plug terminals are held by the plug housing 10.

Furthermore, the first mounting piece 132 is housed in the recess part 112*f* formed at the rear end of the bottom wall 112 in the state where the first main body part 130 is inserted into the first space S1. Meanwhile, the second mounting piece 142 is positioned behind the insertion opening S1*a* of the second space S2 in the state where the second main body part 140 is inserted into the second space S2.

Therefore, the first mounting piece 132 overlaps with the plug housing 10 in the plan view in a state where the plurality of plug terminals are held by the plug housing 10 and also mounted on the cable 1A. At the same time, the second mounting piece 142 is exposed from the plug housing 10 in the plan view in a state where the plurality of plug terminals are held by the plug housing 10 and also mounted on the cable 1A.

More specifically, either one of the first and second mounting pieces (mounting parts) 132 and 142 overlaps with the plug housing 10 when the plug housing 10 is viewed along the direction normal to the mounting surface 1*a*A in a state where the plug connector 1 is mounted on the cable 1A.

Thus, in this embodiment, the mounting parts are arranged in a staggered pattern on either side of the insertion opening (rear end) of the space in the state where the plurality of plug terminals are held by the plug housing.

Moreover, the second leg part 141 and the second mounting piece 142 are also each formed into a thin plate shape (plate shape) such that its plate thickness direction is approximately the same as the thickness direction of the side wall main body 147.

Therefore, in a state where the second main body part 140 is inserted into the second space S2 and also the second mounting piece (second mounting part) 142 is mounted on the cable (mounting member) 1A, the thickness direction of the second leg part 141 is the width direction (Y direction). More specifically, in a state where the plug connector 1 is mounted on the cable 1A, the thickness direction of the second leg part 141 is the direction intersecting with the insertion direction of the second main body part 140 into the second space S2 and with the direction normal to the mounting surface 1*a*A.

Note that, in this embodiment, when the second plug terminal 14 is press-fitted (inserted) into the second space S2, the upper end of the side wall main body 147 constituting a part of the side wall 144 is inserted into the groove 111*c*. Therefore, in this embodiment, the front side edge of the upper end of the side wall main body 147 is the portion of the upper end of the side wall 144 to be first inserted into the groove 111*c*.

Moreover, in this embodiment, the first insertion opening S1*a* is divided into two regions R1 and R2 by the second leg part 141 when viewed from the rear side in the front-rear direction in a state where the main body parts 130 and 140 of the terminals 13 and 14 are inserted into the spaces S1 and S2 (see FIG. 16). More specifically, the first insertion opening S1*a* of the first space S1 is divided into the two regions R1 and R2 by the second leg part 141 when the plug housing is viewed along the insertion direction of the main body parts 130 and 140 into the spaces S1 and S2 in a state where the plug connector 1 is mounted on the cable 1A.

Furthermore, in this embodiment, at the position where the press-fitting (insertion) of the first main body part 130 into the first space S1 is completed, the first leg part 131 is held in a state of being inserted into the groove 112*e* and having its movement restricted in the width direction (Y direction; thickness direction). More specifically, the groove 112*e* formed in the bottom wall 112 of the housing main body 11 functions as a leg part holder 118 to hold the first leg part 131. Thus, the plug connector 1 includes the leg part holder 118 connected to the plug housing 10 to hold the first leg part 131. In this embodiment, the leg part holder 118 is formed integrally with the plug housing 10. Note that the leg part holder may be formed by connecting a separate member from the plug housing 10 to the plug housing 10.

Moreover, at the position where the press-fitting (insertion) of the second main body part 140 into the second space S2 is completed, the second leg part 141 is held in a state of being inserted into the grooves 115*b* and 112*d* and having its movement restricted in the width direction (Y direction; thickness direction). More specifically, the groove 115*b* formed in the partition wall 115 of the housing main body 11 and the groove 112*d* formed in the bottom wall 112 thereof function as a leg part holder 119 to hold the second leg part 141. Thus, the plug connector 1 includes the leg part holder 119 connected to the plug housing 10 to hold the second leg part 141. The leg part holder 119 is also formed integrally with the plug housing 10 in this embodiment, but may be formed as a separate member.

In this way, the leg parts 131 and 141 are prevented from being deformed when the terminals 13 and 14 are press-fitted (inserted) into the spaces S1 and S2 of the main body parts 130 and 140, when the terminals 13 and 14 press-fitted (inserted) into the spaces S1 and S2 are mounted on the cable 1A, or the like.

Configuration Example of Receptacle Connector 2

Next, with reference to FIGS. 18 to 24, description is given of a configuration example of the receptacle connector 2.

Figure 18:
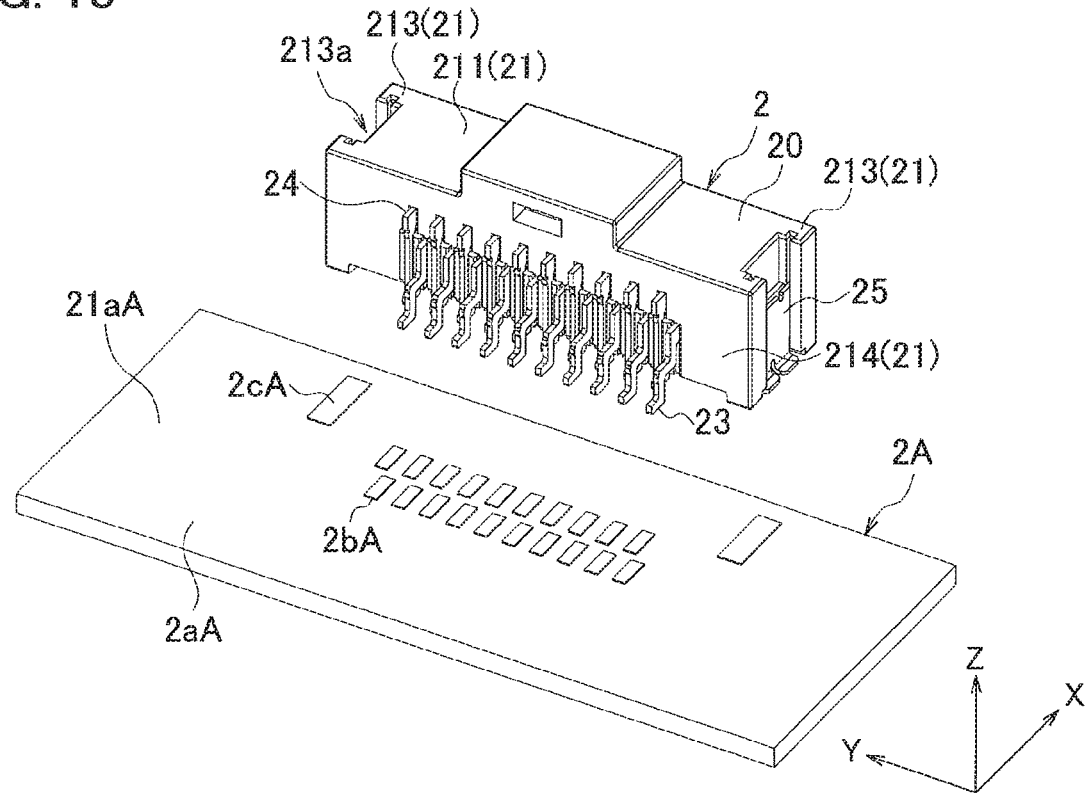
FIG. 18 is a perspective view showing a state before the receptacle connector included in the connector set shown as an example is mounted on the circuit board.
Figure 19:
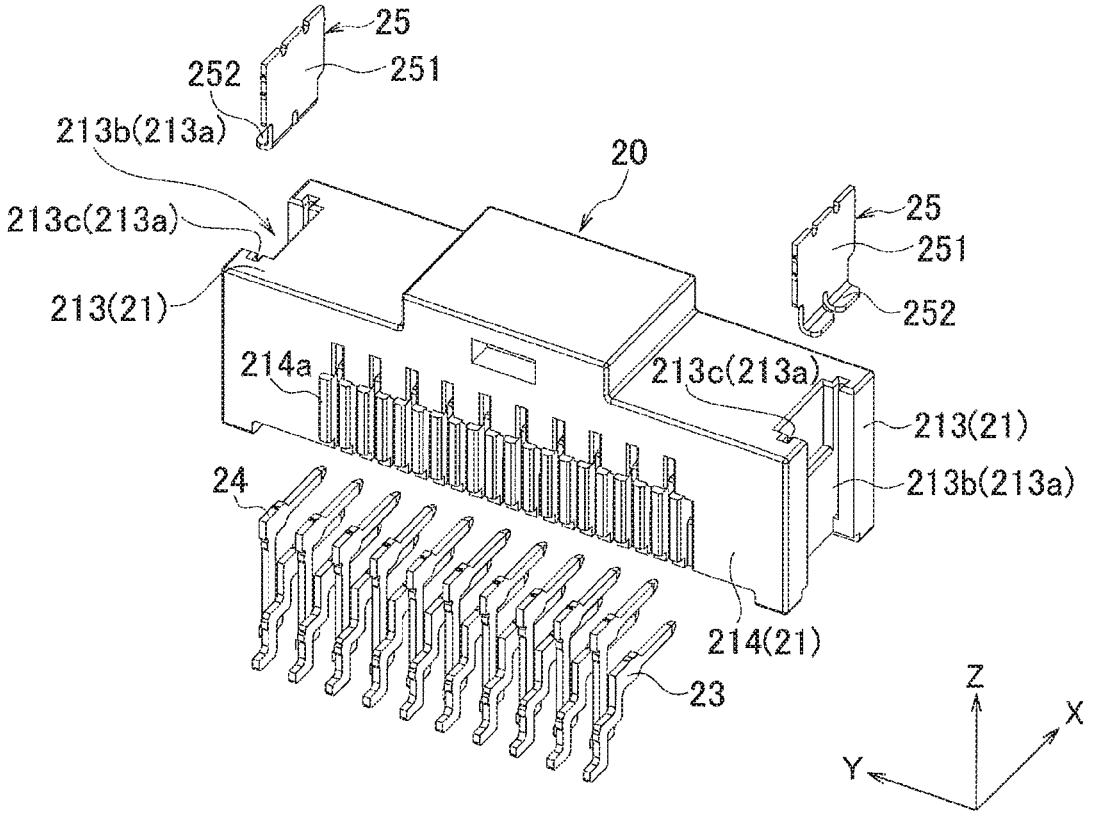
FIG. 19 is an exploded perspective view showing the receptacle connector included in the connector set shown as an example.
Figure 20A:
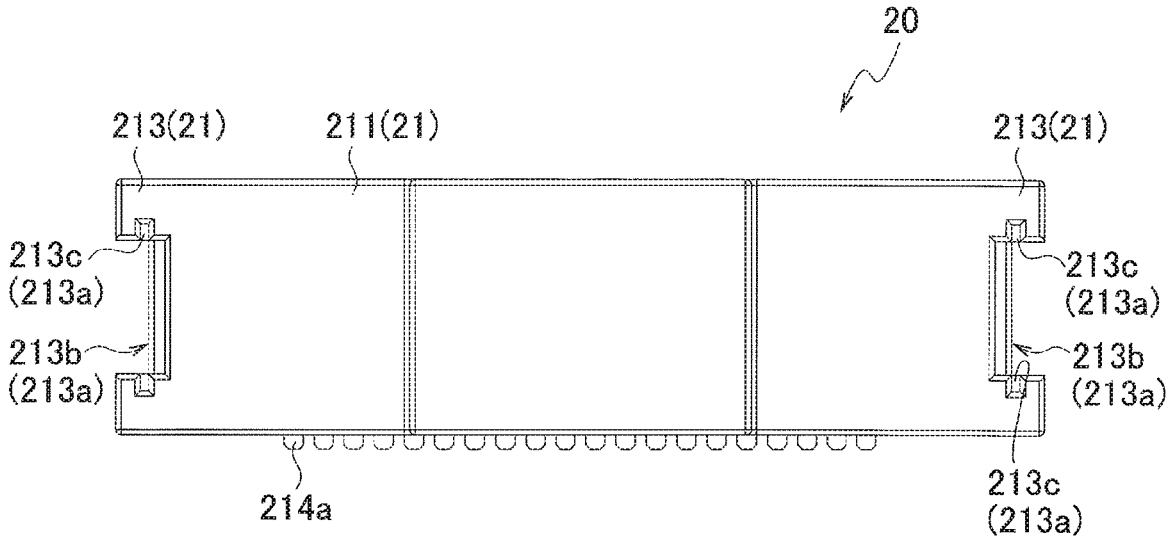
FIG. 20A is a plan view and FIG. 20B is a reverse side view showing a receptacle housing included in the receptacle connector shown as an example.
Figure 20B:
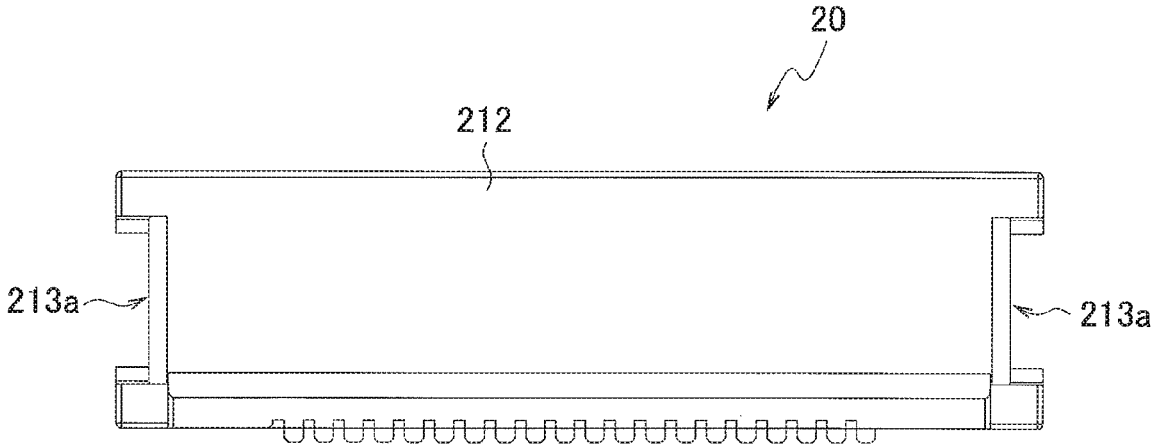
Figure 21A:
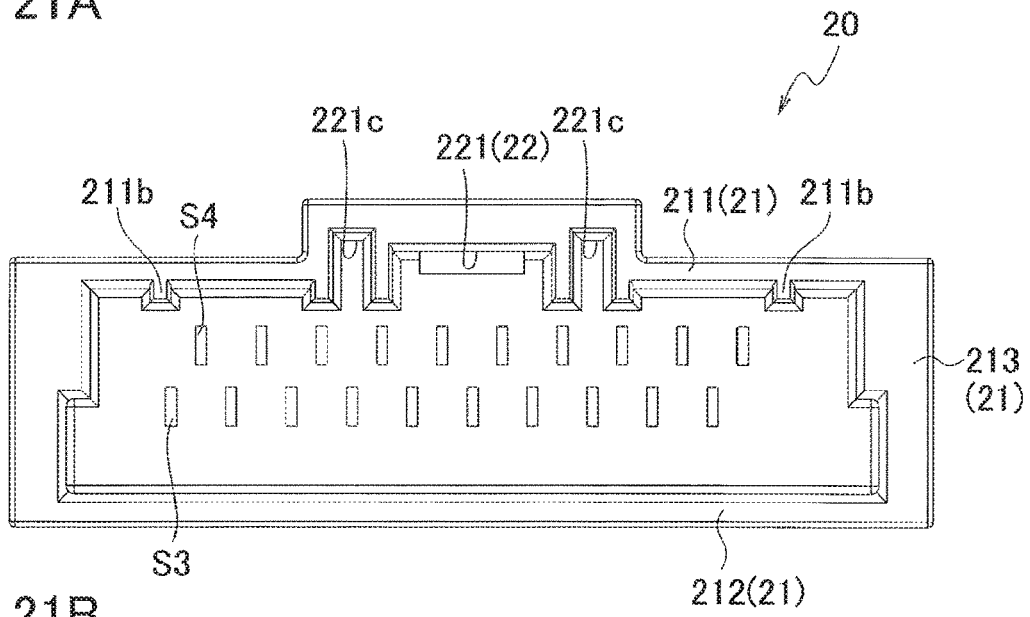
FIG. 21A is a front view.
Figure 21B:
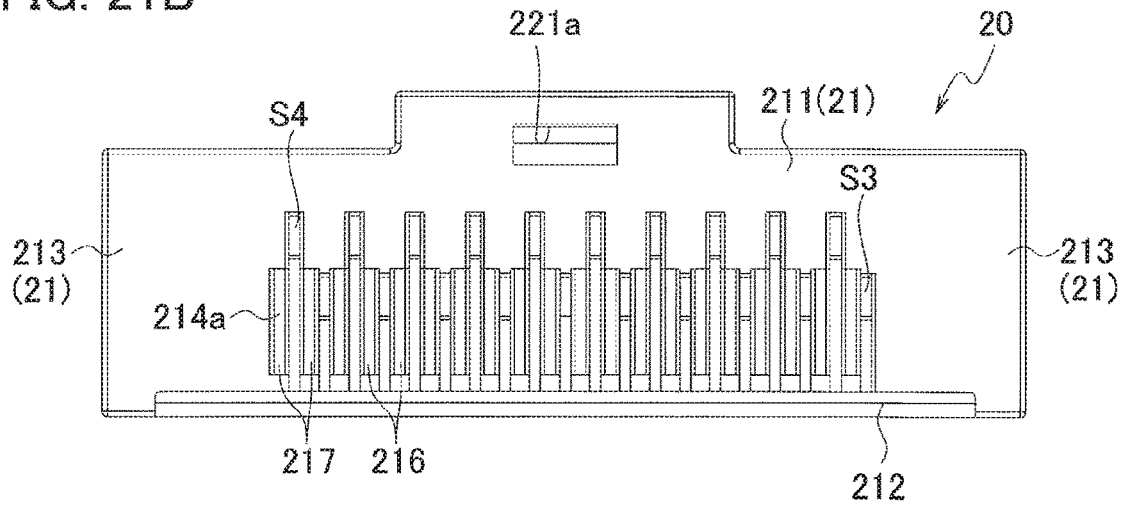
FIG. 21B is a back view.
Figure 21C:
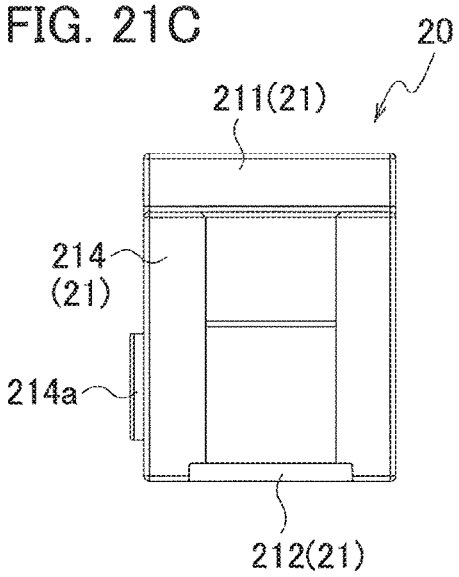
FIG. 21C is a side view.
Figure 21D:
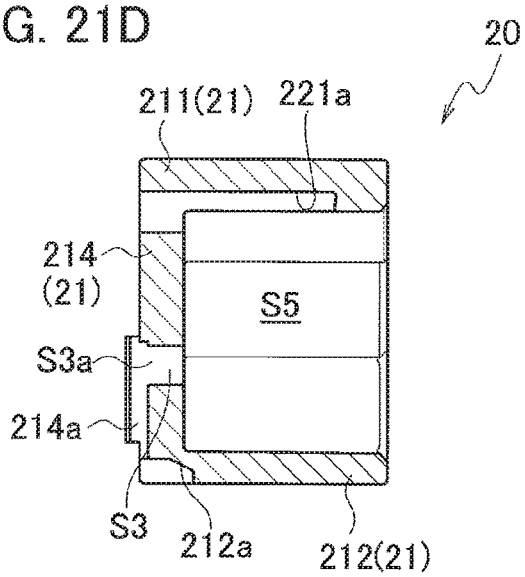
FIG. 21D is a sectional side view showing the receptacle housing included in the receptacle connector shown as an example.
Figure 22A:
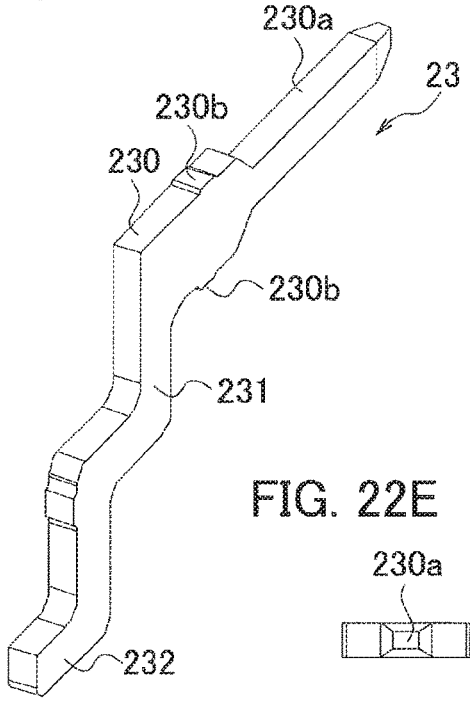
FIG. 22A is a perspective view.
Figure 22E:
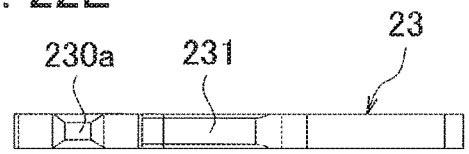
FIG. 22E is a front view.
Figure 22B:
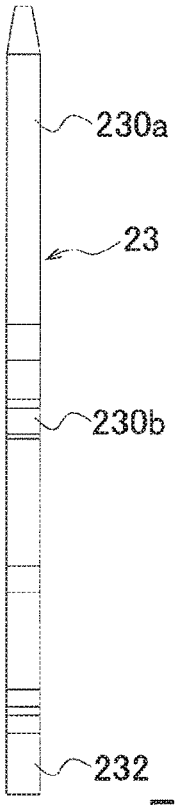
FIG. 22B is a plan view.
Figure 22C:
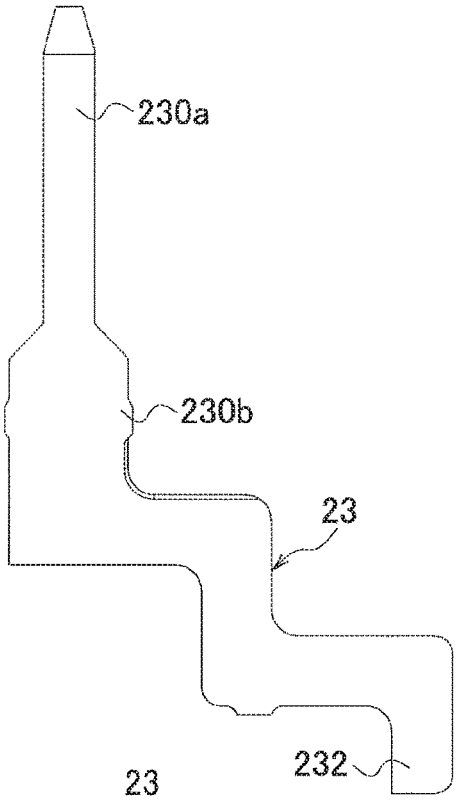
FIG. 22C is a side view.
Figure 22D:
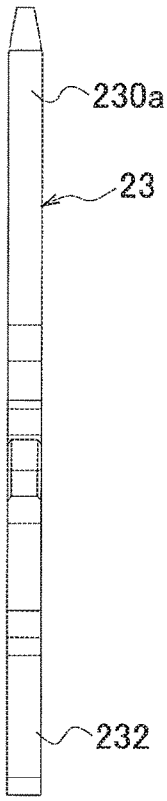
FIG. 22D is a reverse side view.
Figure 22F:
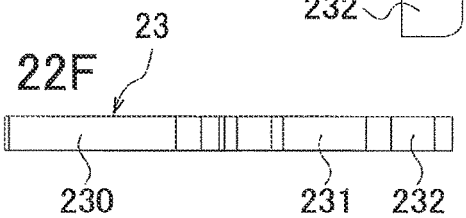
FIG. 22F is a back view showing the first terminal included in the receptacle connector shown as an example.
Figure 23A:
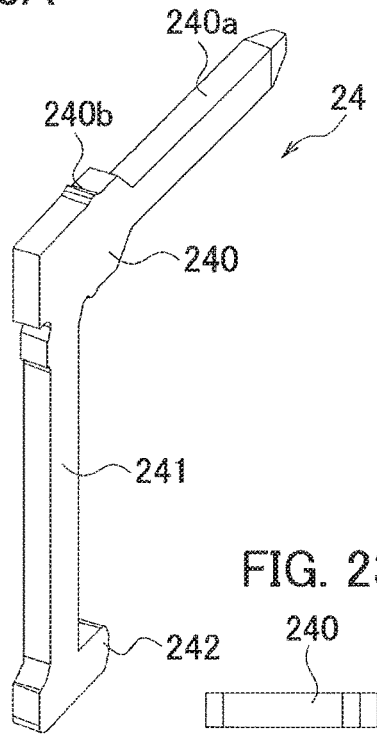
FIG. 23A is a perspective view.
Figure 23B:
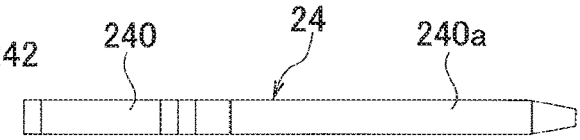
FIG. 23B is a plan view.
Figure 23F:
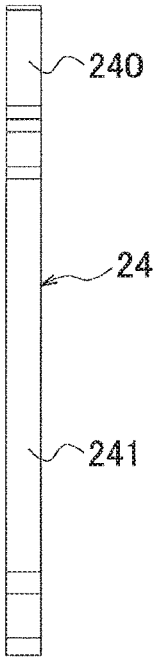
FIG. 23F is a back view showing the second terminal included in the receptacle connector shown as an example.
Figure 23C:
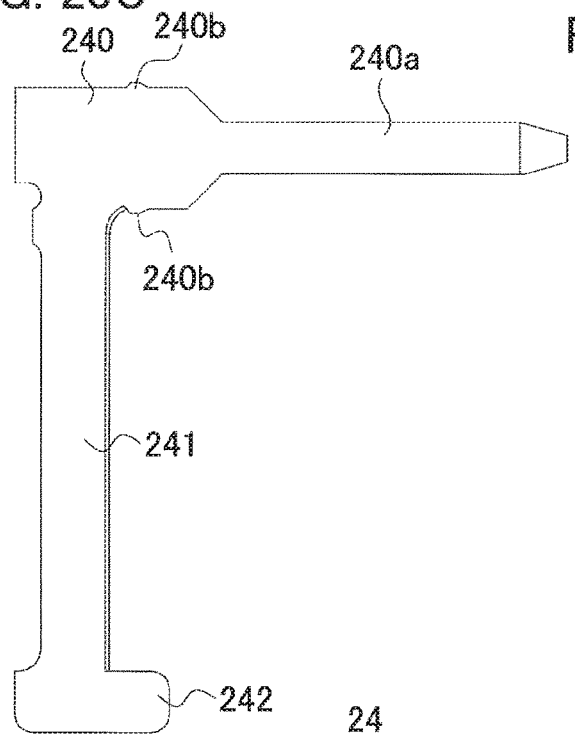
FIG. 23C is a side view.
Figure 23E:
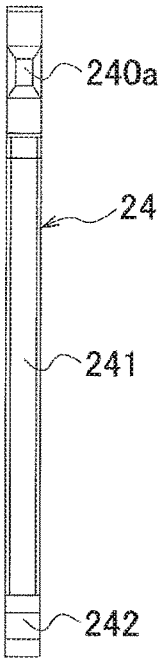
FIG. 23E is a front view.
Figure 23D:
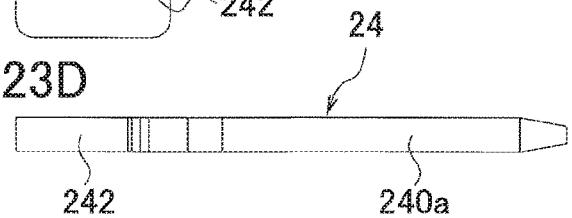
FIG. 23D is a reverse side view.
Figure 24A:
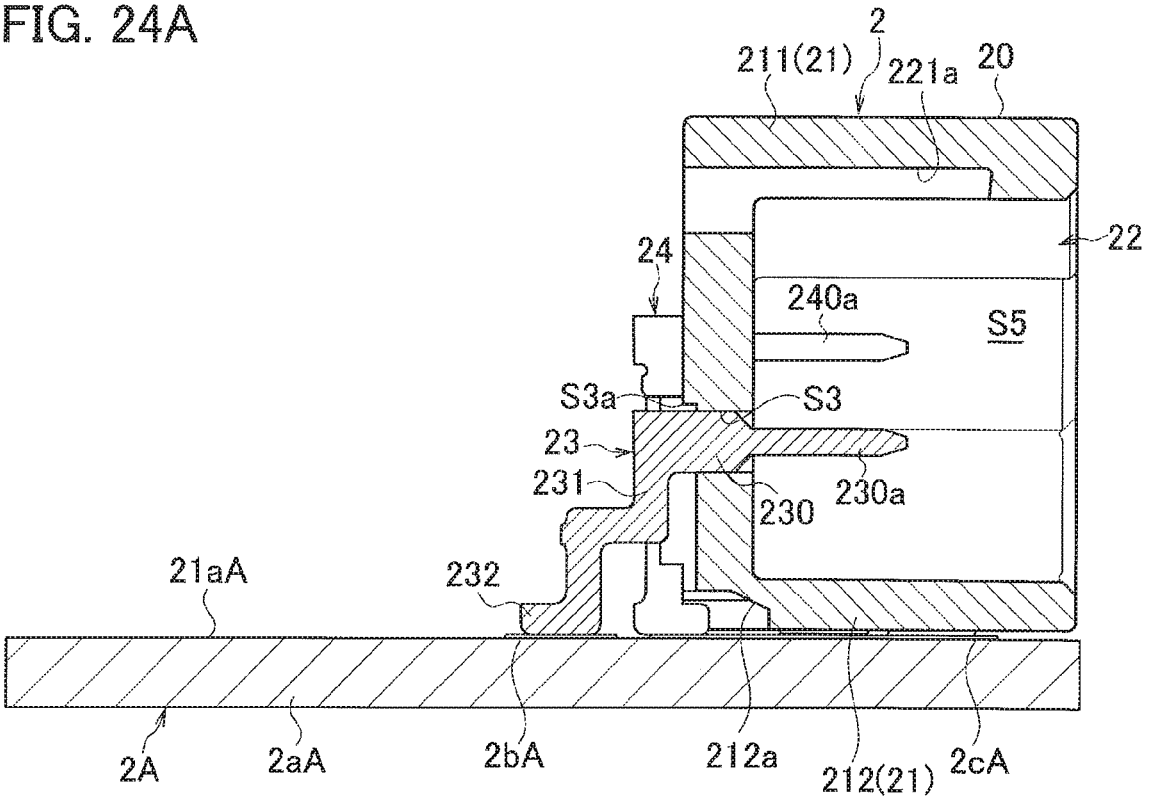
FIG. 24A and FIG. 24B are sectional side views showing a state where the receptacle connector shown as an example is mounted on the circuit board, FIG. 24A showing a state where the first terminal is mounted on a conductor part of the circuit board and FIG. 24B showing a state where the second terminal is mounted on the conductor part of the circuit board.
Figure 24B:
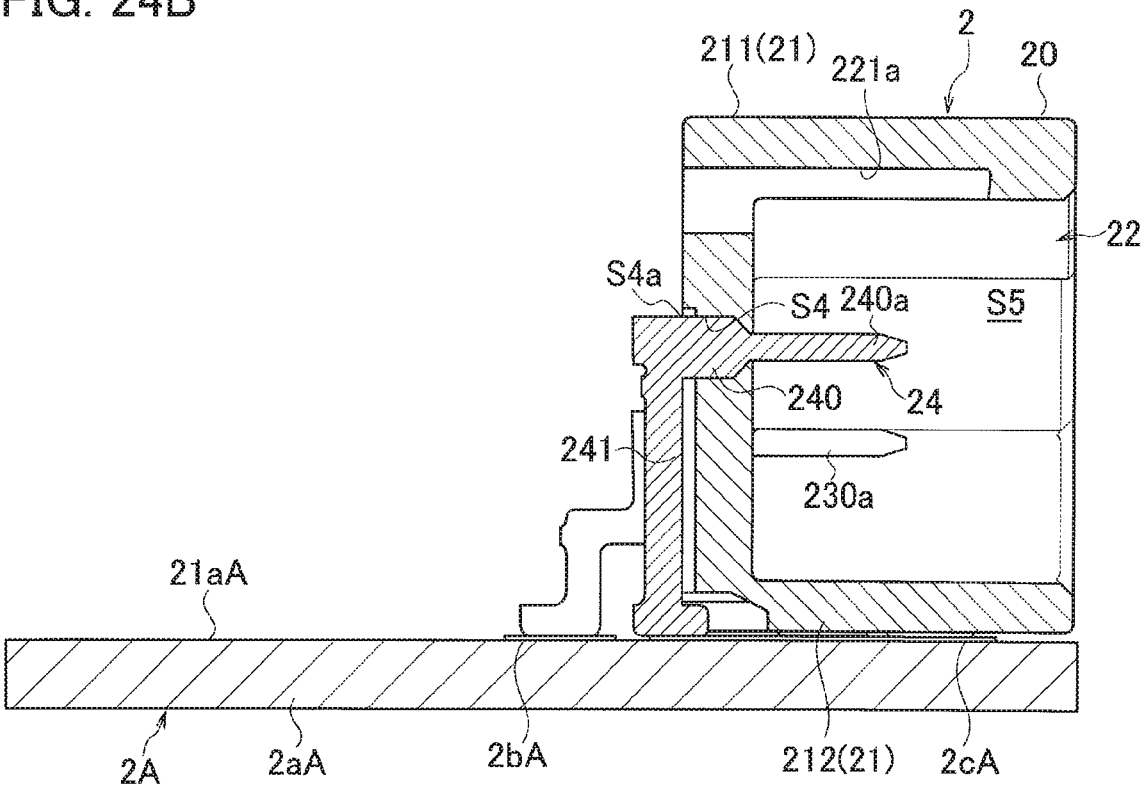

As shown in FIG. 18 and FIG. 19, the receptacle connector 2 includes a receptacle housing (housing) 20 and receptacle terminals (terminals) 23 and 24 held by the receptacle housing 20. The receptacle connector 2 also includes holding brackets 25 held by the receptacle housing 20.

The receptacle connector 2 is configured to be mounted on the circuit board 2A as the mounting member by mounting the receptacle terminals 23 and 24 held by the receptacle housing 20 on the conductor part 2*b*A of the circuit board 2A disposed outside the receptacle housing 20. Note that the receptacle terminals 23 and 24 are also mounted on the conductor part 2*b*A by soldering or the like. The holding brackets 25 are fixed to the fixing parts 2*c*A of the circuit board 2A by soldering or the like, in a state where the holding brackets 25 are held by the receptacle housing 20, to fix the receptacle housing 20 to the circuit board 2A.

Note that the circuit board 2A includes a board main body 2*a*A that has an approximately rectangular plate shape and is formed of a rigid and insulating resin material or the like. The conductor part 2*b*A and the fixing parts 2*c*A are formed so as to be exposed to the surface 21*a*A of the board main body 2*a*A. Thus, in this embodiment, the surface 21*a*A of the board main body 2*a*A serves as a mounting surface.

The receptacle housing 20 includes a rigid housing main body 21, and can be formed, for example, using an insulating resin material.

The housing main body 21 also has a lock insertion part 22 formed on its upper side. The lock part 12 configured to hold the plug housing 10 and the receptacle housing 20 in their fitted state or to release the fitted state is inserted into this lock insertion part 22.

Thus, in this embodiment, the receptacle housing 20 includes the housing main body 21 and the lock insertion part 22 formed in the housing main body 21.

The housing main body 21 includes a top wall 211, a bottom wall 212, a pair of side walls 213 connecting both ends, in the width direction (Y direction), of the top wall 211 and the bottom wall 212, and a rear wall 214 provided continuously from rear ends of the top wall 211, the bottom wall 212, and the side walls 213, 213.

The lock insertion part 22 is formed in the middle, in the width direction, of the top wall 211. To be more specific, the lock insertion part 22 includes a housing part 221 that is formed inside an upward protruding region of the top wall 211, and houses the lever part 121. In the middle, in the front-rear direction, of the housing part 221, an engaged part (engagement recess part) 221*a* is formed to engage with the engagement protrusion 121*b* of the lock part 12. The housing part 221 also has guide grooves 221*c* formed on either side thereof in the width direction, into which the guide walls 111*a* are inserted.

The top wall 211 also has guide protrusions 211*b* formed thereon, which are housed in the guide grooves 111*b*.

Moreover, the rear wall 214 has a plurality of spaces formed therein, which penetrate in the front-rear direction. In this embodiment, a plurality of spaces arranged in the width direction (Y direction) are formed in two stages in the top-bottom direction (Z direction). These spaces are formed in a staggered pattern when viewed from the rear side in the front-rear direction of the housing main body 21. Accordingly, the receptacle connector 2 is reduced in size in the width direction.

Then, the receptacle terminals 23 and 24 are press-fitted (inserted) into the spaces penetrating in the front-rear direction, respectively.

To be more specific, the spaces formed on the lower side (mounting surface 21*a*A side) of the housing main body 21 serve as first spaces S3 into which first receptacle terminals 23 to be described later, among the receptacle terminals 23 and 24, are press-fitted (inserted).

On the other hand, the spaces formed on the upper side (position further away from the mounting surface 21*a*A than the first spaces S3) of the housing main body 21 serve as second spaces S4 into which second receptacle terminals 24 to be described later, among the receptacle terminals 23 and 24, are press-fitted (inserted).

The first receptacle terminals 23 are each configured to be press-fitted (inserted) forward from an opening at the rear end side of the first space S3. This opening at the rear end side of the first space S3 serves as an insertion opening (insertion slot) S3*a*. Likewise, the second receptacle terminals 24 are each configured to be press-fitted (inserted) forward from an opening at the rear end side of the second space S4. This opening at the rear end side of the second space S4 serves as an insertion opening (insertion slot) S4*a*.

Moreover, the housing main body 21 has a fitting space S5 formed therein, which is opened forward (toward the plug connector 1 side). This fitting space S5 is a space into which the housing main body 11 of the plug housing 10 is inserted and fitted, and which is defined by the top wall 211, the bottom wall 212, the pair of side walls 213, 213, and the rear wall 214. Therefore, the first space S3 and the second space S4 are formed to communicate with the fitting space S5, respectively.

Furthermore, in this embodiment, a plurality of projections 214*a* extending in the top-bottom direction and protruding rearward are arranged in the width direction at the rear end of the rear wall 214. To be more specific, the projections 214*a* are formed between the first and second spaces S3 and S4 adjacent to each other in the width direction.

Moreover, a recess part 212*a* that is opened downward and rearward and extends in the front-rear direction is formed at the rear end of the bottom wall 212. This recess part 212*a* houses a mounting piece (mounting part) 242 of the second receptacle terminal 24 in the press-fitted (inserted) state.

Moreover, the pair of side walls 213, 213 have holding bracket attachments 213*a*, 213*a* formed thereon, respectively, to hold the holding brackets 25.

In this embodiment, the holding bracket attachment 213*a* includes: a recess part 213*b* opened outward in the top-bottom direction and in the width direction; and slits 213*c*, 213*c* provided continuously inward, in the width direction, of the recess part 213*b*, into which both ends, in the front-rear direction, of a main body part 251 of the holding bracket 25 is inserted. In a state where the holding brackets 25 are held by the receptacle housing 20, fixing pieces 252 provided continuously from lower ends of the main body parts 251 are fixed to the fixing parts 2*c*A of the circuit board 2A, thereby fixing the receptacle housing 20 to the circuit board 2A.

Moreover, in this embodiment, the receptacle terminals each include: a main body part to be inserted into a space formed in the receptacle housing 20; a leg part extending from the main body part toward the mounting surface 21*a*A of the circuit board 2A in a state where the receptacle terminals are mounted on the circuit board (the mounting member) 2A; and a mounting part provided continuously from the leg part and to be mounted on the circuit board 2A.

To be more specific, the receptacle terminals include the first receptacle terminal 23 to be press-fitted (inserted) into the first space S3 formed on the lower side (mounting surface 21*a*A side) of the housing main body 21. The receptacle terminals further include the second receptacle terminal 24 to be press-fitted (inserted) into the second space S4 formed on the upper side (position further away from the mounting surface 21*a*A than the first space S3) of the housing main body 21.

In this embodiment, the first receptacle terminal 23 is conductive, and a plurality of the first receptacle terminals 23 are arranged in the width direction (Y direction) of the receptacle housing 20. As shown in FIG. 22, the first receptacle terminal 23 is formed into a thin plate shape, and is press-fitted (inserted) from the rear side into the first space S3 formed in the housing main body 21 in a state where the plate thickness direction is approximately aligned with the width direction (Y direction). Such a first receptacle terminal 23 can be formed, for example, by punching thin sheet metal.

The first receptacle terminal 23 also includes a first main body part 230 to be press-fitted (inserted) into the first space S3. The first receptacle terminal 23 further includes: a first leg part 231 extending from the first main body part 230 toward the mounting surface 21*a*A in a state where the first receptacle terminal 23 is mounted on the circuit board (the mounting member) 2A; and a first mounting piece (first mounting part) 232 provided continuously from the first leg part 231 and to be mounted on the circuit board 2A.

At the front end of the first main body part 230, an approximately rod-shaped contact part 230*a* is formed so as to protrude forward. Also, press-fit protrusions 230*b* are formed at the upper and lower ends of the first main body part 230. The first main body part 230 is press-fitted into the first space S3 by sticking the press-fit protrusions 230*b* into the housing main body 21. In the state where the first main body part 230 is press-fitted (inserted) into the first space S3, the contact part 230*a* is disposed in the fitting space S5.

Moreover, in this embodiment, the first leg part 231 is provided extending downward (toward the circuit board 2A: mounting member) from the rear end of the first main body part 230. To be more specific, the first leg part 231 is bent into a crank shape and has its lower end located behind the first main body part 230. Thus, in this embodiment, the first leg part 231 is provided extending in the housing thickness direction (top-bottom direction) from the first main body part 230 press-fitted (inserted) into the first space S3. The first mounting piece 232 is provided continuously from the lower end of this first leg part 231 so as to protrude rearward.

Meanwhile, the second receptacle terminal 24 is also conductive, and a plurality of the second receptacle terminals 24 are arranged in the width direction (Y direction) of the receptacle housing 20. As shown in FIG. 23, the second receptacle terminal 24 is formed into a thin plate shape, and is press-fitted (inserted) from the rear side into the second space S4 formed in the housing main body 21 in a state where the plate thickness direction is approximately aligned with the width direction (Y direction). Such a second receptacle terminal 24 can also be formed, for example, by punching thin sheet metal.

The second receptacle terminal 24 also includes a second main body part 240 to be press-fitted (inserted) into the second space S4. The second receptacle terminal 24 further includes: a second leg part 241 extending from the second main body part 240 toward the mounting surface 21*a*A in a state where the second receptacle terminal 24 is mounted on the circuit board (the mounting member) 2A; and a second mounting piece (second mounting part) 242 provided continuously from the second leg part 241 and to be mounted on the circuit board 2A.

At the front end of the second main body part 240, an approximately rod-shaped contact part 240*a* is formed so as to protrude forward. Also, press-fit protrusions 240*b* are formed at the upper and lower ends of the second main body part 240. The second main body part 240 is press-fitted into the second space S4 by sticking the press-fit protrusions 240*b* into the housing main body 21. In the state where the second main body part 240 is press-fitted (inserted) into the second space S4, the contact part 240*a* is disposed in the fitting space S5.

Moreover, in this embodiment, the second leg part 241 is provided approximately linearly extending downward (toward the circuit board 2A: mounting member) from the rear end of the second main body part 240. Thus, in this embodiment, the second leg part 241 is provided extending in the housing thickness direction (top-bottom direction) from the second main body part 240 press-fitted (inserted) into the second space S4. The second leg part 241 has its length, in the top-bottom direction, longer than the first leg part 231. The first mounting piece 232 is provided continuously from the lower end of this second leg part 241 so as to protrude forward.

Thus, in this embodiment, the second mounting piece (second mounting part) 242 is provided continuously from the second leg part 241 so as to protrude forward (toward one side) in the front-rear direction (X direction: insertion direction into the space of the main body part). Also, the first mounting piece (first mounting part) 232 is provided continuously from the first leg part 231 so as to protrude rearward (toward the other side) in the front-rear direction (X direction: insertion direction into the space of the main body part).

More specifically, the mounting parts (first and second mounting pieces 232 and 242) are arranged in a staggered pattern in a state where the plurality of receptacle terminals are held by the receptacle housing 20.

Furthermore, the second mounting piece 242 is housed in the recess part 212*a* formed at the rear end of the bottom wall 212 in the state where the second main body part 240 is inserted into the second space S4. Meanwhile, the first mounting piece 232 is positioned behind the insertion opening S3*a* of the first space S3 in the state where the first main body part 230 is inserted into the first space S3.

Therefore, the second mounting piece 242 overlaps with the receptacle housing 20 in the plan view in a state where the plurality of receptacle terminals are held by the receptacle housing 20 and also mounted on the circuit board 2A. At the same time, the first mounting pieces 232 are exposed from the receptacle housing 20 in the plan view in a state where the plurality of receptacle terminals are held by the receptacle housing 20 and also mounted on the circuit board 2A.

More specifically, either one of the first and second mounting pieces (mounting parts) 232 and 242 overlaps with the receptacle housing 20 when the receptacle housing 20 is viewed along the direction normal to the mounting surface 21*a*A in a state where the receptacle connector 2 is mounted on the circuit board 2A.

Thus, in this embodiment, the mounting parts are arranged in a staggered pattern on either side of the insertion opening (rear end) of the space in the state where the plurality of receptacle terminals are held by the receptacle housing.

Furthermore, in this embodiment, at the position where the press-fitting (insertion) of the first main body part 230 into the first space S3 is completed, the first leg part 231 is held between the projections 214*a* in a state of having its movement restricted in the width direction (Y direction; thickness direction). More specifically, the projections 214*a* formed on the rear wall 214 of the housing main body 21 function as leg part holders 216 to hold the first leg part 231. Thus, the receptacle connector 2 includes the leg part holders 216 connected to the receptacle housing 20 to hold the first leg part 231. In this embodiment, the leg part holders 216 are formed integrally with the receptacle housing 20. Note that the leg part holders may be formed by connecting separate members from the receptacle housing 20 to the receptacle housing 20.

Moreover, at the position where the press-fitting (insertion) of the second main body part 240 into the second space S4 is completed, the second leg part 241 is held between the projections 214*a* in a state of having its movement restricted in the width direction (Y direction; thickness direction). More specifically, the projections 214*a* formed on the rear wall 214 of the housing main body 21 function as leg part holders 217 to hold the second leg part 241. Thus, the receptacle connector 2 includes the leg part holders 217 connected to the receptacle housing 20 to hold the second leg part 241. The leg part holders 217 are also formed integrally with the receptacle housing 20 in this embodiment, but may be formed as separate members.

In this way, the leg parts 231 and 241 are prevented from being deformed when the terminals 23 and 24 are press-fitted (inserted) into the spaces S3 and S4 of the main body parts 230 and 240.

When the plug connector 1 described above is fitted into the receptacle connector 2 thus configured, the lock part 12 of the plug housing 10 is inserted into the lock insertion part 22 of the receptacle housing 20, and thus the housing main body 11 is inserted into the fitting space S5.

In this event, the engagement protrusion 121*b* of the lever part 121 is pushed downward by the top wall 211 of the receptacle housing 20. When the engagement protrusion 121*b* is pushed downward by the top wall 211 in this way, the rear end part (operation part 121*a*) of the lever part 121 is elastically deformed so as to move downward, and thus the engagement protrusion 121*b* can be moved into the inner side of the lock insertion part 22.

Then, when the engagement protrusion 121*b* is moved into the inner side of the lock insertion part 22, the downward pushing of the engagement protrusion 121*b* by the top wall 211 is released, and the elastic restoring force of the lever part 121 moves the engagement protrusion 121*b* upward. The engagement protrusion 121*b* is moved upward to be engaged with the engaged part 221*a* formed in the receptacle connector 2, thus allowing the plug connector 1 and the receptacle connector 2 to be locked in the fitted state.

During the course of fitting the plug connector 1 into the receptacle connector 2, the tip of the contact part 230*a* of the first receptacle terminal 23 is introduced into the first space S1 formed in the plug housing 10 from the introduction port S1*b* to come into contact with the contact part 130*a* of the first plug terminal 13. Note that, in this embodiment, the approximately rod-shaped contact part 230*a* is inserted between the pair of contact pieces 138, 138 and sandwiched by the pair of contact pieces 138, 138 to achieve conduction between the first plug terminal 13 and the first receptacle terminal 23.

Likewise, the tip of the contact part 240*a* of the second receptacle terminal 24 is introduced into the second space S2 formed in the plug housing 10 from the introduction port S2*b* to come into contact with the contact part 140*a* of the second plug terminal 14. Note that, in this embodiment, the approximately rod-shaped contact part 240*a* is inserted between the pair of contact pieces 148, 148 and sandwiched by the pair of contact pieces 148, 148 to achieve conduction between the second plug terminal 14 and the second receptacle terminal 24.

As described above, the plug connector 1 and the receptacle connector 2 are fitted together to achieve conduction between the terminals 13 and 14 and the terminals 23 and 24. Thus, the connector set C1 is formed to electrically connect the cable 1A to the circuit board 2A.

Meanwhile, in order to detach the plug connector 1 from the receptacle connector 2, the operation part 121*a* of the lever part 121 is first lowered to move the lever part 121 downward. Accordingly, the engagement protrusion 121*b* is also moved downward to release the engagement between the engagement protrusion 121*b* and the engaged part 221*a*. Then, by pulling the plug connector 1 in a removal direction from the receptacle connector 2 in the state where the engagement between the engagement protrusion 121*b* and the engaged part 221*a* is released, the plug connector 1 is moved in the removal direction relative to the receptacle connector 2. When the plug connector 1 is thus moved in the removal direction relative to the receptacle connector 2, the conduction between the terminals is first released, and then the fitting between the housings is released. Thus, the plug connector 1 is detached from the receptacle connector 2.

Configuration Example of Receptacle Connector 3

Next, with reference to FIGS. 25 to 40, description is given of a configuration example of the receptacle connector 3.

Figure 25:
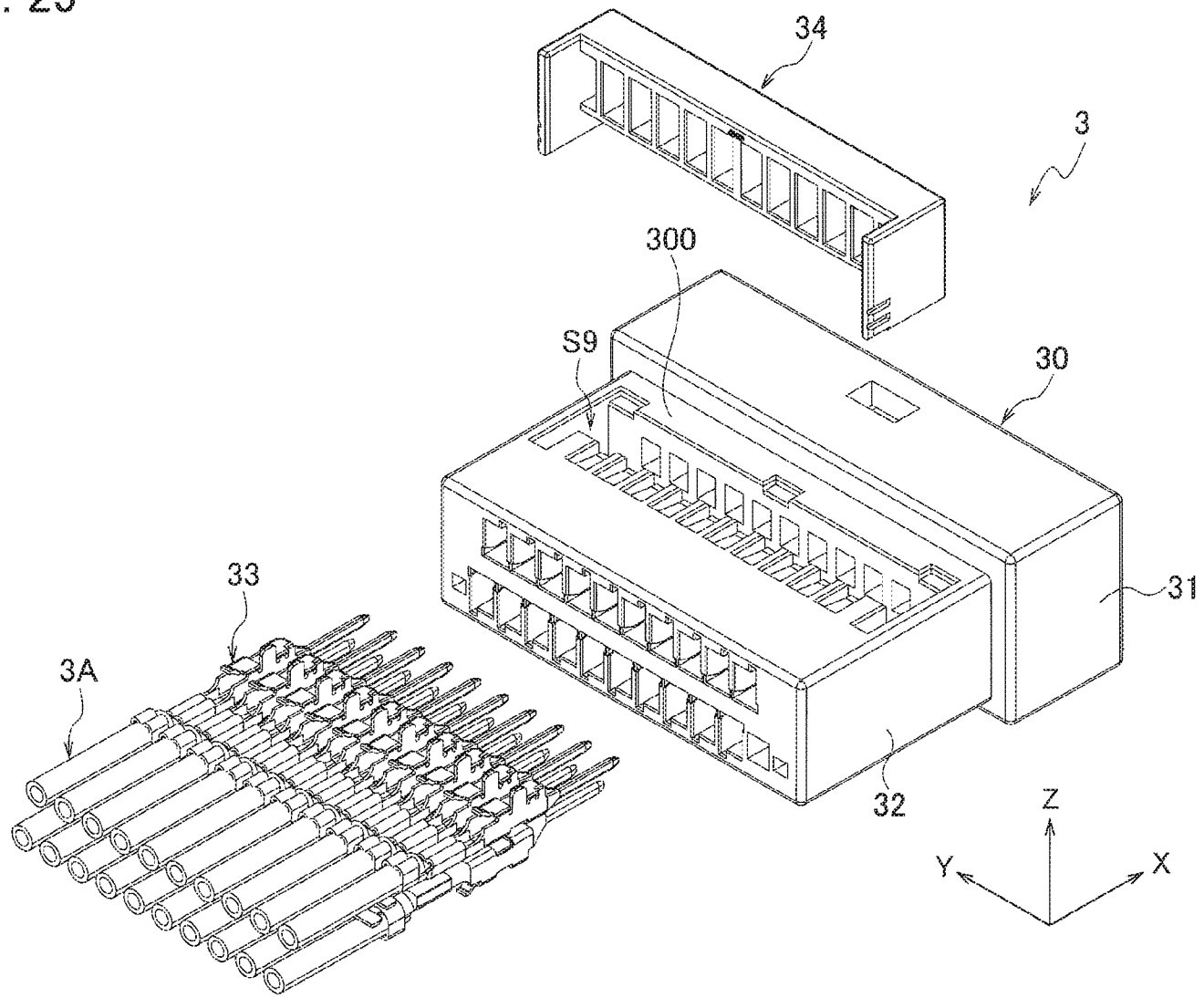
FIG. 25 is an exploded perspective view showing the electric wires and the receptacle connector included in the connector set shown as another example.

As shown in FIG. 25, the receptacle connector 3 includes: a plurality of relay terminals 33 to which an electric wire 3A is connected respectively; and a receptacle housing 30 having a plurality of spaces formed therein, into which the relay terminal 33 is inserted respectively. The receptacle connector 3 includes a retainer 34 attached to the receptacle housing 30 to prevent the relay terminals 33 from coming off the receptacle housing 30.

The receptacle housing 30 is rigid and can be formed, for example, using an insulating resin material.

Figure 26A:
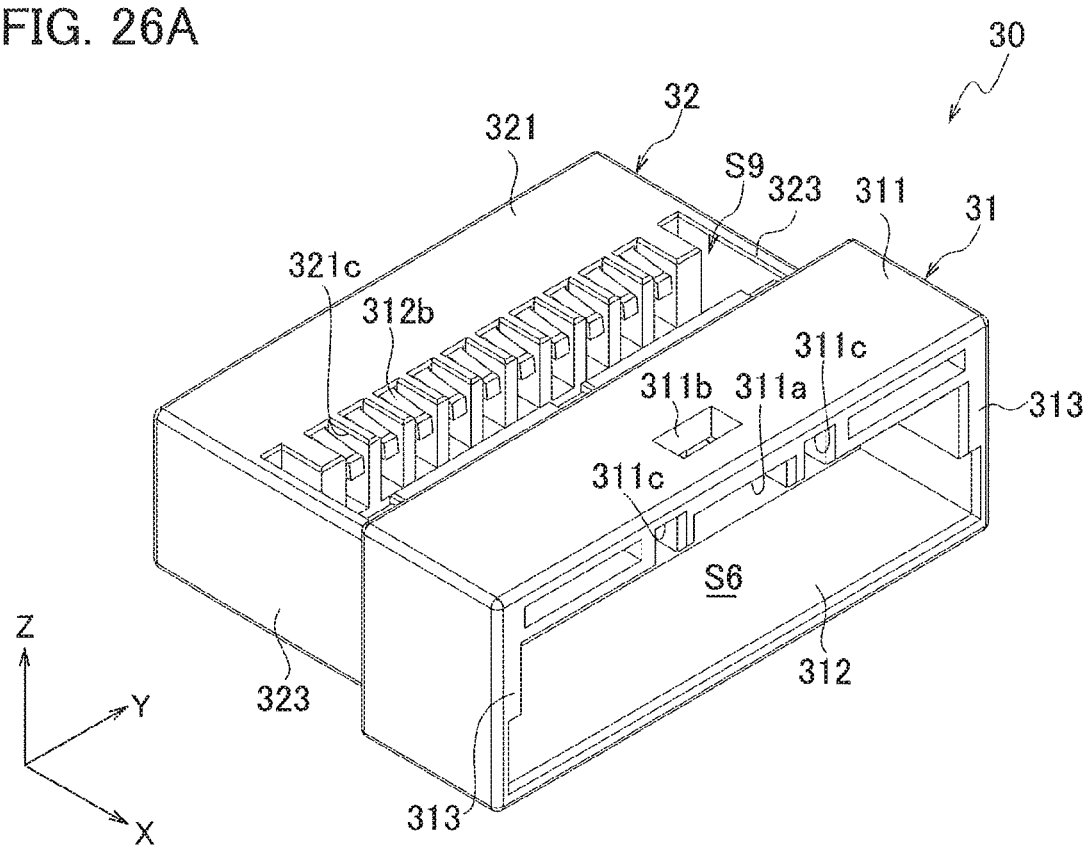
FIG. 26A and FIG. 26B are perspective views showing the receptacle housing included in the receptacle connector shown as another example, FIG. 26A showing a state viewed from the front side and FIG. 26B showing a state viewed from the back side.
Figure 26B:
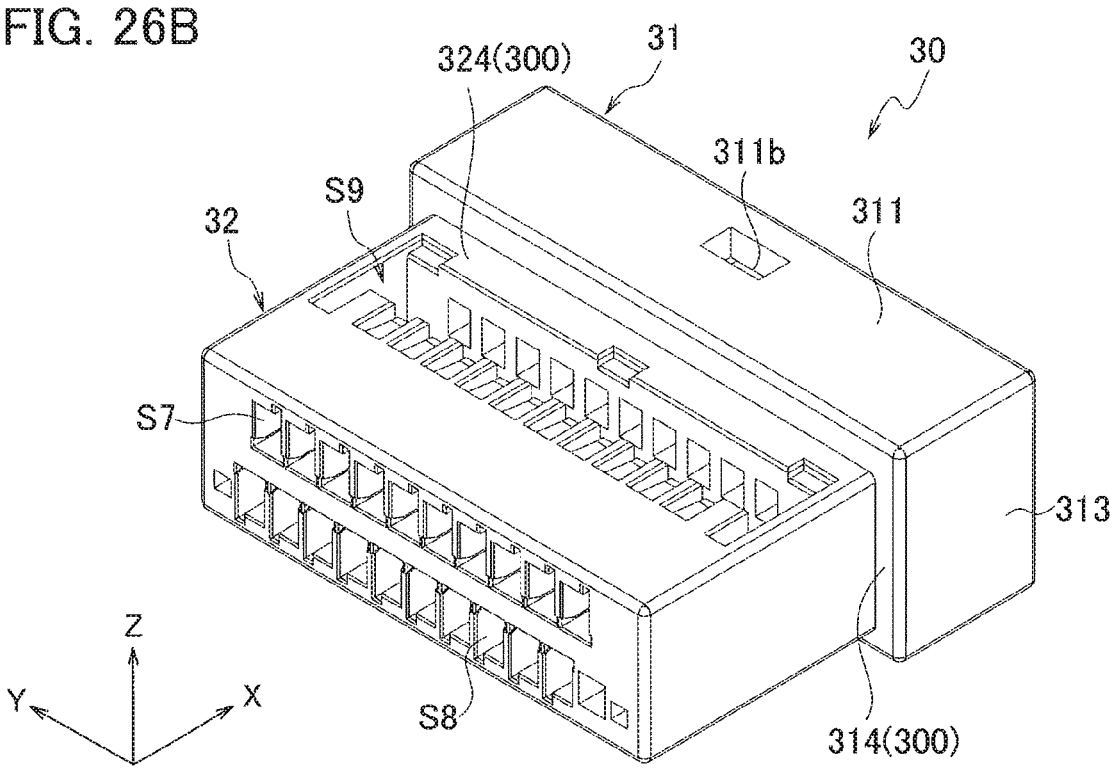
Figure 27A:
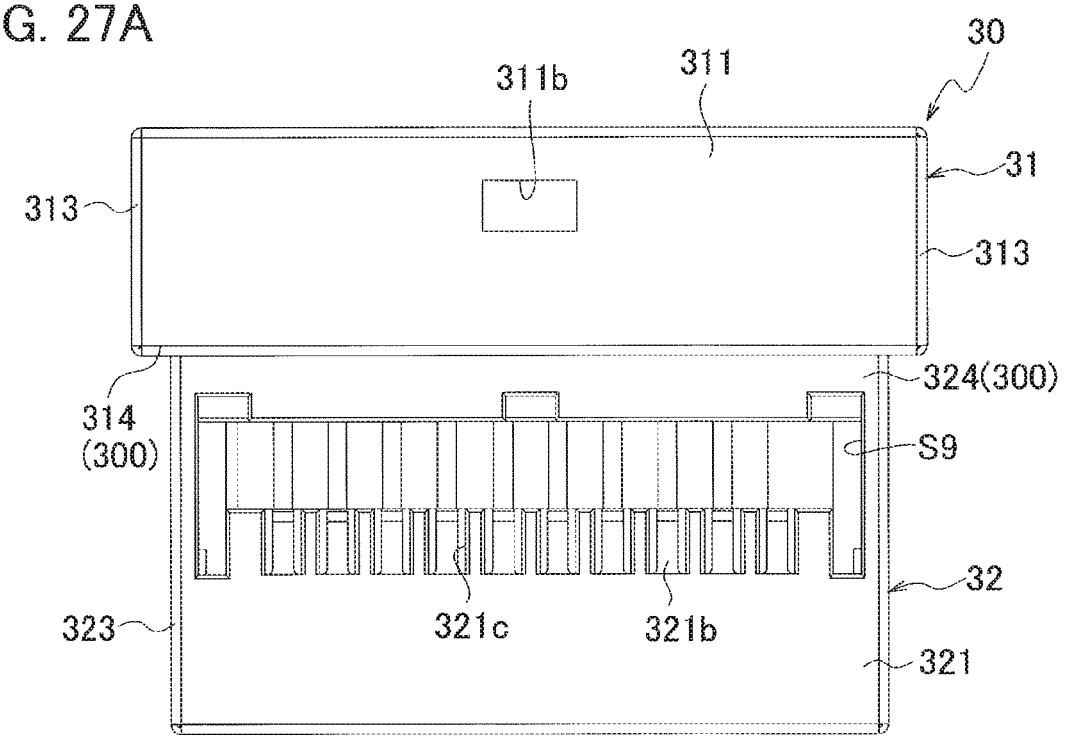
FIG. 27A is a plan view and FIG. 27B is a reverse side view showing the receptacle housing included in the receptacle connector shown as another example.
Figure 27B:
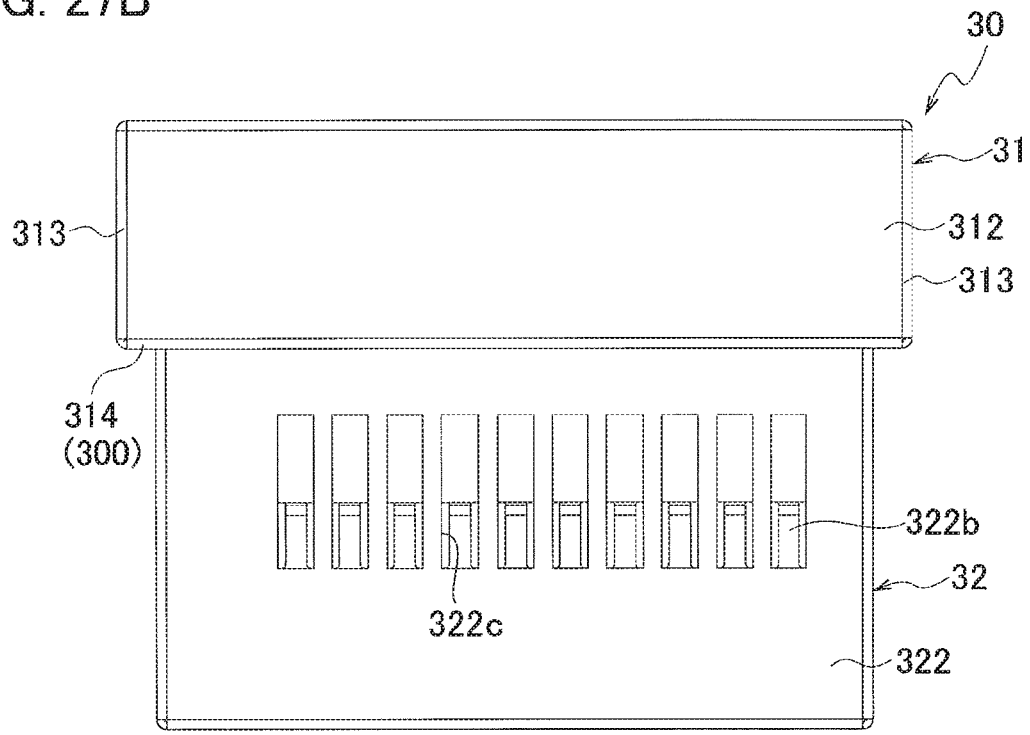
Figure 28A:
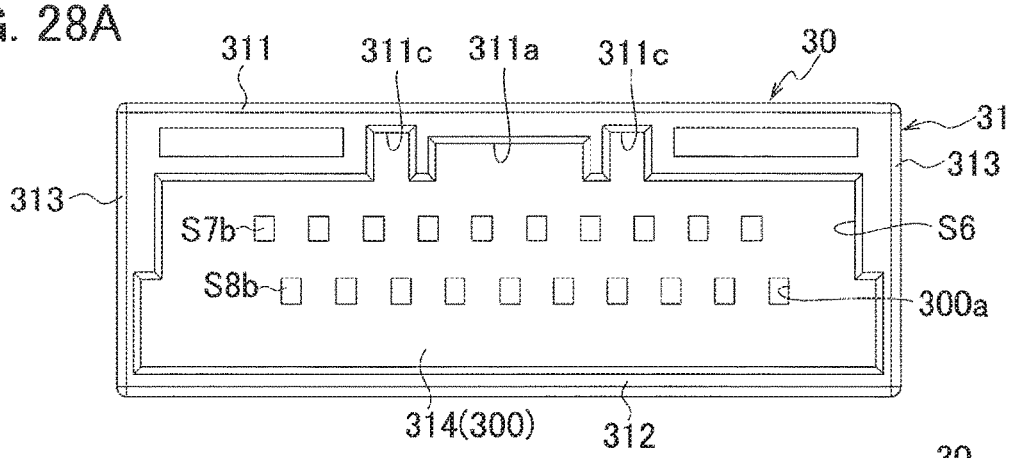
FIG. 28A is a front view.
Figure 28B:
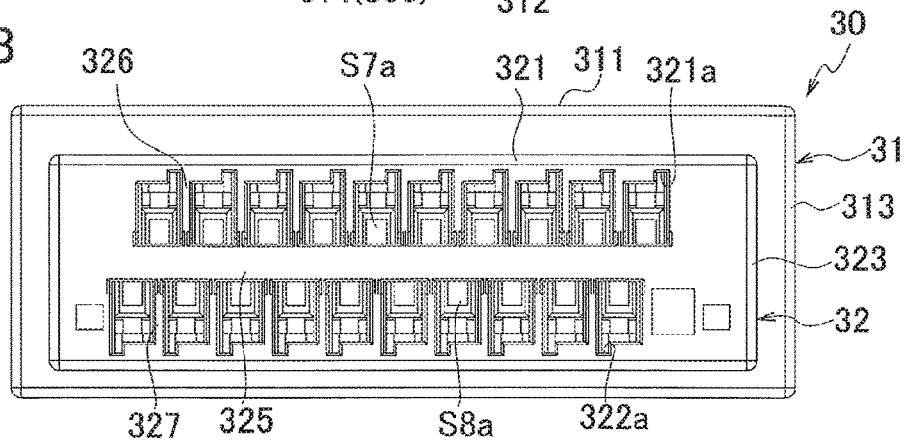
FIG. 28B is a back view.
Figure 28C:
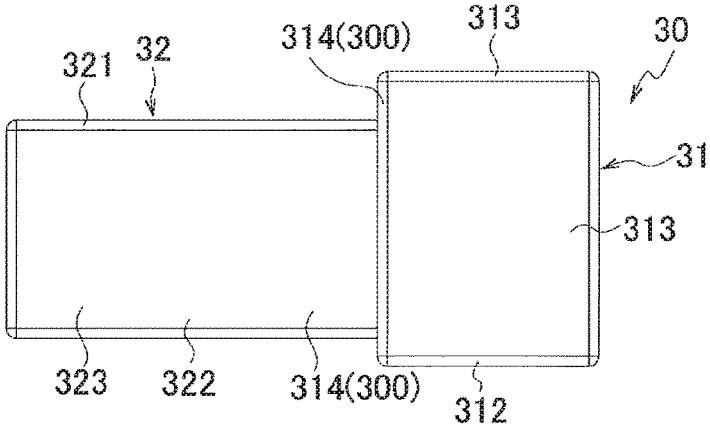
FIG. 28C is a side view.
Figure 28D:
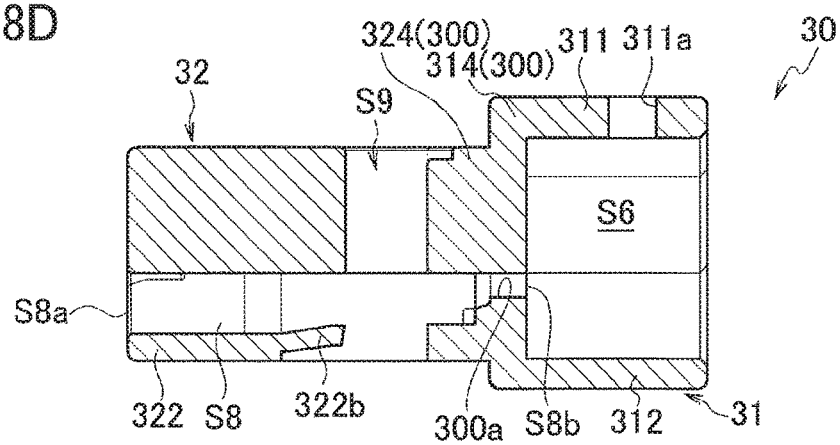
FIG. 28D is a sectional side view showing the receptacle housing included in the receptacle connector shown as another example.
Figure 29A:
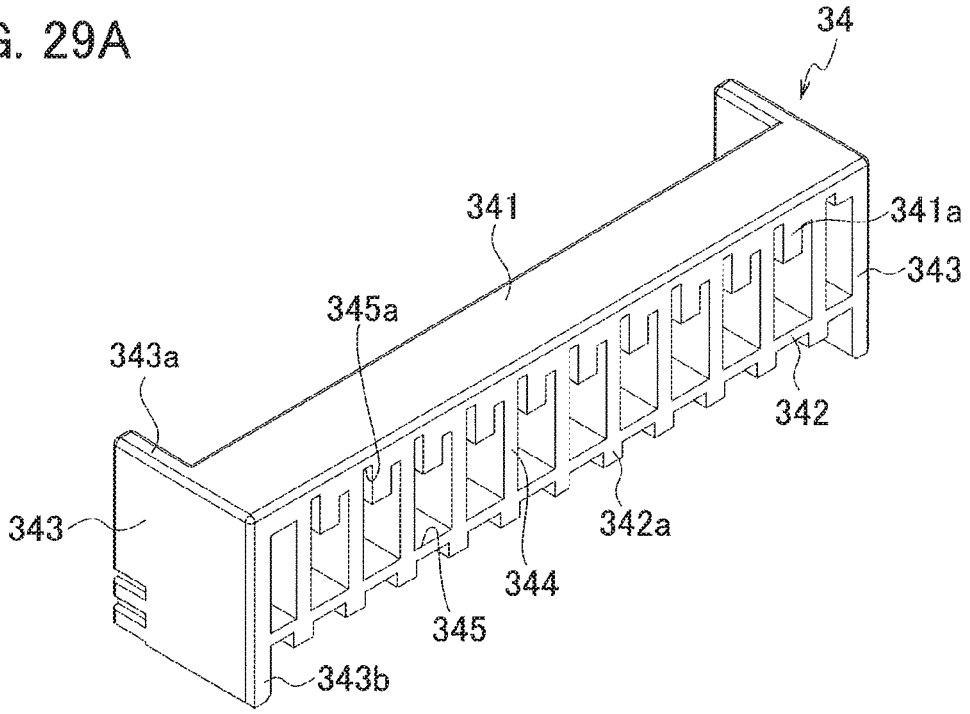
FIG. 29A and FIG. 29B are perspective views showing a retainer included in the receptacle connector shown as another example, FIG. 29A showing a state viewed from the front side and FIG. 29B showing a state viewed from the back side.
Figure 29B:
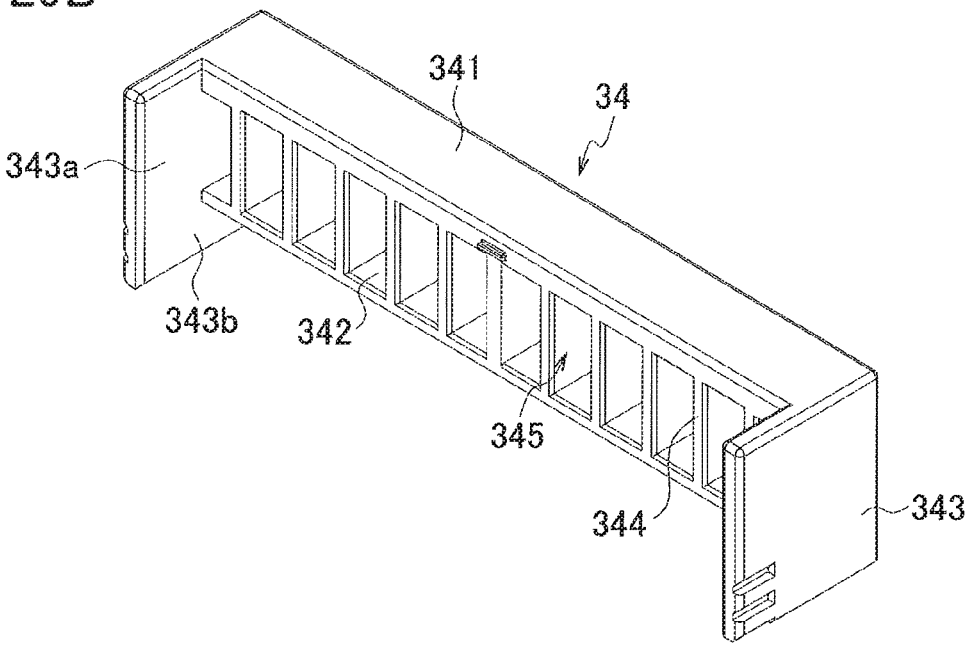
Figure 30A:
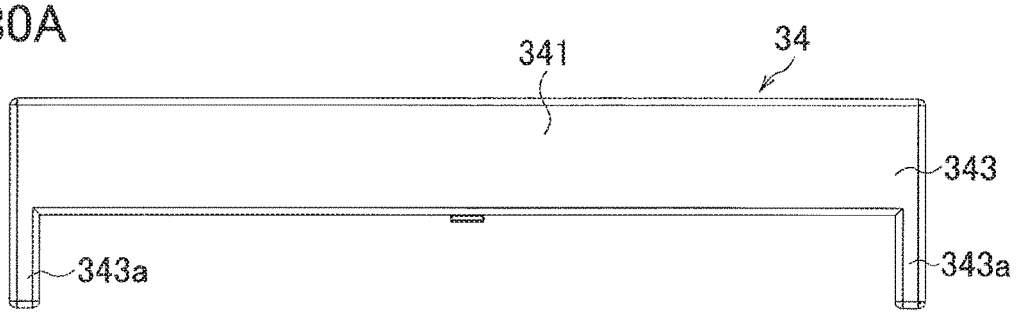
FIG. 30A is a plan view.
Figure 30B:
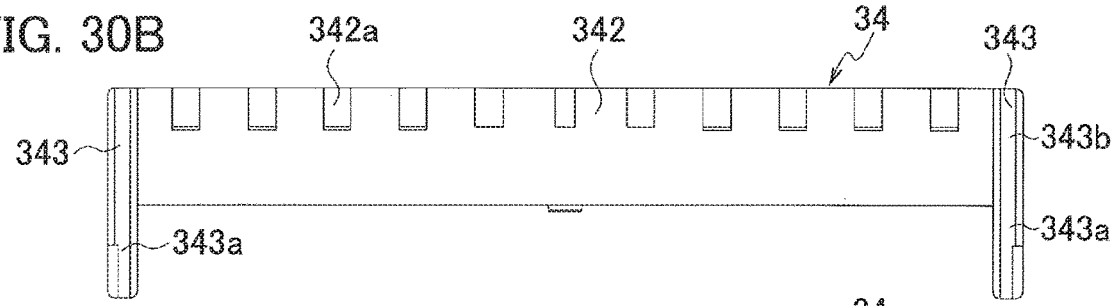
FIG. 30B is a reverse side view.
Figure 30C:
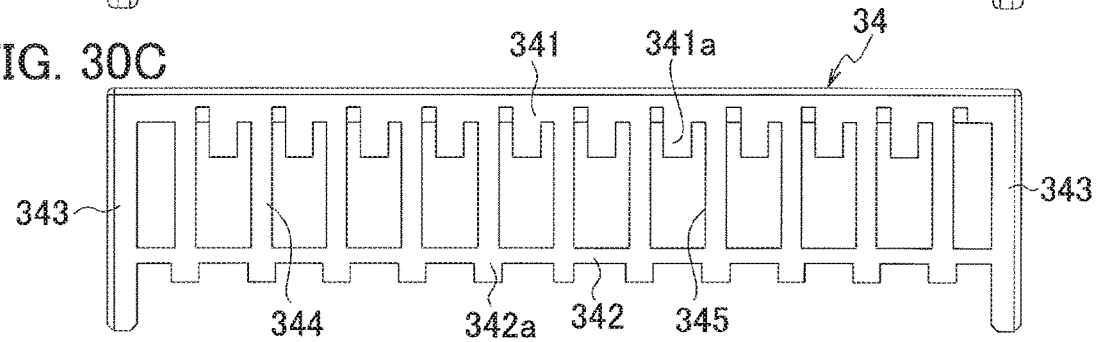
FIG. 30C is a front view.
Figure 30D:
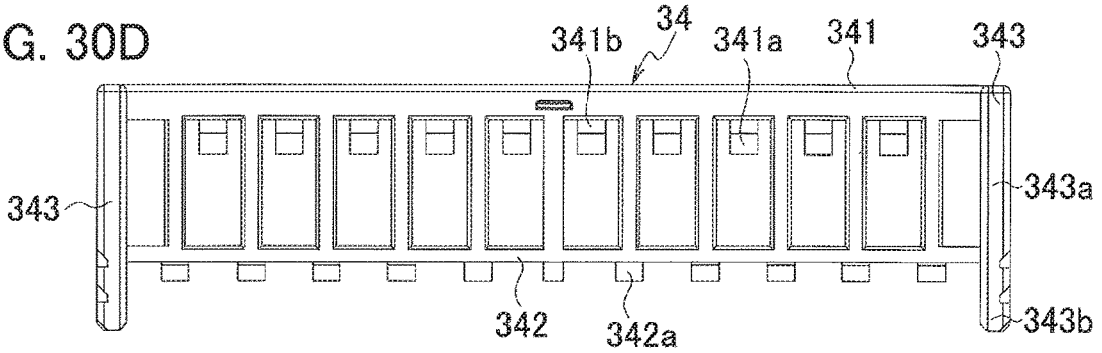
FIG. 30D is a back view.
Figure 30E:
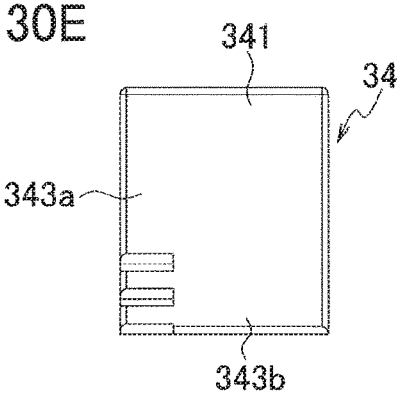
FIG. 30E is a side view.
Figure 30F:
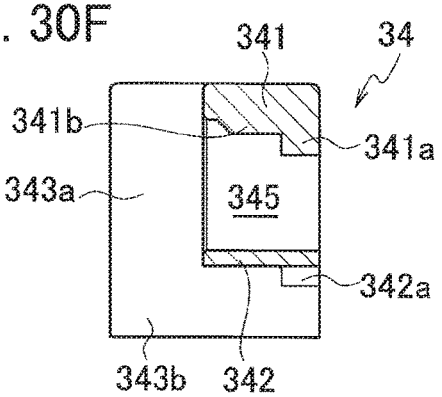
FIG. 30F is a sectional side view showing the retainer included in the receptacle connector shown as another example.

As shown in FIG. 25 and FIG. 26, the receptacle housing 30 includes an approximately rectangular parallelepiped-shaped front housing 31 and an approximately rectangular parallelepiped-shaped rear housing 32 provided continuously from a rear end of the front housing 31. In this embodiment, the rear housing 32 is formed to be slightly smaller than the front housing 31, and the receptacle housing 30 has a shape, as a whole, formed by connecting two rectangular parallelepiped members different in size.

The front housing 31 includes a top wall 311, a bottom wall 312, a pair of side walls 313 connecting both ends, in the width direction (Y direction), of the top wall 311 and the bottom wall 312, and a rear wall 314 provided continuously from rear ends of the top wall 311, the bottom wall 312, and the side walls 313, 313.

The lock part 12 is inserted into a central part, in the width direction, of the top wall 311. To be more specific, a housing part 311*a* to house the lever part 121 is formed in an approximately central part, in the width direction, of the top wall 311. Also, in a central part, in the front-rear direction, of the housing part 311*a*, an engaged part (engagement hole) 311*b* is formed, with which the engagement protrusion 121*b* of the lock part 12 is engaged. The housing part 311*a* also has guide grooves 311*c* formed on either side thereof in the width direction, into which the guide walls 111*a* are inserted.

The front housing 31 also has a fitting space S6 formed therein, which is opened forward (toward the plug connector 1 side). This fitting space S6 is a space into which the housing main body 11 of the plug housing 10 is inserted and fitted, and which is defined by the top wall 311, the bottom wall 312, the pair of side walls 313, 313, and the rear wall 314.

On the other hand, the rear housing 32 includes a top wall 321, a bottom wall 322, a pair of side walls 323 connecting both ends, in the width direction (Y direction), of the top wall 321 and the bottom wall 322, and a front wall 324 connected to front ends of the top wall 321, the bottom wall 322, and the side walls 323, 323.

In this embodiment, the rear wall 314 of the front housing 31 is integrated with the front wall 324 of the rear housing 32, and the rear wall 314 and the front wall 324 form a dividing wall 300 that divides the receptacle housing 30 into front and rear parts.

On the other hand, the rear housing 32 includes a partition wall 325 that is provided continuously from the pair of side walls 323 and partitions, into upper and lower parts, a space defined by the top wall 321, the bottom wall 322, and the side walls 323, 323.

Furthermore, the rear housing 32 includes a plurality of upper dividing walls 326 provided continuously from the top wall 321 and the partition wall 325. These upper dividing walls 326 divide the upper space partitioned by the partition wall 325 into a plurality of spaces. The rear housing 32 also includes a plurality of lower dividing walls 327 provided continuously from the bottom wall 322 and the partition wall 325. These lower dividing walls 327 divide the lower space partitioned by the partition wall 325 into a plurality of spaces.

The dividing wall 300 has through-holes 300*a* formed therein to communicate the fitting space S6 with the spaces formed in the rear housing 32. These through-holes 300*a* are formed at positions corresponding to the spaces partitioned by the upper dividing walls 326 and the lower dividing walls 327 when the receptacle housing 30 is viewed along the front-rear direction. More specifically, the receptacle housing 30 has a plurality of spaces formed therein that penetrate in the front-rear direction. The relay terminals 33 are inserted into these spaces penetrating in the front-rear direction, respectively.

Thus, in this embodiment, at the rear end of the rear housing 32, a plurality of spaces arranged in the width direction (Y direction) are formed in two stages in the top-bottom direction (Z direction). These plurality of spaces are formed in a staggered pattern when the rear housing 32 is viewed from the rear side in the front-rear direction. Accordingly, the receptacle connector 3 is reduced in size in the width direction.

To be more specific, on the upper side of the rear end part of the rear housing 32, a plurality of spaces defined by the top wall 321, the partition wall 325, and the upper dividing walls 326 are arranged in the width direction (Y direction). These spaces formed on the upper side of the rear housing 32 serve as first spaces S7 into which the relay terminals 33 are inserted.

Likewise, on the lower side of the rear end part of the rear housing 32, a plurality of spaces defined by the bottom wall 322, the partition wall 325, and the lower dividing walls 327 are arranged in the width direction (Y direction). These spaces formed on the lower side of the rear housing 32 serve as second spaces S8 into which the relay terminals 33 are inserted.

Furthermore, in this embodiment, the upper dividing walls 326 and the lower dividing walls 327 are formed at positions shifted from each other in the width direction. More specifically, the first spaces S7 and the second spaces S8 partially overlap with each other in the plan view in a state where the receptacle housing 30 is disposed such that the insertion direction of the relay terminals 33 is aligned with a horizontal direction.

Then, the relay terminals 33 are inserted forward from openings at the rear end side of the first spaces S7. These openings at the rear end side of the first spaces S7 serve as insertion openings (insertion slots) S7*a*. The openings (through-holes 300*a*) at the front end side of the first spaces S7 are formed to be smaller than the insertion openings S7*a* so as to prevent the relay terminals 33 from falling off. More specifically, the dividing wall 300 restricts forward movement of the relay terminals 33 inserted from the insertion openings S7*a*. Note that the openings (through-holes 300*a*) at the front end side of the first spaces S7 serve as insertion holes S7*b* into which approximately rod-shaped contact parts 333 of the relay terminals 33 are inserted.

Likewise, the relay terminals 33 are inserted forward from openings at the rear end side of the second spaces S8. These openings at the rear end side of the second spaces S8 serve as insertion openings (insertion slots) S8*a*. The openings (through-holes 300*a*) at the front end side of the second spaces S8 are formed to be smaller than the insertion openings S8*a* so as to prevent the relay terminals 33 from falling off. More specifically, the dividing wall 300 restricts forward movement of the relay terminals 33 inserted from the insertion openings S8*a*. Note that the openings (through-holes 300*a*) at the front end side of the second spaces S8 serve as insertion holes S8*b* into which the approximately rod-shaped contact parts 333 of the relay terminals 33 are inserted.

Also, on the lower side of the top wall 321, grooves 321*a* opened downward and in the front-rear direction are formed to communicate with the first spaces S7. Each of the grooves 321*a* guides insertion of the relay terminal 33 into the first space S7 while a tip of a projection 331*d* of the relay terminal 33 to be described later is inserted into the groove. In this embodiment, the groove 321*a* is formed on one side (right side), in the width direction, of the first space S7 in a state shown in FIG. 28B. The tip of the projection 331*d* of the relay terminal 33 passes through the groove 321*a* during the period from the start of insertion of the relay terminal 33 into the first space S7 through until the insertion is completed.

Likewise, on the lower side of the bottom wall 322, grooves 322*a* opened upward and in the front-rear direction are formed to communicate with the second spaces S8. Each of the grooves 322*a* also guides insertion of the relay terminal 33 into the second space S8 while a tip of a projection 331*d* of the relay terminal 33 is inserted into the groove. In this embodiment, the groove 322*a* is formed on one side (left side), in the width direction, of the second space S8 in the state shown in FIG. 28B. The tip of the projection 331*d* of the relay terminal 33 passes through the groove 322*a* during the period from the start of insertion of the relay terminal 33 into the second space S8 through until the insertion is completed.

Therefore, in this embodiment, the second space S8 has a shape obtained by inverting (turning 180 degrees) the first space S7, when the receptacle housing 30 is viewed from the rear side in the front-rear direction.

Moreover, in the top wall 321, notches 321*c* opened forward and in the top-bottom direction are formed to communicate with the first spaces S7. In these notches 321*c*, abutting pieces 321*b* protruding forward and elastically deformable in the top-bottom direction are formed. These abutting pieces 321*b* prevent the relay terminals 33 with the electric wires 3A connected thereto from falling off by abutting against retaining pieces 331*e* of the relay terminals 33 to be described later in a state where the relay terminals 33 are inserted into the first spaces S7 (insertion completed state) (see FIG. 37 and FIG. 38).

Likewise, in the bottom wall 322, notches 322*c* opened forward and in the top-bottom direction are formed to communicate with the second spaces S8. In these notches 322*c*, abutting pieces 322*b* protruding forward and elastically deformable in the top-bottom direction are formed. These abutting pieces 322*b* also prevent the relay terminals 33 with the electric wires 3A connected thereto from falling off by abutting against the retaining pieces 331*e* of the relay terminals 33 in a state where the relay terminals 33 are inserted into the second spaces S8 (insertion completed state) (see FIG. 39 and FIG. 40).

Furthermore, in this embodiment, a retainer housing space S9 is formed in the front part of the rear housing 32, into which the retainer 34 is slidably inserted. This retainer housing space S9 is formed to be opened upward when the rear housing 32 is disposed such that the first space S7 is positioned above the second space S8. More specifically, in the state where the rear housing 32 is disposed such that the first space S7 is positioned above the second space S8, the retainer 34 is inserted from above into the retainer housing space S9. In this event, the retainer 34 is housed in the retainer housing space S9 so as to be slidable in the top-bottom direction.

The retainer 34 includes a retainer main body 340 attached to the rear housing 32 so as to be slidable in the top-bottom direction when the rear housing 32 is disposed such that the first space S7 is positioned above the second space S8.

In this embodiment, the retainer main body 340 includes a top wall 341, a bottom wall 342, a pair of side walls 343 connecting both ends, in the width direction (Y direction), of the top wall 341 and the bottom wall 342.

The retainer main body 340 also includes a plurality of dividing walls 344 provided continuously from the top wall 341 and the bottom wall 342. By providing the dividing walls 344, a plurality of insertion holes 345 penetrating in the front-rear direction are arranged in the width direction in the retainer main body 340, which are defined by the top wall 341, the bottom wall 342, and the dividing walls 344, 344 adjacent to each other. The respective insertion holes 345 are formed to communicate with the first spaces S7 in a state where the retainer main body 340 is housed in the retainer housing space S9. Therefore, the relay terminals 33 are also inserted into the insertion holes 345 when inserted into the first spaces S7.

Moreover, in this embodiment, the side wall 343 includes a rear extension part 343*a* extending rearward in the front-rear direction and a lower extension part 343*b* extending downward in the top-bottom direction. Thus, the retainer main body 340 can be prevented from moving in the width direction or in the front-rear direction in housing the retainer main body 340 in the retainer housing space S9, sliding the retainer main body 340 housed in the retainer housing space S9 in the top-bottom direction, or the like.

In the lower part of the top wall 341, a first restrictive protrusion 341*a* protruding downward is formed to be disposed inside the insertion hole 345. This first restrictive protrusion 341*a* restricts fall-off of the relay terminal 33 inserted into the first space S7 when sliding the retainer main body 340.

An extension protrusion 341*b* is provided integrally with a rear end of the first restrictive protrusion 341*a*. This extension protrusion 341*b* is formed to have its lower surface following the shape of the upper surface of the retaining piece 331*e*.

In the lower part of the top wall 341, a groove 345*a* opened rearward and downward is formed to communicate with the insertion hole 345. The tip of the projection 331*d* of the relay terminal 33 is inserted into this groove 345*a* in a state where the relay terminal 33 is inserted into the first space S7 (insertion completed state). The projection 331*d* of the relay terminal 33 guides sliding of the retainer main body 340 in the top-bottom direction. In this embodiment, the groove 345*a* is formed on one side (right side), in the width direction, of the insertion hole 345 in a state shown in FIG. 30C.

Furthermore, in this embodiment, a second restrictive protrusion 342*a* protruding downward is formed in the lower part of the bottom wall 342. This second restrictive protrusion 342*a* protrudes in the same direction as the first restrictive protrusion 341*a*, and restricts fall-off of the relay terminal 33 inserted into the second space S8 when sliding the retainer main body 340.

Figure 31A:
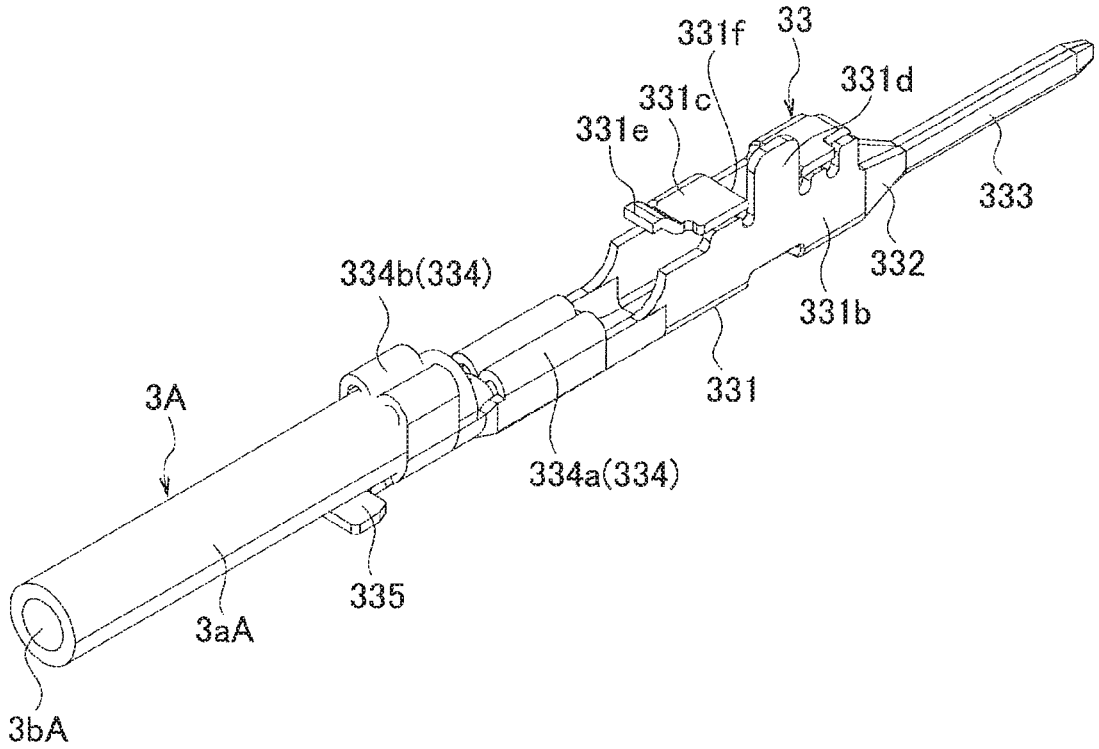
FIG. 31A and FIG. 31B are perspective view schematically showing the terminals included in the receptacle connector shown as another example, FIG. 31A showing a state viewed from the front side and FIG. 31B showing a state viewed from the rear side.
Figure 31B:
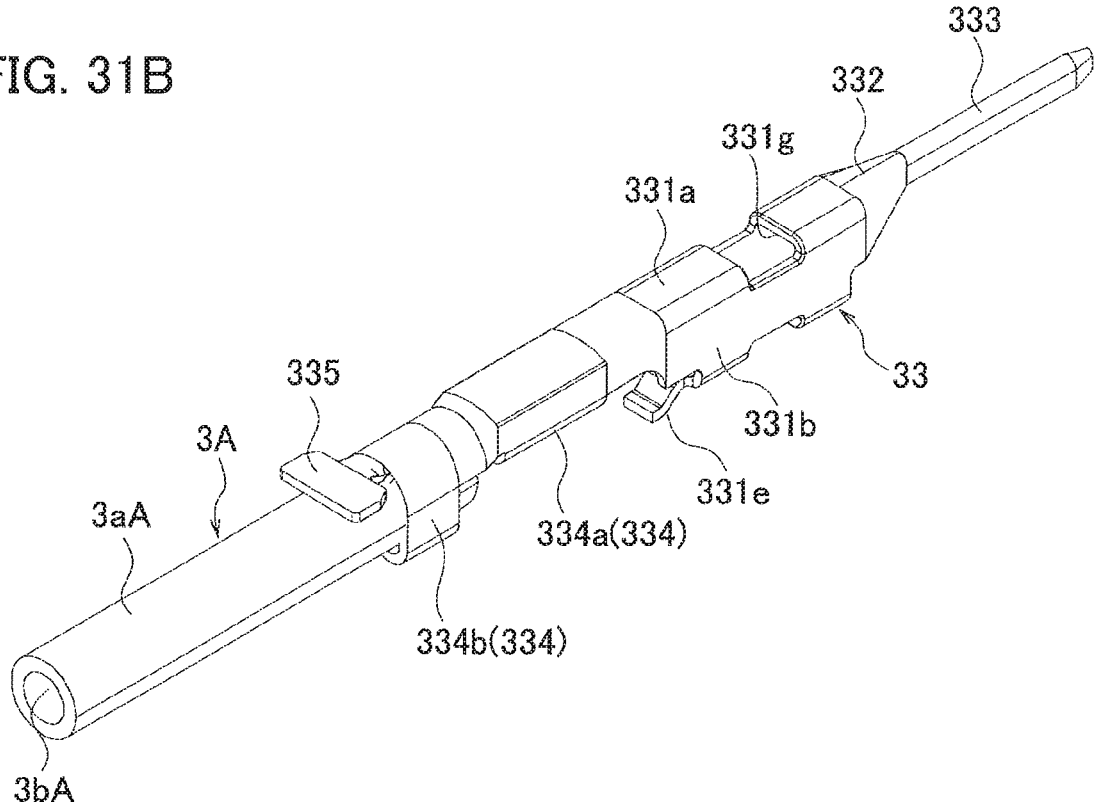

The relay terminals 33 are conductive, and two upper and lower relay terminal groups, each having a plurality of relay terminals arranged in the width direction (Y direction) of the receptacle housing 30, are held by the receptacle housing 30. As shown in FIG. 31, each of these relay terminals 33 has a shape formed by bending a strip-shaped metal member. Such a relay terminal 33 can be formed, for example, by bending a strip-shaped metal member.

The relay terminal 33 includes: a terminal main body part 331 having a peripheral wall extending in the front-rear direction (insertion direction of the relay terminal 33 into the space); and a contact part 333 provided continuously from the front side (one side), in the front-rear direction, of the terminal main body part 331. In this embodiment, the contact part 333 has an approximately rod shape and is coupled to the terminal main body part 331 through a connection part 332 formed to have its diameter reduced toward the front.

The relay terminal 33 includes an electric wire connector part 334 provided continuously from the rear side (the other side), in the front-rear direction, of the terminal main body part 331 and the electric wire 3A is connected to the electric wire connector part 334.

The electric wire 3A is flexible and includes a cover part 3*a*A formed of an insulating material and a conductor part 3*b*A covered with the cover part 3*a*A. The electric wire 3A has its conductor part 3*b*A exposed at its tip connected to the relay terminal 33.

The electric wire connector part 334 is electrically connected to the exposed conductor part 3*b*A to achieve conduction between the conductor part 3*b*A of the electric wire 3A and the relay terminal 33. The electric wire connector part 334 includes: a conductor caulking part 334*a* formed on the terminal main body part 331 side and fixed by caulking to the conductor part 3*b*A; and an electric wire caulking part 334*b* formed at a position further away from the terminal main body part 331 than the conductor caulking part 334*a* and fixed by caulking to the cover part 3*a*A.

The relay terminal 33 further includes a guide piece 335 formed at a position further away from the terminal main body part 331 than the electric wire caulking part 334*b* to guide insertion of the relay terminal 33 connected to the electric wire 3A into the space.

The terminal main body part 331 includes a bottom wall 331*a*, a pair of side walls 331*b* provided continuously from both ends, in the width direction, of the bottom wall 331*a*, and a top wall 331*c* provided continuously from the side walls 331*b* and covering over the bottom wall 331*a*.

In this embodiment, the bottom wall 331*a*, the pair of side walls 331*b*, 331*b*, and the top wall 331*c* correspond to the peripheral wall. The terminal main body part 331 has an approximately box shape with its approximately whole circumference surrounded by the peripheral wall.

The projection 331*d* protruding upward is formed on one of the side walls 331*b*. This projection 331*d* has its tip passing through the groove 321*a* and the groove 322*a* or housed in the groove 345*a* during insertion of the relay terminal 33 into the space.

The retaining piece 331*e* protruding rearward is formed at the rear end of the top wall 331*c*. This retaining piece 331*e* is formed so as to be elastically deformable in the top-bottom direction, and to have its rear end abut against the abutting piece 321*b* in a state where the relay terminal 33 is inserted into the first space S7 (insertion completed state). When the relay terminal 33 is inserted into the second space S8 (in the insertion completed state), the rear end abuts against the abutting piece 322*b*.

Figure 32A:
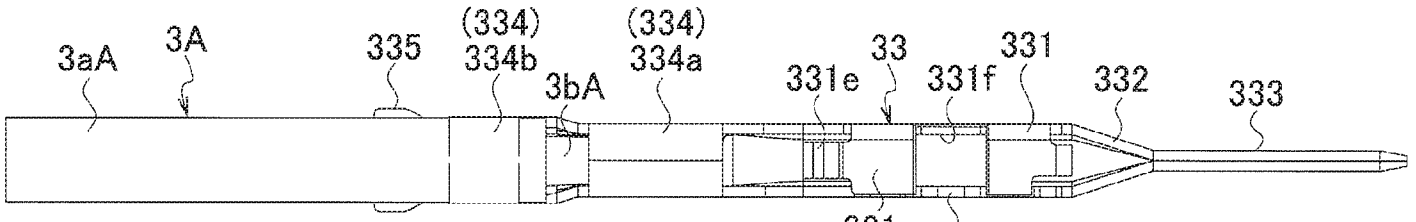
FIG. 32A is a plan view.
Figure 32B:
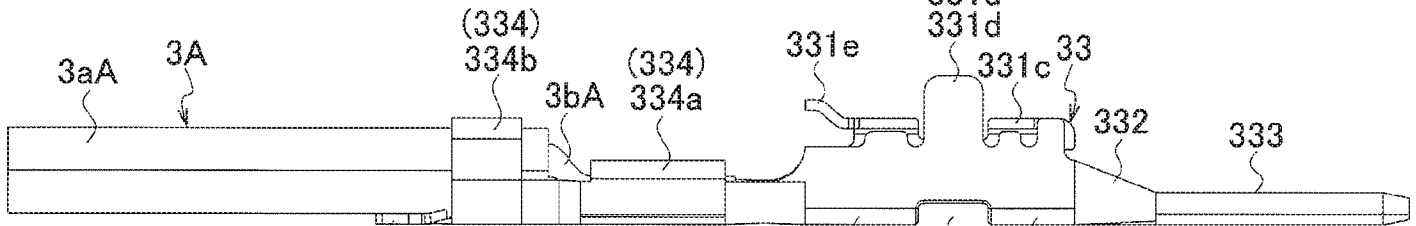
FIG. 32B is a side view.
Figure 32C:
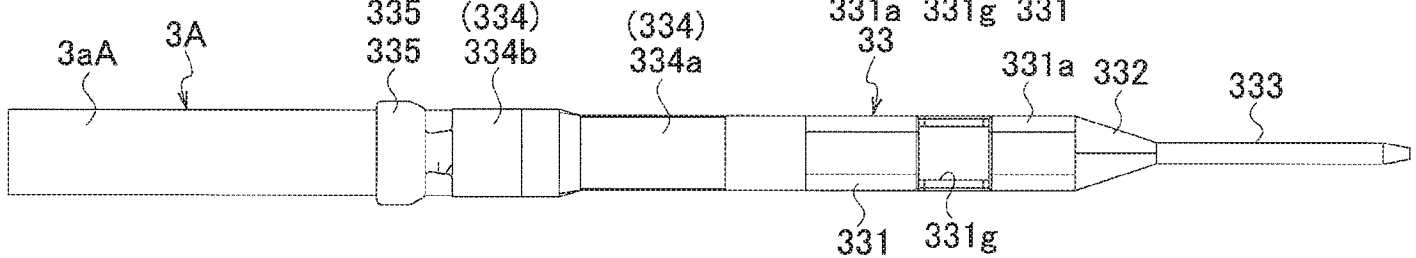
FIG. 32C is a rear side view.
Figure 32E:
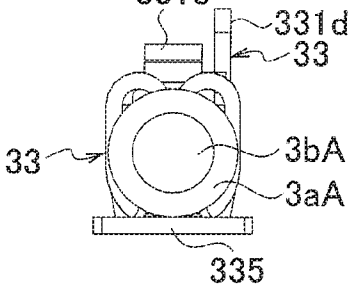
FIG. 32E is a back view showing the terminals included in the receptacle connector shown as another example.
Figure 32D:
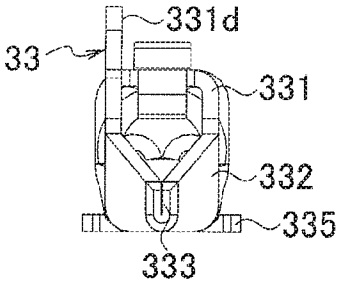
FIG. 32D is a front view.

Here, in this embodiment, the contact part 333 is formed at a position off the center of the electric wire 3A extending in the front-rear direction in a state viewed from the front side in the front-rear direction (state viewed along the insertion direction of the relay terminal 33 into the space) (see FIG. 32D).

Then, the relay terminal 33 to be inserted into the first space S7 is inserted into the first space S7 in a state where the contact part 333 is positioned on the lower side when the rear housing 32 is disposed such that the first space S7 is positioned above the second space S8.

On the other hand, the relay terminal 33 to be inserted into the second space S8 is inserted into the second space S8 in a state where the contact part 333 is positioned on the upper side when the rear housing 32 is disposed such that the first space S7 is positioned above the second space S8.

More specifically, the relay terminal 33 to be inserted into the second space S8 is inserted into the second space S8 in a state where the relay terminal 33 to be inserted into the first space S7 is inverted (turned 180 degrees) about the axial direction of the electric wire 3A. Furthermore, a distance (shortest distance), in the top-bottom direction, between the contact part 333 of the relay terminal 33 to be inserted into the first space S7 and the contact part 333 of the relay terminal 33 to be inserted into the second space S8 is set to be smaller than a distance (shortest distance), in the top-bottom direction, between the centers of the electric wires 3A.

Furthermore, in the peripheral wall of the terminal main body part 331, a first insertion hole 331*f* opened upward and a second insertion hole 331*g* opened downward are formed when the relay terminal 33 are inserted into the space as described above. In this embodiment, the first and second insertion holes 331*f* and 331*g* are formed so as to face each other in the top-bottom direction in the plan view. More specifically, the first and second insertion holes 331*f* and 331*g* are formed at the same position in the front-rear direction and in the width direction in the plan view.

Then, when the retainer main body 340 is slid downward (in one direction) in the top-bottom direction, the first restrictive protrusion 341*a* formed in the retainer main body 340 is inserted into either one of the first and second insertion holes 331*f* and 331*g* (first insertion hole 331*f*). Furthermore, the second restrictive protrusion 342*a* formed in the retainer main body 340 is inserted into the other (second insertion hole 331*g*).

Thus, just by sliding one retainer 34 toward one side (downward), fall-off of the relay terminal 33 inserted into the first space S7 and fall-off of the relay terminal 33 inserted into the second space S8 can be prevented at the same time by the retainer 34.

Moreover, just by sliding one retainer 34 toward the other side (upward), the restriction of fall-off of the relay terminal 33 inserted into the first space S7 and the restriction of fall-off of the relay terminal 33 inserted into the second space S8 can be released at the same time.

Note that, in a state where the relay terminal 33 is inserted into the respective spaces (first space S7 and second space S8), the contact part 333 is disposed inside the fitting space S6.

Next, description is given of an example of a method for assembling the receptacle connector 3. Note that the method for assembling the receptacle connector 3 is not limited to the following method.

Figure 33:
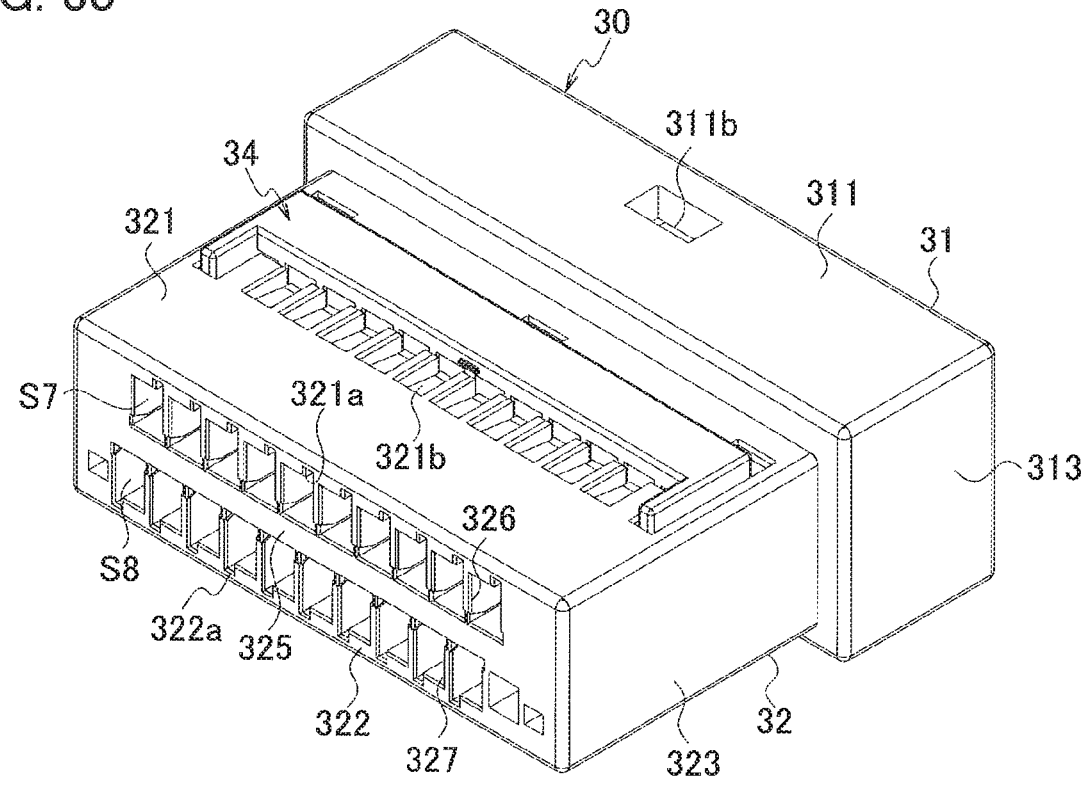
FIG. 33 is a perspective view showing a state where the retainer is attached to the receptacle housing of the receptacle connector shown as another example so as to partially protrude therefrom.

First, as shown in FIG. 33, the retainer 34 is attached to the rear housing 32 so as to have its upper part protrude above the top wall 321. In this event, the retainer main body 340 is housed in the retainer housing space S9 in a state where the insertion holes 345 communicate with the first spaces S7, respectively.

Also, the electric wires 3A are connected to the plurality of relay terminals 33 to be inserted into the spaces in the rear housing 32 (see FIG. 31 and FIG. 32).

Note that either one of the attachment of the retainer main body 340 to the rear housing 32 and the connection of the electric wires 3A to the plurality of relay terminals 33 may be performed before the other, or the both may be performed at the same time.

Figure 34:
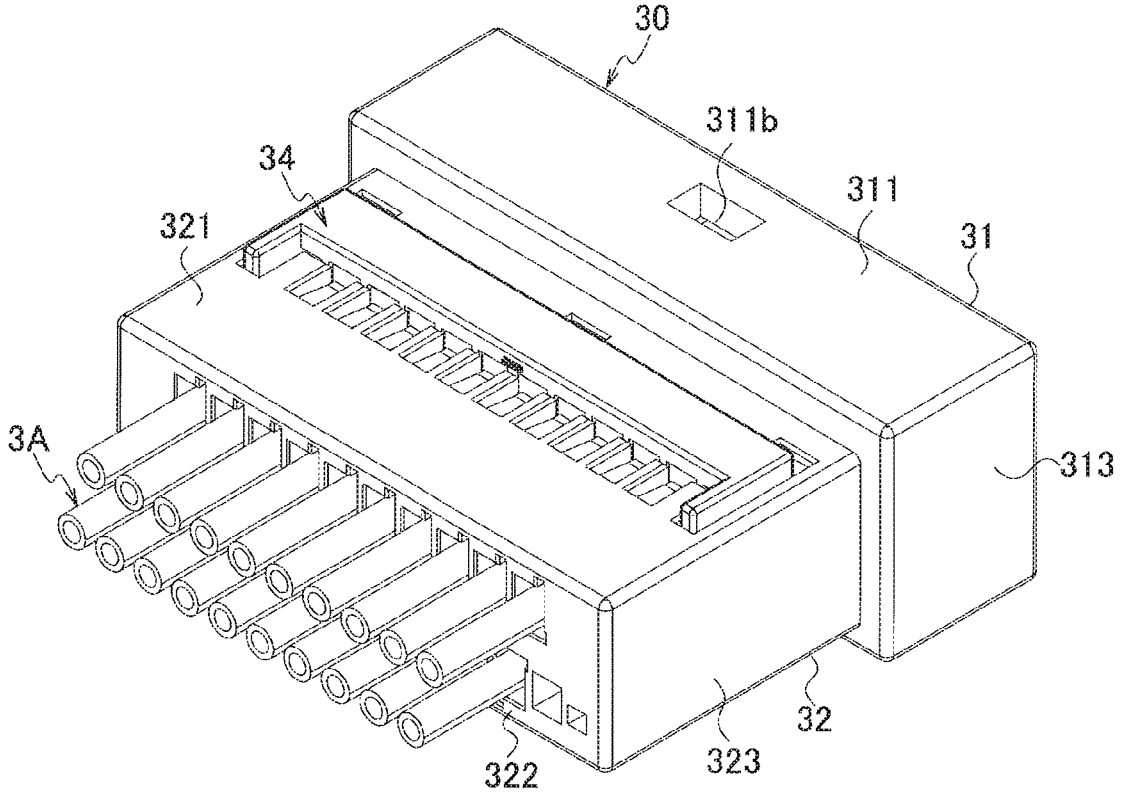
FIG. 34 is a perspective view showing a state where the terminals are inserted into the receptacle housing in the state of FIG. 33.
Figure 35:
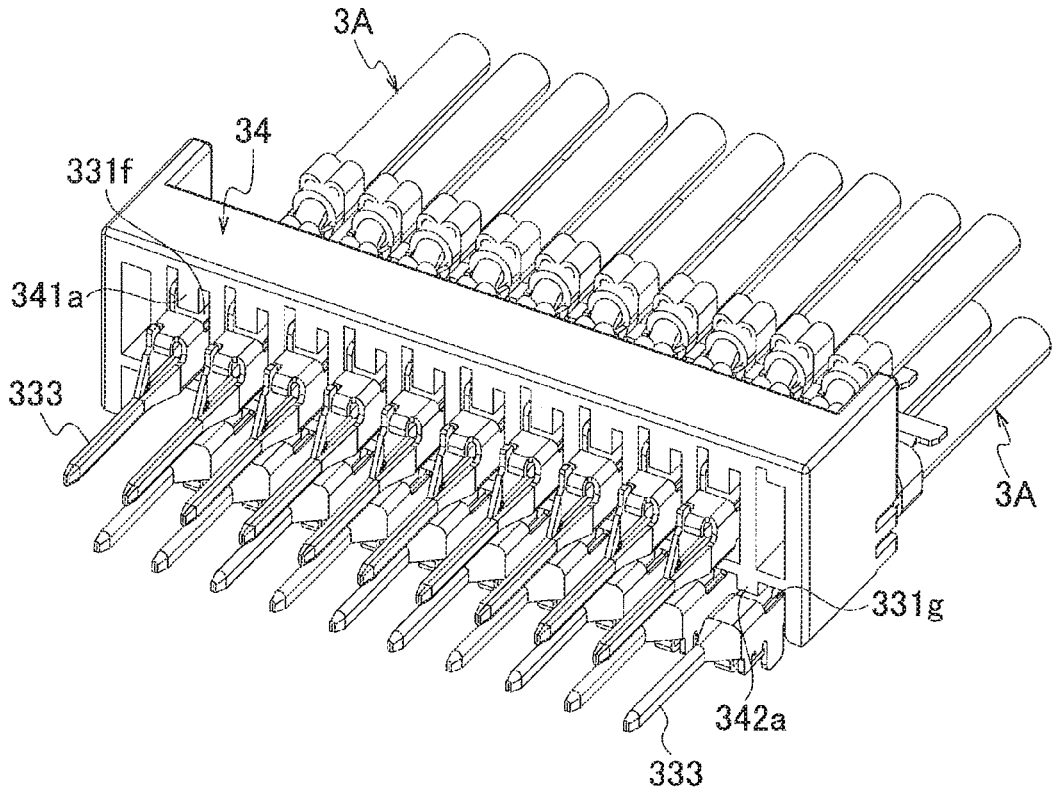
FIG. 35 is a perspective view showing a relationship between the retainer and the terminals in the state shown in FIG. 34.

Next, as shown in FIG. 34, the relay terminals 33 having the electric wires 3A connected thereto are inserted into the spaces in the rear housing 32. In this event, the relay terminals 33 are inserted into the second spaces S8 in a state where the relay terminals 33 to be inserted into the first spaces S7 are inverted (turned 180 degrees) about the axial direction of the electric wires 3A. Furthermore, a distance (shortest distance), in the top-bottom direction, between the contact part 333 of the relay terminal 33 to be inserted into the first space S7 and the contact part 333 of the relay terminal 33 to be inserted into the second space S8 is set to be smaller than a distance (shortest distance), in the top-bottom direction, between the centers of the electric wires 3A.

Then, the first insertion holes 331*f* face the first restrictive protrusions 341*a* in a state where the relay terminals 33 are inserted into the first space S7 (insertion completed state), and the second insertion holes 331*g* face the second restrictive protrusions 342*a* in a state where the relay terminals 33 are inserted into the second space S8 (insertion completed state).

Next, the retainer 34 is housed in the retainer housing space S9 by sliding the retainer main body 340 downward. Thus, the first restrictive protrusions 341*a* formed in the retainer main body 340 are inserted into the first insertion holes 331*f*, and the second restrictive protrusions 342*a* are inserted into the second insertion holes 331*g*.

Figure 36:
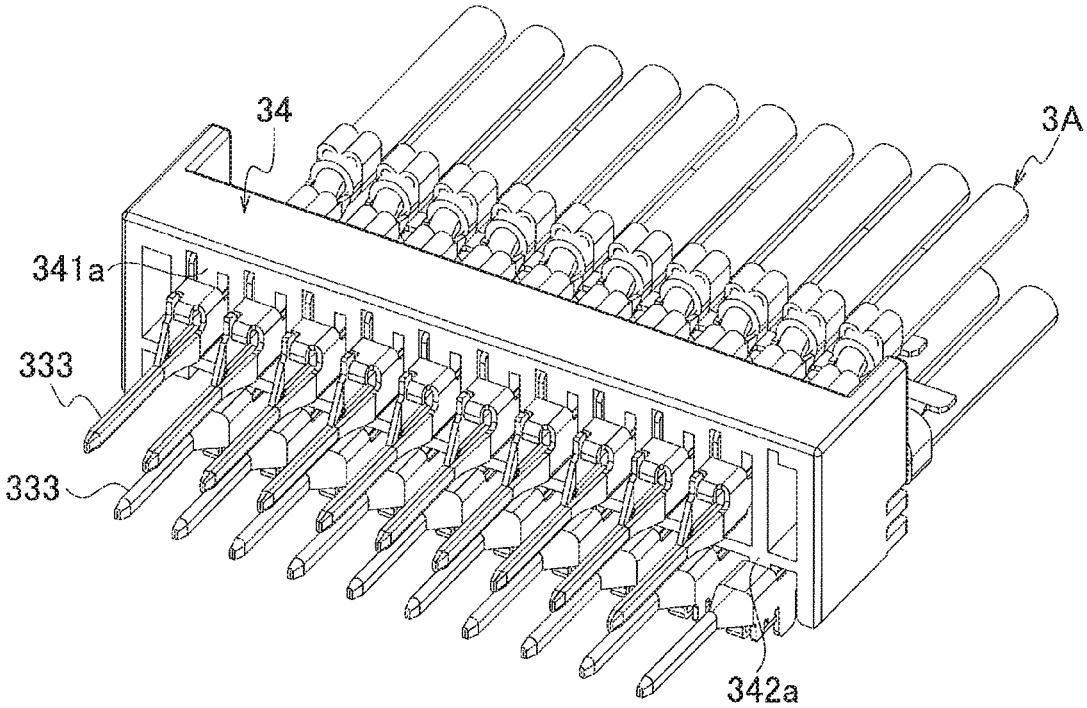
FIG. 36 is a perspective view showing a relationship between the retainer and the terminals in a state where the retainer is housed in the receptacle housing.
Figure 37:
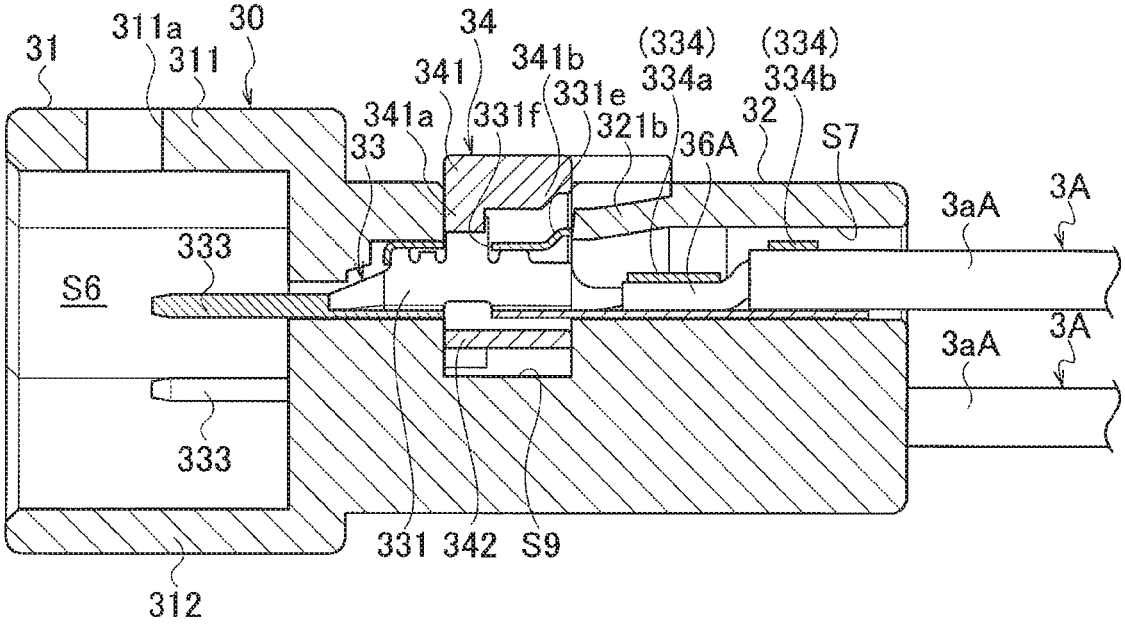
FIG. 37 is a sectional side view showing a relationship between the retainer and the upper terminal in the state shown in FIG. 34.
Figure 38:
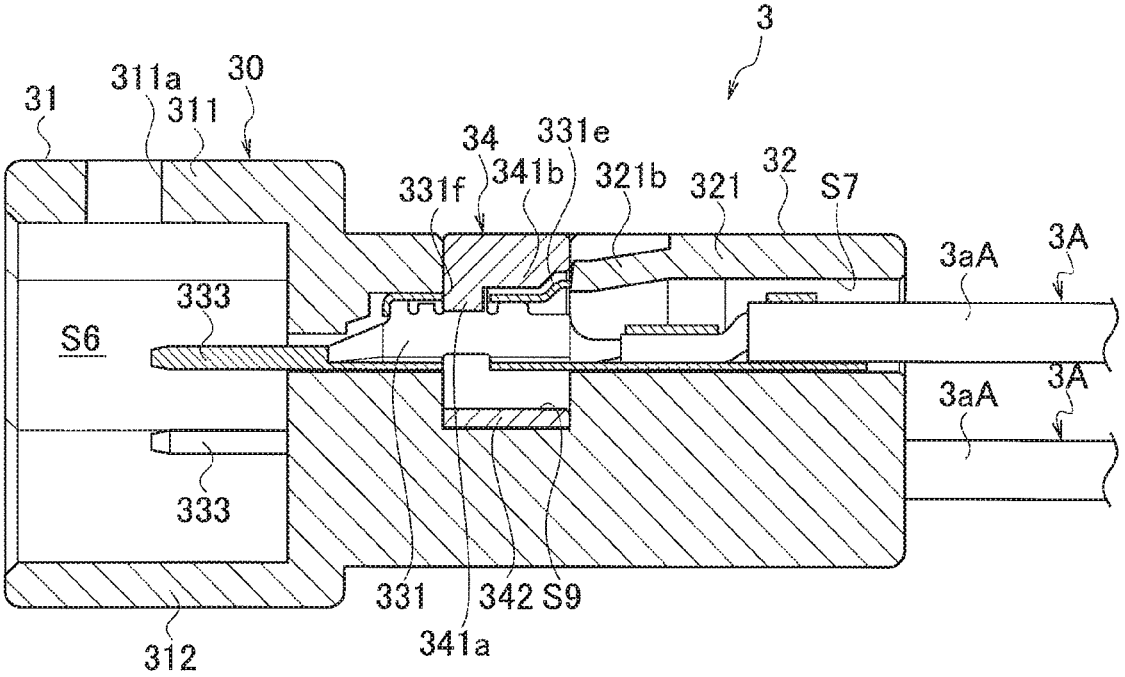
FIG. 38 is a sectional side view showing a relationship between the retainer and the upper terminal in the state where the retainer is housed in the receptacle housing.
Figure 39:
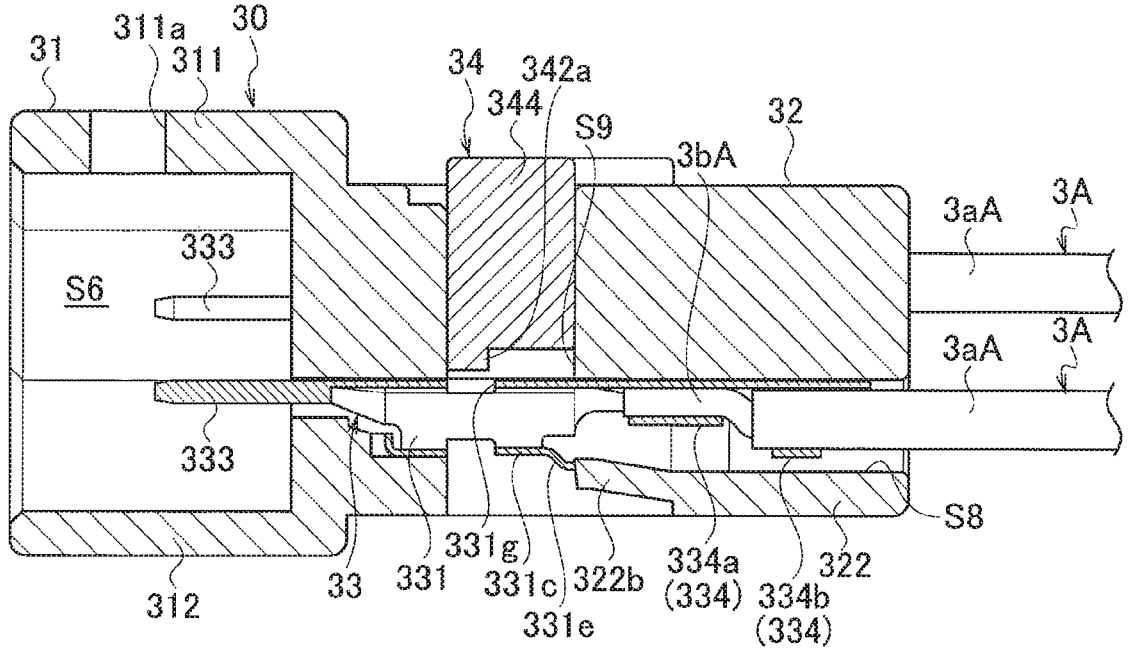
FIG. 39 is a sectional side view showing a relationship between the retainer and the lower terminal in the state shown in FIG. 34.
Figure 40:
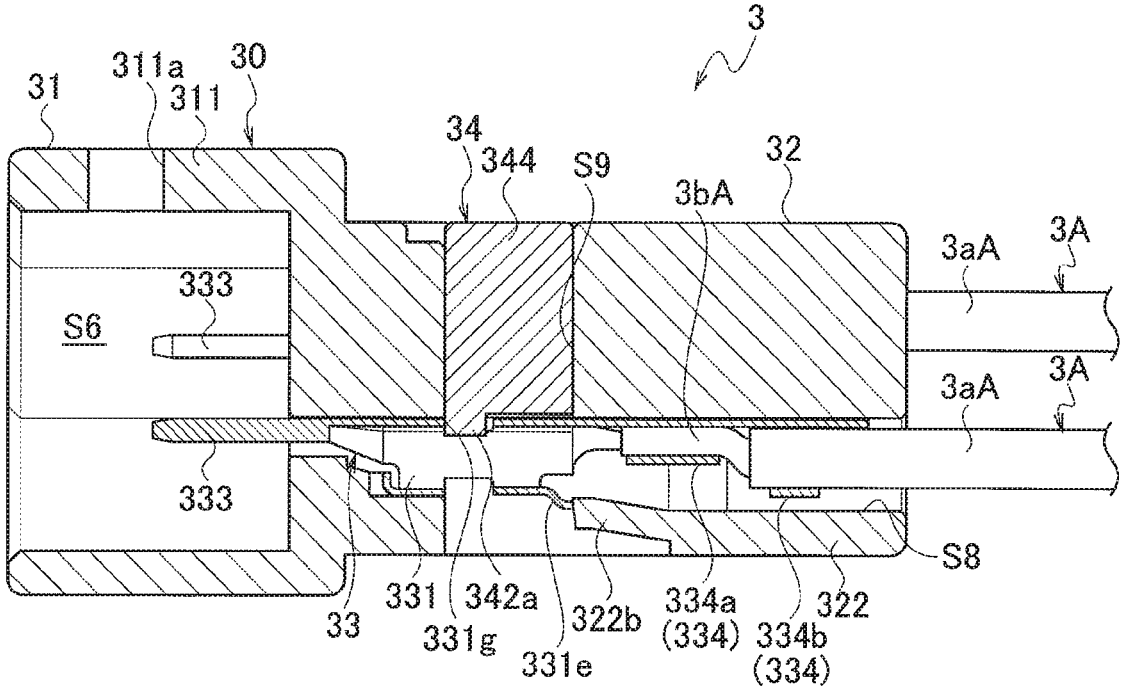
FIG. 40 is a sectional side view showing a relationship between the retainer and the lower terminal in the state where the retainer is housed in the receptacle housing.

Accordingly, the receptacle connector 3 is formed in a state where fall-off of the relay terminals 33 inserted into the first spaces S7 and fall-off of the relay terminals 33 inserted into the second spaces S8 are restricted at the same time by the retainer 34 (see FIGS. 36, 38, and 40).

By fitting the plug connector 1 described above into the receptacle connector 3 thus configured, the lock part 12 of the plug housing 10 is inserted into the center part, in the width direction, of the top wall 311 of the receptacle housing 30. Then, the housing main body 11 is inserted into the fitting space S6 of the front housing 31.

To be more specific, the engagement protrusion 121*b* of the lever part 121 is pushed downward by the top wall 311 of the front housing 31. When the engagement protrusion 121*b* is thus pushed downward by the top wall 311, the rear end part (operation part 121*a*) of the lever part 121 is elastically deformed so as to be moved downward, thus allowing the engagement protrusion 121*b* to be moved to the inner side of the fitting space S6.

Then, when the engagement protrusion 121*b* is moved to the inner side of the fitting space S6, the downward pushing of the engagement protrusion 121*b* by the top wall 311 is released, and the elastic restoring force of the lever part 121 moves the engagement protrusion 121*b* upward. The engagement protrusion 121*b* is moved upward to be engaged with the engaged part 311*b* formed in the receptacle connector 3, thus allowing the plug connector 1 and the receptacle connector 3 to be locked in the fitted state.

During the course of fitting the plug connector 1 into the receptacle connector 3, the tip of the contact part 333 of the relay terminal 33 inserted into the second space S8 is introduced into the first space S1 formed in the plug housing 10 from the introduction port S1*b* to come into contact with the contact part 130*a* of the first plug terminal 13. Note that, in this embodiment, the approximately rod-shaped contact part 333 is inserted between the pair of contact pieces 138, 138 and sandwiched by the pair of contact pieces 138, 138 to achieve conduction between the first plug terminal 13 and the relay terminal 33.

Likewise, the tip of the contact part 333 of the relay terminal 33 inserted into the first space S7 is introduced into the second space S2 formed in the plug housing 10 from the introduction port S2*b* to come into contact with the contact part 140*a* of the second plug terminal 14. Note that, in this embodiment, the approximately rod-shaped contact part 333 is inserted between the pair of contact pieces 148, 148 and sandwiched by the pair of contact pieces 148, 148 to achieve conduction between the second plug terminal 14 and the relay terminal 33.

As described above, the plug connector 1 and the receptacle connector 3 are fitted together to achieve conduction between the terminals 13 and 14 and the relay terminals 33. Thus, the connector set C2 is formed to electrically connect the cable 1A to the electric wires 3A.

Meanwhile, in order to detach the plug connector 1 from the receptacle connector 3, the operation part 121*a* of the lever part 121 is first lowered to move the lever part 121 downward. Accordingly, the engagement protrusion 121*b* is also moved downward to release the engagement between the engagement protrusion 121*b* and the engaged part 311*b*. Then, by pulling the plug connector 1 in a removal direction from the receptacle connector 3 in the state where the engagement between the engagement protrusion 121*b* and the engaged part 311*b* is released, the plug connector 1 is moved in the removal direction relative to the receptacle connector 3.

When the plug connector 1 is thus moved in the removal direction relative to the receptacle connector 3, the conduction between the terminals is first released, and then the fitting between the housings is released. Thus, the plug connector 1 is detached from the receptacle connector 3.

As described above, the plug connector (connector) 1 according to this embodiment includes the plug housing (housing) 10 and the plug terminals (terminals) held by the plug housing 10 and to be mounted on the cable (mounting member) 1A disposed outside the plug housing 10.

The plug terminals each include: the main body part to be inserted into the spaces S1 and S2 formed in the plug housing 10; the leg part extending from the main body part toward the mounting surface 1*a*A of the cable 1A in a state where the plug terminals are mounted on the cable (the mounting member) 1A; and the mounting piece (mounting part) provided continuously from the leg part and to be mounted on the cable 1A.

The plug connector 1 further includes the leg part holder connected to the plug housing 10 to hold the leg part.

Accordingly, during insertion of the plug terminals into the spaces S1 and S2 formed in the plug housing 10, the leg parts of the plug terminals can be held by the leg part holders formed in the plug housing 10. As a result, deformation of the leg parts of the plug terminals can be suppressed to ensure secure mounting of the plug terminals on the cable (mounting member) 1A.

Note that, when the leg parts of the plug terminals are deformed during insertion of the plug terminals into the spaces S1 and S2 formed in the plug housing 10, the provision of the leg part holders causes the leg parts not to be held by the leg part holders or causes the main body part not to be inserted to the insertion completed position. Therefore, insertion failure of the plug terminals can be easily checked to ensure, also from this perspective, secure mounting of the plug terminals on the cable (mounting member) 1A.

Moreover, in this embodiment, the leg parts are formed into the plate shape. In a state where the main body part is inserted into the space and the mounting part is mounted on the cable 1A, the plate thickness direction of the leg part corresponds to the direction (Y direction) intersecting with the insertion direction (X direction) of the main body part into the space and the direction (Z direction) normal to the mounting surface 1*a*A. Therefore, even when the plug terminals having the leg parts likely to be deformed in the plate thickness direction are inserted into the spaces, the leg part holders can ensure secure mounting of the plug terminals on the cable (mounting member) 1A.

Furthermore, in this embodiment, the plug housing 10 has the receiving part (recess part 112*c*) to receive the cable (mounting member) 1A in the wall (bottom wall 112) on one side in the housing thickness direction (top-bottom direction). The leg part extends in the housing thickness direction from the main body part.

Thus, an increase in height of the plug connector 1 when mounted on the cable (mounting member) 1A can be suppressed. Also, an extension distance of the leg part can be reduced.

Moreover, in this embodiment, the leg part holders are formed integrally with the plug housing 10. Thus, an increase in the number of parts can be suppressed. Also, the leg part holders can be prevented from falling off the plug housing 10, such as when provided as separate members. Thus, deformation of the leg parts can be more surely suppressed.

In this embodiment, the spaces include the first space S formed in the plug housing 10 and the second space S2 formed at the position further away from the mounting surface 1*a*A than the first space S1 in the plug housing 10 in a state where the main body part is inserted into the space and the mounting part is mounted on the cable (the mounting member) 1A. The plug terminals include the first plug terminal (first terminal) 13 and the second plug terminal (second terminal) 14. The first plug terminal 13 includes: the first main body part 130 to be inserted into the first space S1; the first leg part 131 extending from the first main body part 130 toward the mounting surface 1*a*A in a state where the first plug terminal 13 is mounted on the cable (the mounting member) 1A; and the first mounting part 132 provided continuously from the first leg part 131 and to be mounted on the cable 1A.

Likewise, the second plug terminal 14 includes: the second main body part 140 to be inserted into the second space S2; the second leg part 141 extending from the second main body part 140 toward the mounting surface 1*a*A in a state where the second plug terminal 14 is mounted on the cable (the mounting member) 1A; and the second mounting part 142 provided continuously from the second leg part 141 and to be mounted on the cable 1A.

At least one of the first and second leg parts 131 and 141 is held by the leg part holder.

Thus, deformation of any one of the leg parts of the first and second plug terminals 13 and 14 can be suppressed to ensure secure mounting of the plug terminals on the cable (mounting member) 1A. Particularly, deformation of the leg parts can be more effectively suppressed if the second leg part 141 of the relatively longer second plug terminal 14 is held by the leg part holder 119. Furthermore, deformation of the leg parts can be more surely suppressed if both of the leg parts 131 and 141 of the first and second plug terminals 13 and 14 are held by the leg part holders 118 and 119.

Moreover, in this embodiment, the first and second spaces S1 and S2 overlap with each other when the plug housing 10 is viewed along the direction (Z direction) normal to the mounting surface 1*a*A in a state where the plug terminals are held by the plug housing 10 and mounted on the cable 1A.

Thus, the plug connector 1 can be reduced in size in the width direction.

Moreover, in this embodiment, the first insertion opening S a of the first space S1 is divided into the two regions R1 and R2 by the second leg part 141 when the plug housing 10 is viewed along the insertion direction (X direction) of the main body parts 130 and 140 into the spaces S1 and S2 in a state where the main body parts 130 and 140 are inserted into the spaces S1 and S2.

The second leg part 141 is held by the leg part holders 119 (the grooves 112*d* and 115*b*) at two spots across the first insertion opening S1*a*.

Thus, deformation of the second leg part 141 can be more surely suppressed while reducing the size of the plug connector 1 in the width direction.

Moreover, in this embodiment, the first mounting part 132 is provided continuously from the first leg part 131 so as to protrude toward one side in the insertion direction (X direction) of the main body parts 130 and 140 into the spaces S1 and S2. Also, the second mounting part 142 is provided continuously from the second leg part 141 so as to protrude toward the other side in the insertion direction (X direction) of the main body parts 130 and 140 into the spaces S1 and S2.

Thus, the positions of the first and second mounting parts 132 and 142 are prevented from getting away from the plug housing 10. As a result, deformation of the leg parts 131 and 141 can be more surely suppressed.

Moreover, in this embodiment, either one of the first and second mounting parts 132 and 142 overlaps with the plug housing 10 when the plug housing 10 is viewed along the direction (Z direction) normal to the mounting surface 1*a*A in a state where the plug terminals 13 and 14 are held by the plug housing 10 and mounted on the cable 1A.

Thus, the positions of the first and second mounting parts 132 and 142 are prevented from getting away from the plug housing 10. As a result, deformation of the leg parts 131 and 141 can be more surely suppressed.

Moreover, in this embodiment, a plurality of plug terminals 13 and 14 are provided, and the mounting parts 132 and 142 are arranged in a staggered pattern in a state where the plurality of plug terminals 13 and 14 are held by the plug housing 10. Thus, the plug connector 1 can be reduced in size in the width direction while securing an insulation distance.

Although Patent Literature 1 discloses that the terminal is inserted into the space formed in the housing, it is preferable that the terminal be more easily inserted into the space formed in the housing.

Therefore, the plug connector (connector) 1 according to this embodiment includes the plug housing (housing) 10 and the plug terminal (terminal) 13, 14 held by the plug housing 10 and to be mounted on the cable (mounting member) 1A.

The plug terminal 13, 14 includes: the main body part 130, 140 to be inserted into the space S1, S2 formed in the plug housing 10; and the mounting piece (mounting part) 132, 142 provided continuously from the main body part 130, 140 and to be mounted on the cable 1A. The main body part 130, 140 includes the bottom wall 133, 143 and the side walls 134, 144 provided continuously from the bottom wall 133, 143.

In the space S1, S2, the grooves 111*c*, 115*a* are formed to guide insertion of the main body part 130, 140 into the space S1, S2 while the tips of the side walls 134, 144 are inserted into the grooves. The space S1, S2 includes: the insertion opening S1*a*, S2*a* opened toward the outside of the plug housing 10; and the insertion main cavity S1*c*, S2*c* which communicates with the insertion opening S1*a*, S2*a* and in which to house the main body part 130, 140 of the plug terminal 13, 14. The grooves 111*c*, 115*a* are formed in the insertion main cavity S1*c*, S2*c*.

This structure is capable of guiding the insertion of the main body part 130, 140 into the space S1, S2 on the inner side beyond the insertion opening S1*a*, S2*a* (front side) in the insertion direction.

Moreover, the length of the grooves 111*c*, 115*a* in the insertion direction (X direction) is not shorter than the distance by which the main body part 130, 140 moves between the start and end of insertion of the tip of the side wall 134, 144.

Thus, a positional shift in the plug terminal 13, 14 can be suppressed when the plug terminal 13, 14 is press-fitted (inserted) into the space S1, S2.

The grooves 111*c*, 115*a* extend beyond the center of the space S1, S2 to the inner side of the space S1, S2 in the insertion direction. Thus, the main body part 130, 140 can be guided to near the insertion end position.

Furthermore, the insertion opening S1*a*, S2*a* also has the second groove 111*d*, 115*c* formed therein to guide insertion of the main body part 130, 140 into the space S1, S2. The second groove 111*d*, 115*c* communicates with the groove 111*c*, 115*a*. Thus, the main body part 130, 140 can be guided to near the insertion end position from the insertion start position.

As described above, according to this embodiment, the plug terminal 13, 14 can be press-fitted (inserted) more smoothly and more accurately to the press-fit (insertion) end position in the space S1, S2.

Moreover, in this embodiment, the side walls 134, 144 are provided continuously from the both ends, in the width direction (Y direction), of the bottom wall 133, 143, and one of the side walls 134, 144 has the extension wall 139, 149 formed therein, which protrudes rearward, more than the other side wall 134, 144, in the insertion direction (X direction) of the main body part 130, 140 into the space S1, S2.

When the plug terminal 13, 14 with a long one side wall 134, 144 is press-fitted (inserted) into the space S1, S2, the one side wall 134, 144 protruding rearward of the main body part 130, 140 is generally pushed. The use of such a plug terminal 13, 14 is likely to cause a positional shift during press-fitting (insertion) into the space S1, S2.

However, by forming the grooves 111*c*, 115*a* in the space S1, S2 to guide the insertion of the main body part 130, 140 into the space S1, S2, the plug terminal 13, 14 can be more smoothly and more accurately press-fitted (inserted) into the space S1, S2 even when the plug terminal 13, 14 with a long one side wall 134, 144 is used.

Thus, according to this embodiment, a positional shift in the plug terminal 13, 14 is suppressed even when the one side wall 134, 144 protruding rearward of the main body part 130, 140 is pushed. As a result, the plug terminal 13, 14 can be more smoothly and more accurately press-fitted (inserted) into the space S1, S2.

The plug terminal (connector terminal) 13, 14 according to this embodiment includes: the main body part 130, 140 to be inserted into the space S1, S2 formed in the plug housing (housing) 10; and the mounting piece (mounting part) 132, 142 provided continuously from the main body part 130, 140 and to be mounted on the cable (mounting member) 1A.

The main body part 130, 140 includes the bottom wall 133, 143 and the pair of side walls 134, 144 provided continuously from the both ends of the bottom wall 133, 143 in the width direction.

One of the side walls 134, 144 has the extension wall 139, 149 formed therein, which protrudes, more than the other side wall 134, 144, in the insertion direction (X direction) of the main body part 130, 140 into the space S1, S2.

As described above, by inserting the plug terminal (connector terminal) 13, 14 having the side walls 134, 144 different in length into the space S1, S2 formed in the plug housing (housing) 10, friction force acting on the plug terminal 13, 14 during insertion into the space S1, S2 can be reduced at least on the side of the shorter side wall 134, 144. Thus, the plug terminal 13, 14 can be more easily press-fitted (inserted) into the space S1, S2.

The receptacle connector (connector) 3 according to this embodiment includes: a plurality of relay terminals (terminals) 33 to which the electric wire 3A is connected respectively; and the receptacle housing (housing) 30 having a plurality of spaces formed therein to insert the relay terminal 33 respectively. The receptacle connector 3 also includes the retainer 34 attached to the receptacle housing 30 to restrict fall-off of the relay terminals 33 from the receptacle housing 30.

The relay terminal 33 includes the terminal main body part 331 having the peripheral wall extending in the insertion direction (X direction) of the relay terminal 33 into the space. The relay terminal 33 also includes: the contact part 333 provided continuously from one side, in the insertion direction, of the terminal main body part 331; and the electric wire connector part 334 provided continuously from the other side, in the insertion direction, of the terminal main body part 331 and connected to the electric wire 3A.

Here, the contact part 333 is formed at a position off the center of the electric wire 3A extending in the insertion direction in a state viewed along the insertion direction (X direction). Moreover, the space includes the first space S7 and the second space S8, which are formed on the upper and lower sides of the receptacle housing 30 disposed such that the insertion direction (X direction) corresponds to the horizontal direction.

Then, the relay terminal 33 to be inserted into the first space S7 is inserted into the first space S7 in a state where the contact part 333 is positioned on the lower side when the receptacle housing 30 is disposed such that the first space S7 is positioned above the second space S8. On the other hand, the relay terminal 33 to be inserted into the second space S8 is inserted into the second space S8 in a state where the contact part 333 is positioned on the upper side when the receptacle housing 30 is disposed such that the first space S7 is positioned above the second space S8.

Furthermore, when the relay terminal 33 is disposed such that the insertion direction (X direction) corresponds to the horizontal direction and the contact part 333 is positioned on the lower side, the first insertion hole 331*f* opened upward and the second insertion hole 331*g* opened downward are formed in the peripheral wall of the relay terminal 33.

Moreover, the retainer 34 includes the retainer main body 340 attached to the receptacle housing 30 so as to be slidable in the top-bottom direction when the receptacle housing 30 is disposed such that the first space S7 is positioned above the second space S8.

The first restrictive protrusion 341*a* to restrict fall-off of the relay terminal 33 inserted into the first space S7 and the second restrictive protrusion 342*a* to restrict fall-off of the relay terminal 33 inserted into the second space S8, when the retainer main body 340 is slid downward (to one side in the top-bottom direction), are formed in the retainer main body 340.

When the retainer main body 340 is slid downward, the first restrictive protrusion 341*a* is inserted into the first insertion hole 331*f* of the relay terminal 33 inserted into the first space S7. Meanwhile, the second restrictive protrusion 342*a* of the retainer main body 340 is inserted into the second insertion hole 331*g* of the relay terminal 33 inserted into the second space S8.

As described above, the receptacle housing 30 can be reduced in size in the width direction by inserting the plurality of relay terminals 33 into the spaces formed in the two upper and lower stags in the receptacle housing 30.

Moreover, the plurality of relay terminals 33 are inserted into the upper and lower parts of the receptacle housing 30 in a state where the distance, in the top-bottom direction, between the contact parts 333 is reduced (inverted state). Thus, an increase in height of the receptacle housing 30 reduced in size in the width direction can be suppressed.

With the above configuration of the receptacle connector 3 according to this embodiment, the receptacle connector 3 can be reduced in size.

Furthermore, in this embodiment, the first and second insertion holes 331*f* and 331*g* formed in the relay terminals 33 allows fall-off of the relay terminals 33 inserted into the upper and lower sides to be prevented just by sliding one retainer 34. As a result, the configuration of the receptacle connector 3 can be simplified.

Thus, according to this embodiment, the receptacle connector 3 with a simpler configuration can be obtained while reducing the size thereof.

Moreover, in this embodiment, the first and second spaces S7 and S8 are formed in a staggered pattern when the receptacle housing 30 is viewed along the insertion direction (X direction).

In this way, the contact parts 333 of the relay terminals 33 inserted into the first and second spaces S7 and S8 are also formed in a staggered pattern. Thus, the distance in the height direction can be reduced while securing the insulation distance between the contact parts 333. As a result, the receptacle connector 3 can be further reduced in size.

Although the preferred embodiment of the present disclosure has been described above, the present disclosure is not limited to the above embodiment and modified examples thereof but various changes can be made thereto.

For example, a connector can be formed by appropriately combining the configurations described in the above embodiment.

Moreover, although the description has been given of the one having the plurality of terminals arranged in the two upper and lower stages in the above embodiment, a connector having a plurality of terminals arranged only in one stage or a connector having a plurality of terminals arranged in three or more stages can also be realized.

Moreover, although the description has been given of the connector in which the terminals arranged in the same stage have the same shape, a connector in which a plurality of kinds of terminals are arranged in the same stage can also be realized.

Moreover, the receptacle connector 2 described in the above embodiment also has the leg part holders formed therein. Therefore, it is also possible to realize the receptacle connector 2 as the connector of the present disclosure and the plug connector 1 as the opposing connector.

Moreover, the present disclosure may be applied to a connector (plug connector or receptacle connector) to electrically connect between circuit boards or between cables. Furthermore, the present disclosure may be applied to a connector (plug connector or receptacle connector) to electrically connect electric wires to circuit boards.

Moreover, although the description has been given of the receptacle connector having one retainer restricting fall-off of the relay terminals 33 arranged in two stages in the above embodiment, two or more retainers may be used to restrict the fall-off of the relay terminals 33. More specifically, a connector may be realized using relay terminals with no second insertion holes 331*g* formed in the peripheral wall of the terminal main body part 331.

Moreover, although the description has been given of the receptacle connector into which the plug connector mounted on the cable is fitted, a receptacle connector into which a plug connector mounted on a circuit board is fitted may be realized.

Moreover, the plug connector may also be configured to use one retainer to restrict fall-off of relay terminals arranged in two stages.

Moreover, the specifications (shape, size, layout, and the like) of the housing, the terminals, and the other details may also be changed as needed.

The invention claimed is:

1. A connector, comprising:

a housing;

a terminal held in the housing and to be mounted on a mounting member disposed outside the housing, wherein the terminal includes a main body part extending along a first direction and inserted into a space formed in the housing, a leg part extending along a second direction different from the first direction, and a mounting part provided continuously from the leg part and to be mounted on the mounting member and a groove formed in a wall of the space, wherein the leg part is held by the groove when the main body part is inserted into the space.

2. The connector according to claim 1, wherein the leg part is formed into a plate shape, and in a state where the main body part is inserted into the space and the mounting part is mounted on the mounting member, a plate thickness direction of the leg part corresponds to a direction intersecting with an insertion direction of the main body part into the space and with a direction normal to the mounting surface.

3. The connector according to claim 1, wherein
the housing has a receiving part to receive the mounting member in a wall on one side in a housing thickness direction, and
the leg part extends in the housing thickness direction from the main body part.

4. The connector according to claim 1, wherein
the groove is integrally formed with the housing.

5. The connector according to claim 1, wherein
the space includes
a first space formed in the housing and
a second space formed at a position further away from the mounting surface than the first space in the housing in a state where the main body part is inserted into the space and the mounting part is mounted on the mounting member,
the terminal includes
a first terminal having a first main body part inserted into the first space, a first leg part extending from the first main body part toward the mounting surface in a state where the terminal is mounted on the mounting member, and a first mounting part provided continuously from the first leg part and to be mounted on the mounting member, and
a second terminal having a second main body part inserted into the second space, a second leg part extending from the second main body part toward the mounting surface in a state where the terminal is mounted on the mounting member, and a second mounting part provided continuously from the second leg part and to be mounted on the mounting member, and
at least either one of the first and second leg parts is held by the leg part holder groove.

6. The connector according to claim 5, wherein
the first space and the second space overlap with each other when the housing is viewed along the direction normal to the mounting surface in a state where the terminal is held by the housing and mounted on the mounting member.

7. The connector according to claim 6, wherein
a first insertion opening of the first space is divided into two regions by the second leg part when the housing is viewed along the insertion direction of the main body part into the space in a state where the main body part is inserted into the space, and
the second leg part is held by the leg part holder at two spots across the first insertion opening.

8. The connector according to claim 5, wherein
the first mounting part is provided continuously from the first leg part so as to protrude toward one side in the insertion direction of the main body part into the space, and
the second mounting part is provided continuously from the second leg part so as to protrude toward the other side in the insertion direction of the main body part into the space.

9. The connector according to claim 8, wherein
either one of the first and second mounting parts overlaps with the housing when the housing is viewed along the direction normal to the mounting surface in a state where the terminal is held by the housing and mounted on the mounting member.

10. The connector according to claim 1, comprising:
a plurality of the terminals,
wherein the mounting parts are arranged in a staggered pattern in a state where the plurality of terminals are held by the housing.

11. The connector according to claim 1, wherein
the main body part includes a bottom wall and a side wall provided continuously from the bottom wall,
a tip of the side wall is inserted into the groove such that the groove guides insertion of the main body part into the space,
the space includes an insertion opening opened toward the outside of the housing and an insertion main cavity which communicates with the insertion opening and in which to house the main body part of the terminal, and
the groove is formed in the insertion main cavity.

12. The connector according to claim 11, wherein
a length of the groove in an insertion direction is not shorter than a distance by which the main body part moves between the start and end of insertion of the tip of the side wall.

13. The connector according to claim 11, wherein
the groove extends beyond the center of the space to an inner side of the space in the insertion direction.

14. The connector according to claim 11, wherein
the insertion opening has a second groove formed therein to guide insertion of the main body part into the space, and
the second groove communicates with the groove.

15. The connector according to claim 11, wherein
the side walls are provided continuously from both ends of the bottom wall in the width direction, and
one of the side walls has an extension wall formed therein, which protrudes, more than the other side wall, in the insertion direction of the main body part into the space.

16. A connector terminal used in the connector according to claim 15.

17. A connector comprising:
a plurality of terminals to which an electric wire is connected respectively;
a housing having a plurality of spaces formed therein, into which the terminal is inserted respectively; and
a retainer attached to the housing, and to restrict fall-off of the terminals from the housing,
wherein the terminals each include
a terminal main body part having a peripheral wall extending in an insertion direction of the terminal into the space,
a contact part provided continuously from one side, in the insertion direction, of the terminal main body part, and
an electric wire connector part provided continuously from the other side, in the insertion direction, of the terminal main body part, and to have the electric wire connected thereto,
wherein a first insertion hole is formed in the peripheral wall,
wherein a second insertion hole, facing the first insertion hole, is formed in the peripheral wall,
wherein the contact part is formed at a position off the center of the electric wire extending in the insertion direction, when viewed along the insertion direction,
wherein a distance between the first insertion hole and the contact part is larger than a distance between the second insertion hole and the contact part,
wherein the spaces include a first space and a second space,
wherein the retainer includes
a third space formed therein, and a retainer main body, to be slid into the housing in a direction crossing the insertion direction, which includes a first restrictive protrusion and a second restrictive protrusion, wherein the terminals include a first terminal and a second terminal, and wherein when the retainer is attached to the housing, and the first terminal and the second terminal are inserted into the housing, (i) the first terminal is inserted into a fourth space where the first space overlaps with the third space and the second terminal is inserted into the second space, (ii) a distance between the contact part of the first terminal and the contact part of the second terminal is smaller than a distance between the first insertion hole of the first terminal and the first insertion hole of the second terminal, (iii) a distance between the first insertion hole of the first terminal and the first insertion hole of the second terminal is larger than a distance between the second insertion hole of the first terminal and the second insertion hole of the second terminal, and (iv) the first restrictive protrusion is inserted into the first insertion hole the second protrusion is inserted into the second insertion hole.

18. The connector according to claim 17, wherein the first and second spaces are formed in a staggered pattern when the housing is viewed along the insertion direction.

* * * * *